US008610311B1

(12) United States Patent
Grimes

(10) Patent No.: US 8,610,311 B1
(45) Date of Patent: Dec. 17, 2013

(54) PASSIVE POWER GENERATION SYSTEM

(75) Inventor: Sean N. Grimes, Davis, CA (US)

(73) Assignee: Energy Magnification Corporation, Clarksburg, CA (US)

( * ) Notice: Subject to any disclaimer, the term of this patent is extended or adjusted under 35 U.S.C. 154(b) by 968 days.

(21) Appl. No.: 12/657,778

(22) Filed: Jan. 26, 2010

Related U.S. Application Data

(60) Provisional application No. 61/206,086, filed on Jan. 27, 2009.

(51) Int. Cl.
*H01F 27/42* (2006.01)
*H01F 38/00* (2006.01)

(52) U.S. Cl.
USPC ..... 307/104; 307/416

(58) Field of Classification Search
USPC ..... 307/416, 104
See application file for complete search history.

(56) References Cited

U.S. PATENT DOCUMENTS 514,168 A 2/1894 Tesla
593,138 A 11/1897 Tesla
645,576 A 3/1900 Telsa
649,621 A 5/1900 Tesla
685,953 A 11/1900 Tesla
685,955 A 11/1901 Tesla
787,412 A 4/1905 Tesla
1,119,732 A 12/1914 Tesla
5,051,881 A 9/1991 Herold
6,100,665 A 8/2000 Alderman
6,414,403 B2 7/2002 Kitagawa et al.
7,095,126 B2 8/2006 McQueen
7,825,606 B2 * 11/2010 Yang et al. ..... 315/247
2006/0256592 A1 11/2006 Yoshida
2007/0007844 A1 1/2007 Barbat

OTHER PUBLICATIONS

Nokila Tesla, with addition material by David Hatcher Childress, The Fantastic Inventions of Nikola Tesla, ISBN 0-932813-19-4 Copyright 1993, See especially Chapters 2, 4, & 8.

* cited by examiner

*Primary Examiner* — Jared Fureman
*Assistant Examiner* — Dru Parries
(74) *Attorney, Agent, or Firm* — Dennis A. DeBoo; Audrey A. Millemann; Weintraub Tobin Law Corp.

(57) ABSTRACT

A passive power generation system comprised of a magnification device for magnifying energy and a recovery device operatively coupled to the magnification device for recovering at least a portion of the magnified energy and a method for making the passive power generation system for magnifying and recovering energy.

27 Claims, 40 Drawing Sheets

PASSIVE POWER GENERATION SYSTEM

CROSS-REFERENCE TO RELATED APPLICATIONS

This application claims priority under 35 USC Section 119(e) to U.S. Provisional Patent Application No. 61/206,086, filed Jan. 27, 2009 the entire disclosure of which is incorporated herein by reference.

FIELD OF THE INVENTION

This invention relates generally to passive power generation systems and, in particular, to a passive power generation system comprised of a magnification device for magnifying electricity or energy, a recovery device for recovering at least a portion of the magnified electricity or energy, and a coupling between the two devices. This invention also relates to methods for making and using the passive power generation system which, in one aspect, includes a use for local power recovery applications. Additionally, this invention also relates to standalone uses for the magnification device.

BACKGROUND OF THE INVENTION

Energy resources and the conservation of energy are at the forefront of today's most critical issues. Increasing the efficiency of providing electrical power would address at least one these issues.

In U.S. Pat. No. 787,412, issued Apr. 18, 1905, Nikola Tesla discloses an improvement in the art of transmitting electrical energy through the natural media. In particular, Tesla discloses a single transformer comprised of a primary coil (A) consisting generally of a few turns of a stout cable of inappreciable, resistance, the ends of which are connected to the terminals of a source of powerful electrical oscillation and a spirally-wound secondary coil (C) within the primary having the end nearer to the latter connected to the ground (E') and the other end to an elevated terminal (E). Tesla also discloses that the physical constants of the secondary coil, determining its period of vibration, are so chosen and adjusted that the secondary system (E' C E) is in the closest possible resonance with the oscillations impressed upon it by the primary coil.

Tesla further discloses at least the following three principles. First, Tesla discloses that in order to magnify the electrical movement in the secondary as much as possible, it is essential that its inductive connection with the primary (A) should not be very intimate, as in ordinary transformers, but loose, so as to permit free oscillation that is to say, their mutual induction should be small. Second, Tesla discloses that the electrical movement produced in the secondary system by the inductive action of the primary will be enormously magnified, the increase being directly proportionate to the inductance (L) and frequency (f) and inversely to the resistance (R) of the secondary system. Third, Tesla discloses that the total length of the conductor from the ground-plate (E') to the elevated terminal (E) should be equal to one-quarter of the wave length of the electrical disturbance in the system (E' C E) or else equal to that length multiplied by an odd number. This is known as spatial resonant tuning using the quarter wavelength, or an odd integer multiple of it. Accordingly, spatially tuned resonance was all Tesla disclosed.

Notwithstanding, Tesla failed to discover and solve the problem of providing practical magnification of electricity or energy and local recovery of the magnified electricity or energy.

BRIEF SUMMARY OF THE INVENTION

This instant invention is distinguished over the known prior art in a multiplicity of ways. For one thing, applicant has discovered a solution to the problem of providing practical magnification of electricity or energy and local recovery of the magnified electricity or energy. Additionally, an embodiment of the invention is differentiated over the known prior art in that applicant utilizes temporal resonance to achieve a less frequency stable, but more powerful version of magnification technology. In a device having a primary coil and a secondary coil, the temporal resonance of the secondary coil is due to the self-inductance and self-capacitance of the secondary coil. To determine the temporal resonance, one drives the primary coil at a constant voltage while changing a drive frequency of the primary coil, until the voltage reading on the secondary coil is at the maximum value; that frequency is the temporal resonant frequency of the secondary coil. Furthermore, an embodiment of the invention is differentiated over the known prior art in that applicant utilizes both spatial and temporal resonance together to create a powerful and frequency stable version of magnification technology. These two discoveries can be made to every device that Nikola Tesla describes in U.S. Pat. No. 787,412, issued Apr. 18, 1905, as well as in U.S. Pat. No. 1,119,732 issued Dec. 1, 1914 and for more powerful wireless power applications as well. Accordingly, applicant has discovered a solution to the problem of creating the most powerful form of magnification technology; whether used in newly created local recovery applications or in the above noted disclosures by Nikola Tesla.

In one aspect, an embodiment of the invention provides a passive power generation system comprised of a first section operatively coupled to a second section wherein the first section comprises a magnification device for magnifying energy and wherein the second section comprises a recovery device for recovering at least a portion of the magnified energy for use in, for example, local power magnification applications.

In another aspect, the passive power generation system is comprised of a high frequency magnification device operatively coupled to a high frequency recovery device for magnifying energy and for recovering at least a portion of the magnified electricity or energy.

In another aspect, the passive power generation system is comprised of a power frequency magnification device operatively coupled to a power frequency recovery device for magnifying energy and for recovering a portion of the magnified electricity or energy.

In another aspect, the magnification section can be thought of as a transmitter for local and/or planetary applications and the recovery section can be thought of as a receiver for local applications.

In another aspect, the first section of passive power generation system (the magnification section) has standalone applications as a wireless power transmitter (WPT), a measurement device, a physical example of the open circuit current content phenomenon, and as a demonstrative device for showing the existence of new forms of electrical energy and new electrical behaviors.

In another aspect, an embodiment of the invention provides a magnification section, comprising: a primary winding having a first number of turns and driven at a drive frequency; and a secondary winding disposed concentric with the primary winding and having a second number of turns greater than the first number of turns for providing an inductive time constant greater than a time between cycles of the drive frequency for allowing currents induced in the secondary winding by the primary winding to superimpose for magnifying energy so long as a portion of the secondary winding remains electrically free relative to the primary winding.

In another aspect, an embodiment of the invention provides a wireless power transmitter, comprising: a primary winding having a first number of turns and driven at a drive frequency; a secondary winding disposed concentric with the primary winding and having a second number of turns greater than the first number of turns for providing an inductive time constant greater than a time between cycles of the drive frequency for allowing currents induced in the secondary winding by the primary winding to superimpose for magnifying energy so long as a portion of the secondary winding remains electrically free relative to the primary winding; and wherein a temporal resonant frequency of the secondary winding is substantially equal to the drive frequency.

In another aspect, an embodiment of the invention provides a passive power generation system, comprising: a magnification section comprising: a first primary winding loosely coupled to a first secondary winding wherein the first primary winding is electrically coupled to a generator for being driven at a drive frequency; the first secondary winding comprised of a first portion having a first magnetic link with the first primary winding and a second portion having a second magnetic with the first primary winding that is a percentage of the first magnetic link that achieves a magnification factor so that the first secondary winding will oscillate at the drive frequency; a recovery section comprising: a second primary winding loosely coupled to a second secondary winding; the second primary winding of the recovery section electrically coupled in series with the first secondary winding of the magnification section for defining a secondary and primary series coupling; and a capacitive coupling means electrically coupled in series with the secondary and primary series coupling for tuning the recovery section to have a recovery drive frequency substantially equal to the drive frequency of the magnification section.

In a further aspect, an embodiment of the invention provides a magnification section, comprising: a secondary winding comprised of a first winding portion and a second winding portion; a primary winding driven at a drive frequency and located relative to the first winding portion and the second winding portion of the secondary for inducing an electric field strength differential between the first winding portion and the second winding portion of the secondary wherein the electric field strength induced in the first winding portion is greater than the electric field strength induced in the second winding portion by an electric field strength amount that achieves a magnification factor; and wherein the primary winding includes a first number of turns and the secondary winding includes a second number of turns greater than the first number of turns of the primary for providing an inductive time constant for the secondary winding that is greater than a time between cycles of the drive frequency for allowing currents induced in the secondary winding by the primary winding to superimpose for magnifying power in the secondary as a function of the magnification factor.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
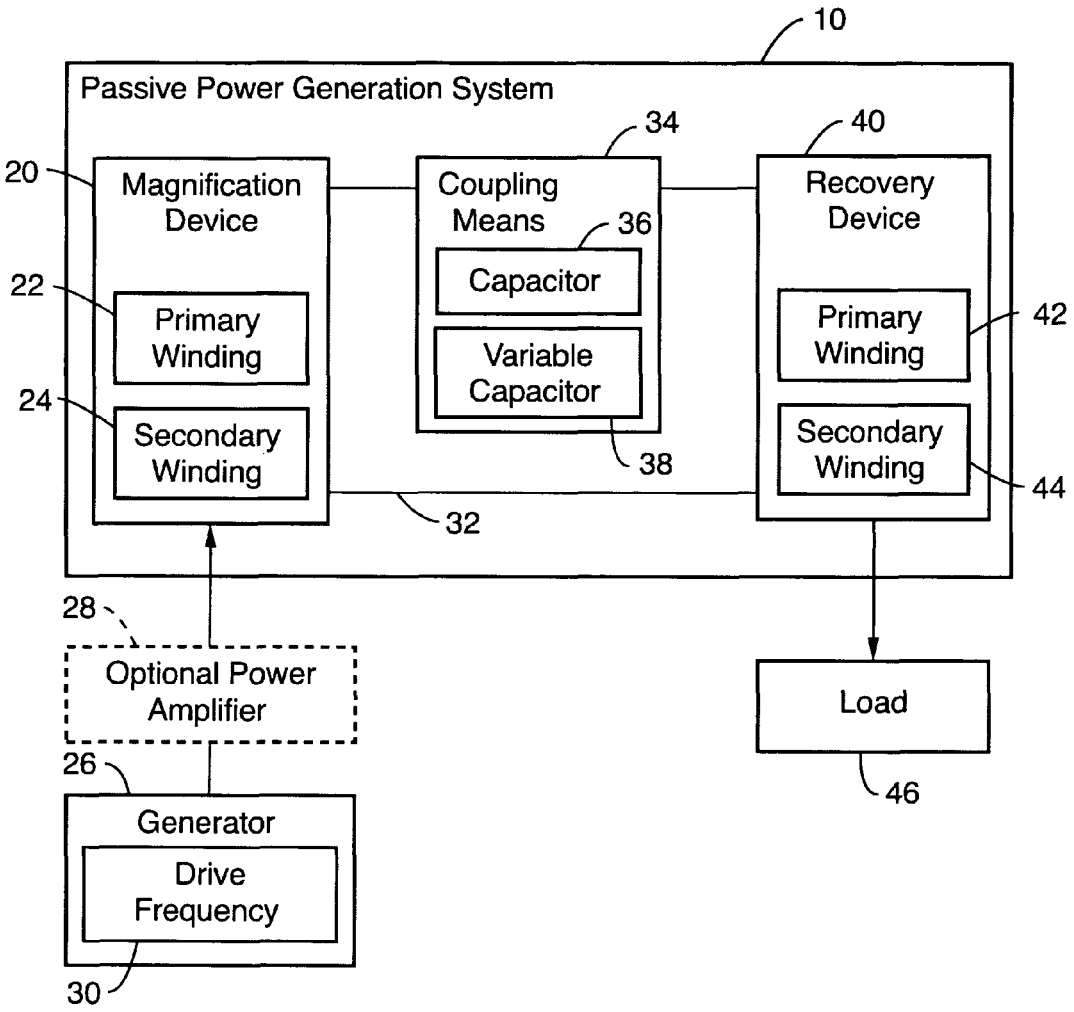
FIG. 1 is a block diagram view of an embodiment of a passive power generation system operatively coupled between a generator and a load.

The following introductory material is provided before delineating a detailed description of a passive power generation system 10 for assisting in a clear understanding of the passive power generation system.

Introductory Material

The passive power generation system 10 has roots in the known laws of physics and is a novel, unobvious, and useful category of an electrical system that uses Faraday's Law and the principle of the conservation of energy in a novel, unobvious, and useful manner. Faraday's law of induction deals with the idea of "fields." A field is a concept used by physics to avoid action at a distance. If a field is present, the field is acting on a particle (such as an electron) and explains particle motions due to the field present at its location. "Flux" is a particular field's strength over some unit area. When we map the field into three-dimensional space we have a flux over some two-dimensional cross-section of that space. Faraday's law states that a changing magnetic flux produces an electric field and is conventionally written in the following equation format.

$$\oint E \cdot ds = -\frac{d\Phi_B}{dt} \quad \text{(Faraday's Law)}$$

Hence, if there are conductors present in the electric field, then current will flow in the conductors.

The accepted form for a one dimensional electrical wave in a loss-less medium is given by y(x,t)=A cos(wt−Bx+phi). This general equation keeps track of two components, one for a spatial parameter (x) and a latter for temporal parameter (t). Tesla describes creating a resonant device using only the spatial parameter (x) of the general equation given above. The temporal parameter also provides for an even more powerful form of the devices Nikola Tesla disclosed in U.S. Pat. No. 787,412, issued Apr. 18, 1905. Applicant has discovered that an overlap of both spatial and temporal resonances provides a most ideal and preferred method. It is of interest to note that the phase shift (phi) is simply a temporal offset component. That is, phi plays no part in the spatial parameters in the general equation. Spatial resonance (in this case) has to do with how a wave fits on a wire depending on that wires length and the speed of voltage propagation along that wire.

A spatial wave is at its maximum amplitude at its quarter and three-quarter wavelengths and is in spatial resonance for any odd integer multiple of the quarter wavelength. This provides a frequency stable system since wire length does not change appreciably under real world environmental changes. The speed of light is 186,282 miles/second. Therefore to find the full wavelength divide the speed of light by the frequency. Then divide the result by four to obtain the quarter wave length. This works since in a coil, the voltage propagates at near the speed of light.

It is a common misconception that electric potential (voltage) has meaning for induced electric fields. In fact, electric potential has no meaning for induced fields. The concept of electric potential applies to static charges, where a field line begins at one type of charge and ends at another. Induced electric fields form complete circles, so the concept of electric potential does not apply and cannot be defined inside a region of changing magnetic flux.

We can define electric potential across an inductor by separating the internal resistance from the self-inductance, and imagining the potential to exist across the resistance alone, assuming the points of measurement are outside the region of changing flux. So for an inductor, we can specify the self-induced electro-motive force using a loop. This self-induced electro-motive force for the inductor is conventionally written in the following equation format.

$$\varepsilon_L = -L\frac{di}{dt} \text{ (Self-induced } emf\text{)}$$

The following conventional differential equation describes the general behavior of current over time in an RL circuit, as would be understood by one of ordinary skill in the art and informed by the present disclosure. This conventional differential equation is obtained by the loop rule that is a direct expression of the principle of the conservation of energy.

$$L\frac{di}{dt} + Ri = \varepsilon \text{ (}RL\text{ circuit)}$$

The solution to this conventional differential equation results in the formula for inductive current decay that is conventionally written in the following equation format.

$$i = \frac{\varepsilon}{R}e^{-i/\tau_L} = i_O\, e^{-i/\tau_L} \text{ (current decay)}$$

And wherein the time constant is conventionally written in the following equation format.

$$\tau_L = \frac{L}{R} \text{ (time constant)}$$

Accordingly, this states that current will decay (in the DC case) from its initial value based on the inductive time constant. After one time constant the value of the current will be 37% of its original value. That current cannot change instantly in an inductor is another common way to state this concept. The root-mean-squared AC current value can also be used in this equation for the AC case.

Magnetic energy for an inductor represents the total energy stored by an inductor carrying a DC current, and can be stated by the following conventional equation.

$$U_B = \frac{1}{2}Li^2 \text{ (magnetic energy)}$$

The root-mean-squared AC current value can also be used in this equation for the AC case. Combining the inductive current decay and the stored magnetic energy equations can be used for showing by calculation that the stored energy will reach half of the original value after 1.23 time constants. This can be explicitly by the following equation:

$$\frac{t}{\tau_L} = -\ln 0.293 = 1.23$$

wherein $t \approx 1.2\tau_L$.

The (L/R) ratio dictates how long energy will remain in the system. When an electrical system is created which takes a long time for current to dissipate from, and is induced by current faster than it is allowed to dissipate; the energy is greatly magnified. This is because the conservation of energy does not allow energy to leave this system as fast as it enters. Therefore a net energy buildup over time occurs.

A magnification factor (M) is defined as the operational frequency (f) times the (L/R) ratio. In equation form MF=f*(L/R). This equation gives an approximation as to the potential the system 10 has to magnify electricity or energy. There is another requirement that at least a portion of the secondary coil be electrically free.

Electrically free means that the induced electric field in the secondary has fallen off to at least 50% of its original value near the primary windings. The simplest case is that the primary is wound concentric on the outside of the secondary on a former. In that case, the center axis of the transformer has zero electric field strength, and it increases linearly toward the primary through the secondary windings. Therefore in that case there are two ways to create a free geometry. First, one may insure some secondary windings are at least half the distance to the center of the former. Second, many windings may be intimate with the primary and have a large mutual inductance with its coil continuing to another set of windings located near the center of the former. Either of these simple geometries will insure at least a portion of the secondary coil will remain electrically free. The case with the primary wound concentric on the inside of the secondary will be covered in the material to follow. Either primary location may be designed suitably to provide for a portion of the secondary coil to be electrically free.

This introductory material concludes with the detail that ordinary transformers are typically characterized by using only their mutual inductance, since ideal transformer theory assumes one hundred percent magnetic flux linkage between the primary and secondary coils. This insures that the difference in voltages and currents across the transformer will be defined by the turns ratio independent of the magnification factor since no portion of the secondary coil is electrically free.

For example, the ideal transformer is typically modeled as having two coils of wire wound around a permeability enhancing hollow rectangular core wherein a primary winding (or primary) having Np turns is wound around one leg of the rectangular core and is connected to an input AC voltage source or generator having an output Vs and wherein a secondary winding (or secondary) having Ns turns is wound around the opposing leg of the rectangular core and is connected to a load resistor R.

Then, Faraday's law is employed with the assumption that that no flux leaks out of the core to obtain the following two conventional equations.

$$V_s = V_p \frac{Ns}{Np} \quad \text{(transformation of voltage)}$$

$$I_s = I_p \frac{Np}{Ns} \quad \text{(transformation of currents)}$$

Passive Power Generation System 10

Turning now to the Drawings, wherein like numbers denote like parts throughout the several views, and in one embodiment, reference numeral 10 is directed to a passive power generation system.

Referring to FIG. 1, and in one embodiment, the passive power generation system (PGS) 10 is comprised of a magnification section or device 20 for magnifying electricity or energy, a recovery section or device 40 for recovering at least a portion of the magnified electricity or energy, and a series and capacitive coupling means 32, 34 for operatively coupling the magnification device 20 to the recovery device 40. In one embodiment of use, the passive power generation system 10 is coupled to a generator 26 for receiving an alternating current power at a drive frequency 30 which is magnified by the magnification device 20, recovered by the recovery device 40, and delivered to a load 46.

Magnification Section or Device 20

More specifically, the magnification section or device 20 is comprised of a primary coil or winding 22 and a secondary coil or winding 24. The primary winding 22 is electrically coupled to the generator 26 via an optional power amplifier 28 for providing alternating current power at a drive frequency 30 to the primary winding 22 which is magnified by the magnification device 20.

The magnification device 20 requires consideration of both mutual and self-inductive properties. Specifically, the self-inductance and inductive time constant of the secondary winding 24 are of particular importance to enable the magnification of energy. Herein, power is defined as energy per duration of time. In the magnification device 20, the secondary winding 24 must be kept partially free from the primary winding 22 so the turns ratio is therefore no longer the only deciding factor in the resulting secondary behavior. Additionally, the self-inductance must be made large compared to the self-resistance of the secondary winding 24; and this ratio times the intended drive frequency 32 of the generator 30 must be made as large as possible. That is, the magnification factor MF must be made as large as possible wherein the magnification factor is equal to the drive frequency multiplied by inductive time constant or MF=(f*L)/R. Accordingly, a core technological component of any passive power generation system 10 is the magnification device 20.

In one embodiment, the magnification device 20 is a high frequency magnification section or device 50 operating above about 1 kHz. In another embodiment, the magnification device 20 is a power frequency magnification section or device 140 that covers the power frequencies of, for example, fifty (50) Hertz to about one (1) kHz. In one embodiment, the high frequency magnification device 50 is typically an air-core device while the power frequency magnification device 140 may be a ferric-core device. The high frequency magnification device 50 and the power frequency magnification device 170 will be further delineated hereinbelow.

Recovery Section or Device 40

Still referring to FIG. 1, and in one embodiment, the passive power generation system 10 is further comprised of the recovery section or device 40 for recovering at least a portion of the magnified electricity or energy.

Similar to the magnification section or device 20, the recovery section or device 40 is comprised of a primary coil or winding 42 and a secondary coil or winding 44. In one embodiment, the primary winding 42 of the recovery device 40 is electrically coupled in series with the secondary winding 24 of the magnification device 20 for defining a secondary and primary series coupling 32. Additionally, and in one embodiment, a capacitive coupling means 34 is electrically coupled in parallel with the secondary and primary series coupling 32 for providing a means for tuning the recovery device 40 to have a resonant frequency substantially equal to a resonant frequency of the magnification device 20.

In one embodiment, the capacitive coupling means 34 directly couples the recovery device 40 to the magnification device 20 via a direct electrical coupling that takes into account three considerations. The first deals with the fact that the open circuit current content will be disturbed whenever a free portion of the secondary winding 24 and the primary winding 42 ceases to become free. This can occur in many circumstances including: proximity to iron, proximity to concrete, proximity to other magnetic fields, proximity to other conductors, and external connections. Therefore, the direct coupling of the recovery device 40 to the magnetic device 20 requires resonant tuning that is undisturbed by the local environmental conditions. The second required consideration is the use of a lumped sum element that has already been resonantly tuned to the magnification device 20 as the primary winding 42 of the recovery device 40. The third required consideration is to use a capacitive coupling between these two resonantly tuned windings 24, 42 to preserve a difference in phase for the voltage between them.

Accordingly, and in one embodiment, the direct coupling means is the capacitive coupling means 34. Additionally, the capacitive coupling means 34 should be attached at a specific physical location, where the AC current is measured to be the greatest near the end of the magnification device output wire, where the wire is kept outside the region of significant changing magnetic flux.

Although the passive power generation system 10 may be tuned to a variety of operational frequencies, it has been experimentally found that an operational frequency that is one quarter of the temporal resonance of both the magnification and recovery sections 20, 40 is particularly well suited.

When using the passive power generation system 10 there are two preferred methods to achieve resonant operational tuning. Either of these methods can be used individually, or they can be used in conjunction with each other. First, if a variable frequency source or generator 26 is used, then the capacitive coupling means 34 employs a single non-variable capacitor 36 for joining the two passive power generation system devices 20, 40, and the source or generator 26 can be varied to achieve the resonant operational tuning. Second, if a single frequency source or generator 26 is employed, the capacitive coupling means 34 can add a variable capacitor 38 in parallel with non-variable capacitor 36 to achieve the resonant operational tuning. The use of a lumped sum element helps to preserve the freedom of the magnification device 20 as the recovery device 40 externally loads it.

The value of capacitance C of the capacitive coupling means 34 shall be selected from one of two equations. It is usually sufficient for high frequency systems to simply use the standard resonant equation for LC circuits to determine the value C of the capacitive coupling means 34. Accordingly, the value C can be determined through a first equation: $C=1/(4*\pi^2 f^2*(2*L))$ wherein $\pi$=pi, f is the drive frequency 30, and L is the value of the inductance of the secondary winding 24 of magnification device 20 which is also equal to the inductance of the primary 42 of the recovery device 40 and thus, the multiplication of L by two. Alternatively, the value C can be determined through a second equation: $C=1/(4*\pi^2*f^2*(LmagS+LrecP))$ where $\pi$=pi, f is the drive frequency 30, LmagS is a value of inductance of the secondary winding 24 of the magnification section 20, and LrecP is a value of inductance of the primary winding 42 of the recovery section 40.

In one embodiment, the secondary winding 24 of magnification device 20 has a temporal resonant frequency that is four times its drive frequency 30 and a spatial resonant frequency equal to the drive frequency 30. Additionally, and in one embodiment, the primary 42 of the recovery device 40 has substantially the same temporal and spatial resonant frequencies as the secondary winding 24 of magnification device 20. Since the recovery device 40 is also a unique transformer, its secondary winding 44 forms the output circuit for the passive power generation system 10.

In one embodiment, a general design criteria method for magnification section 20 is comprised of the following steps: (1) Providing weak coupling geometry producing a free oscillation on the secondary winding 24 along with a large predicted value for the magnification factor as delineated above. The turns of the secondary winding 24 that are most strongly magnetically linked to the primary winding 22 only make up a portion of the secondary coil; however, the current induced in these few linked turns must traverse the entire length of the secondary winding 24. This geometry provides for a free oscillation to build up on the secondary winding 24. (2) Adjusting the temporal resonance of the magnifying secondary winding 24 to four times the intended drive frequency 30. (3) Adjusting the length of the conductor forming the secondary winding 24 to the lowest possible odd integer multiple of a quarter (¼) wavelength of the intended drive frequency 30. The wavelength is found by dividing the velocity of wave propagation by the self-resonant frequency (or four times the drive frequency). If the secondary wire is an excellent conductor, such as magnetic copper wire, then this velocity will be close to the speed of light.

Additionally, and in one embodiment, a general design criteria method for the recovery section 40 is comprised of the following steps: (1) forming the primary winding 42 of the recovery device 40 to closely match the secondary winding 24 of the magnification device 20. In one embodiment, the method utilizes the lumped-sum element property delineated above to avoid affecting the resonant operation. As the two sections 20, 40 are joined through the capacitive coupling means 34 that passes alternating current, the parallel connection has the effect of reducing the effective inductance by two as it increases the effective capacitance by two. The result of these effective changes produces another, lower resistance element with the same LC resonance. A series connection is similar in that it does not affect the LC resonance, but will increase the effective resistance instead if lowering it. (2) Scaling the system 10 to allow the use of permeability enhancing core material such as laminated iron in the recovery section 40. (3) Adjusting the temporal resonance of the primary winding 42 to four times the drive frequency 30. (4) Adjusting the length of the primary winding 42 to an odd integer multiple of the a quarter (¼) wavelength of the intended drive frequency 30. This length may extend beyond the primary winding 42 so as to not appreciably alter the temporal resonance.

Furthermore, it is important to allow for physical separation from magnetic induction with bodies near the magnification section 20 and recovery section 40 (other than the permeability enhancing core material itself), or with anything else that might interfere with the free oscillation. This includes non-obvious items such as concrete and non-ferric metals, in addition to ferric material. The system 10 must be allowed to set-up its free oscillation and some materials in the vicinity tend to make the system 10 hunt for a stable frequency instead of starting up properly. To allow for reliable operation it is necessary to maintain some distance between such material and the system 10. Plastics and wood isolation mechanisms as well as brass tend to have little to no effect on PGS or WPT operation.

Moreover, a suitable gauge for the secondary winding 44 that will be able to handle the magnified power predicted to be recovered can be chosen from a wire table.

In light of the above, and in one embodiment, the passive power generation system is comprised of a magnification section having a first primary winding loosely coupled to a first secondary winding wherein the first primary winding is electrically coupled to a generator for being driven at a drive frequency; the first secondary winding comprised of a first portion having a first magnetic link with the first primary winding and a second portion having a second magnetic with the first primary winding that is a percentage of the first magnetic link that achieves a magnification factor so that the first secondary winding will oscillate at a resonant frequency and wherein the first secondary winding is formed from a conductor having a length substantially equal to an odd integer multiple of a quarter wave length of the drive frequency; and a recovery section comprising: second primary winding loosely coupled to a second secondary winding; the second primary winding of the recovery section electrically coupled in series with the first secondary winding of the magnification section for defining a secondary and primary series coupling; and a capacitive coupling means electrically coupled in parallel with the secondary and primary series coupling for tuning the recovery section to have a resonant frequency substantially equal to the resonant frequency of the magnification section.

High Frequency Magnification Section or Device 50

In one embodiment, and as noted hereinabove, the magnification device 20 is a high frequency magnification section or device 50.

Referring to FIGS. 2 through 8, the high frequency magnification device 50 is comprised of an air-core insulating spool 52 comprised of a central former 54 having a hollow core 56 circumscribing a central axis 58. The central former 54 axially extends between a first outside flange 60 and a second outside flange 62. The spool 52 is made of materials that are non-conductive (wood, rubber, plastic, paper, et cetera). If fasteners 64 are used to fasten the outsides 60, 62 to the central former 54 then they should not be made of iron, but made of plastic, rubber, or brass instead.

Figure 35:
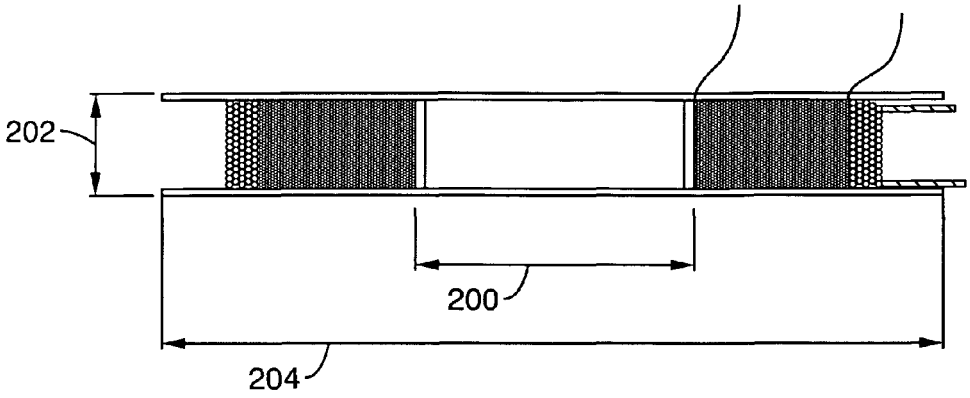
FIG. 35 is a cut-away side elevation view of an example of a thin and flat geometry comprised of a primary winding wound concentric around an outside of a secondary windings.
Figure 36:
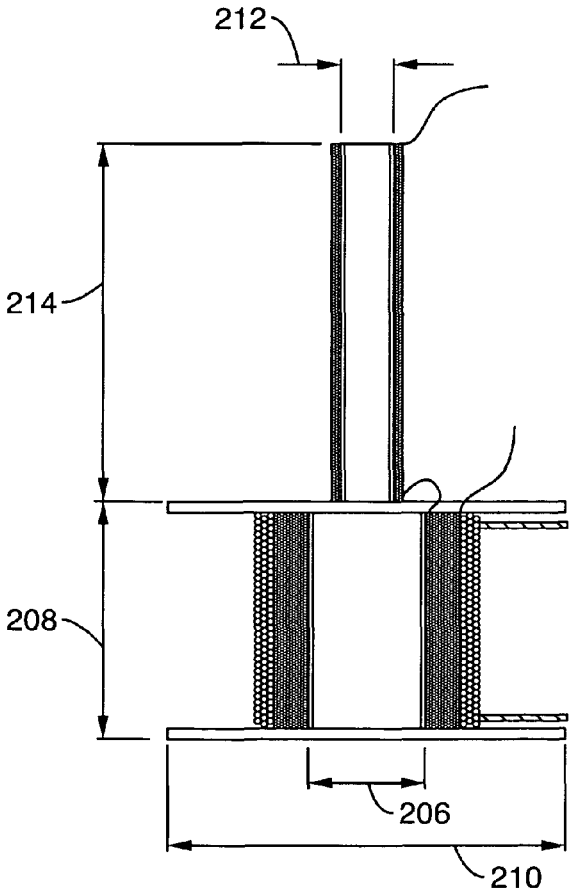
FIG. 36 is a cut-away side elevation view of an example of a geometry comprised of a primary winding wound concentric around an outside of an initial secondary winding, and an additional section of secondary winding separately wound and centered above the initial secondary winding.
Figure 37:
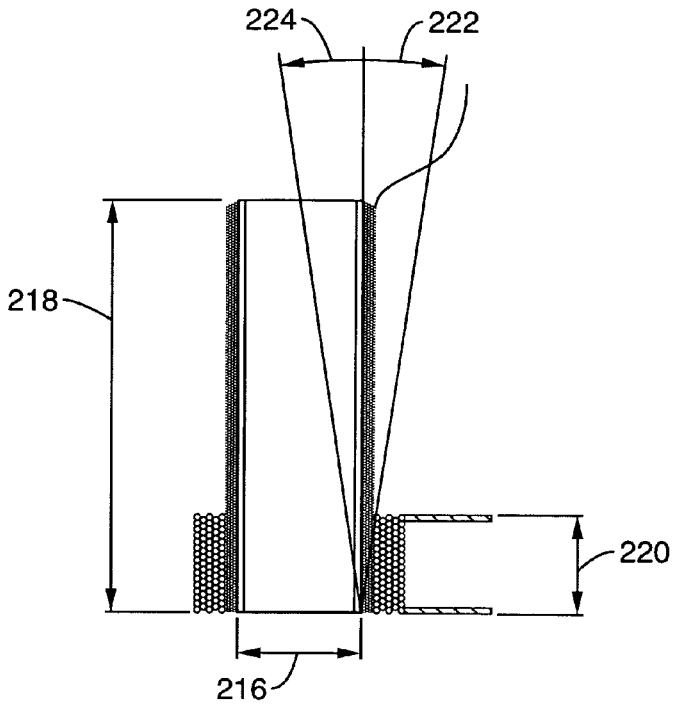
FIG. 37 is a cut-away side elevation view of an example of a column geometry with a primary winding wound concentric around an outside of a secondary winding.
Figure 38:
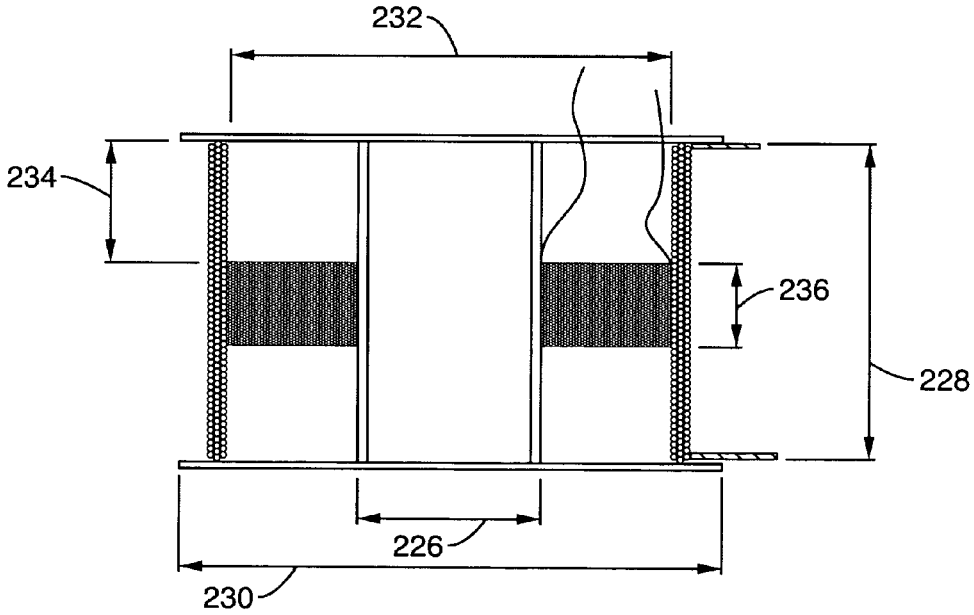
FIG. 38 is a cut-away side elevation view of a first example of a tapered geometry with a primary winding wound concentric around an outside of a secondary winding.
Figure 39:
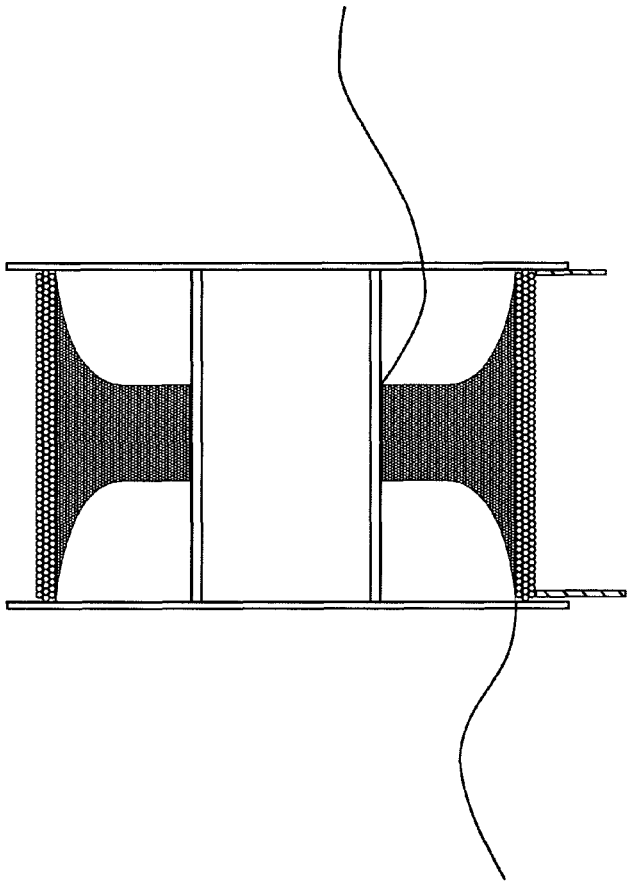
FIG. 39 is a cut-away side elevation view of a second example of a tapered geometry with a primary winding wound concentric around an outside of a secondary winding.
Figure 40:
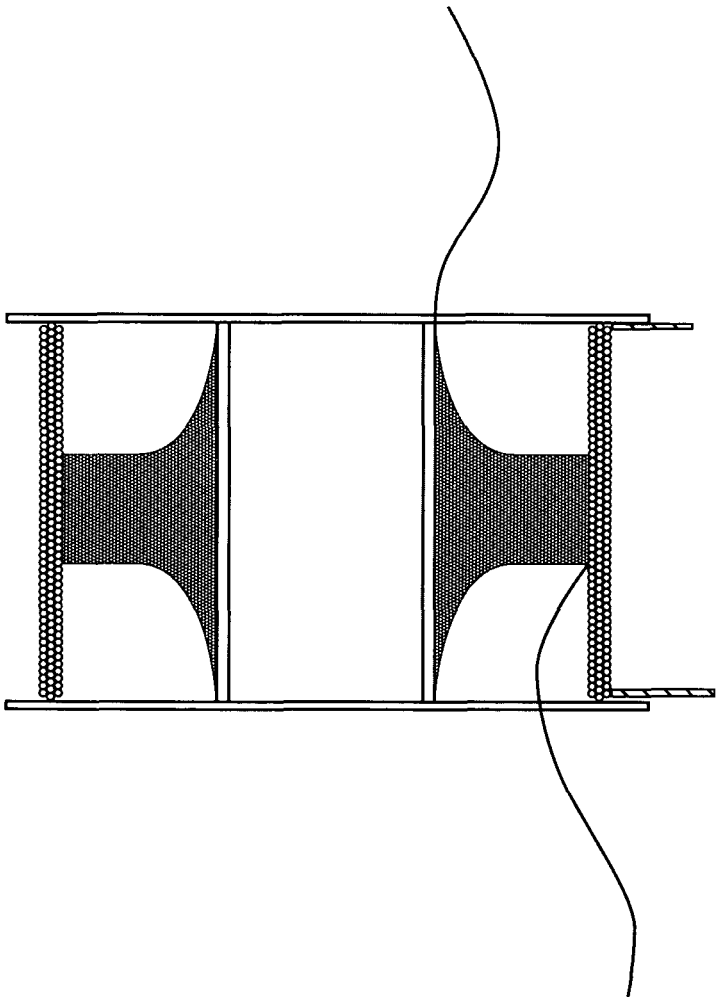
FIG. 40 is a cut-away side elevation view of a third example of a tapered geometry with a primary winding wound concentric around an outside of a secondary winding.
Figure 41:
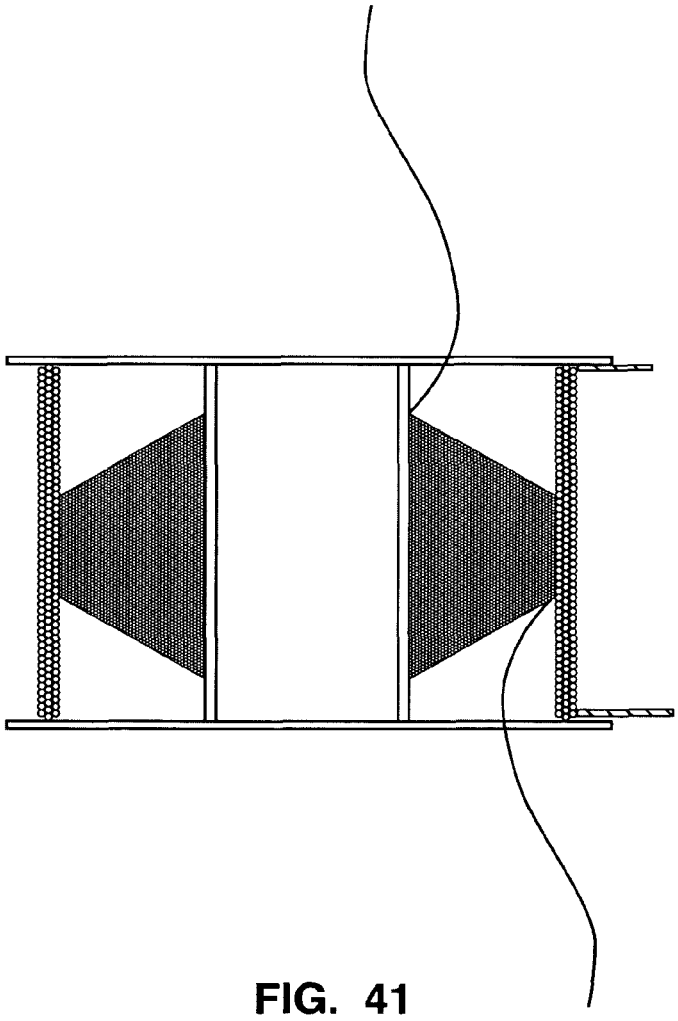
FIG. 41 is a cut-away side elevation view of a fourth example of a tapered geometry with a primary winding wound concentric around an outside of a secondary winding.
Figure 42:
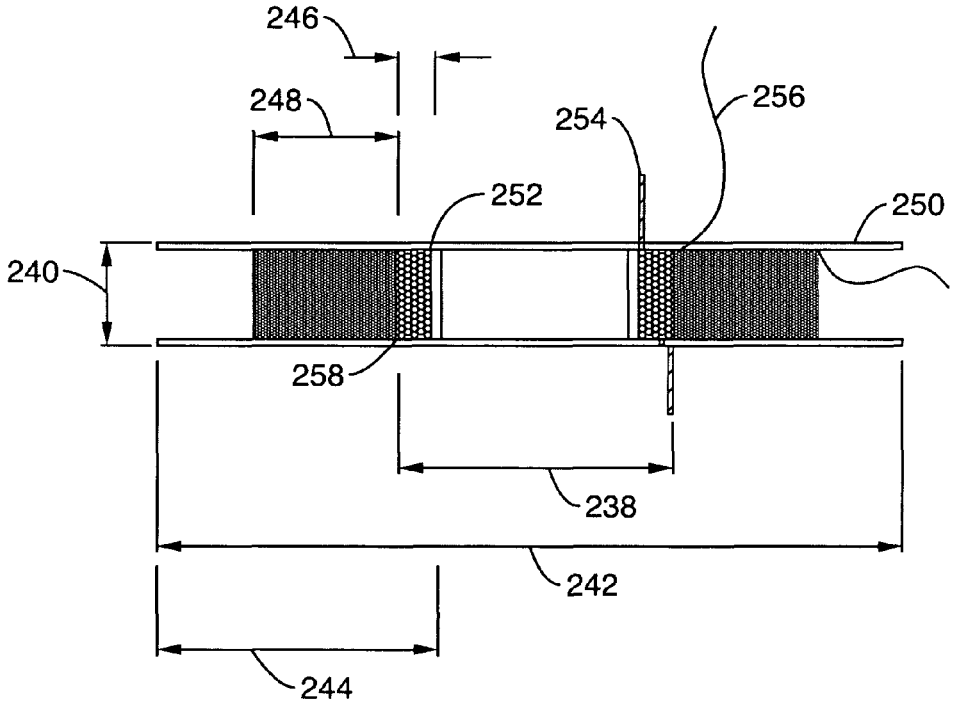
FIG. 42 is a cut-away side elevation view of an example of a thin and flat geometry comprised of a primary winding wound concentric on an inside of a secondary winding.
Figure 43:
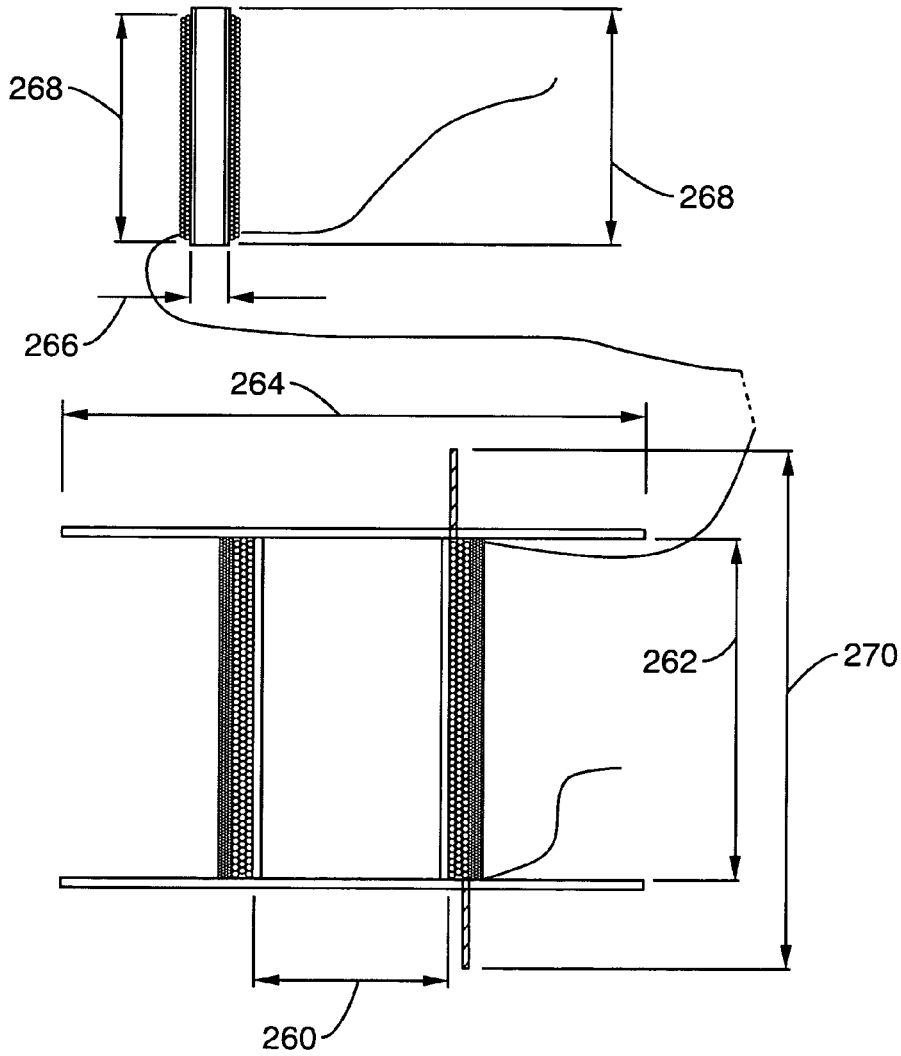
FIG. 43 is a cut-away side elevation view of an example of a remote location geometry with a primary winding wound concentric on the inside of an initial portion of a secondary winding, and an additional portion of the secondary windings being remotely located in an area of electrical freedom.
Figure 44:
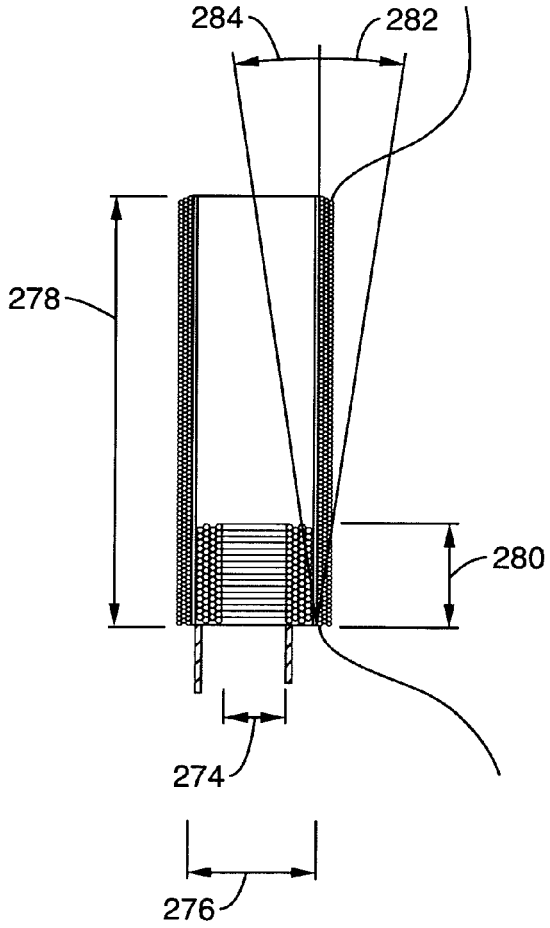
FIG. 44 is a cut-away side elevation view of an example of a column geometry with a primary winding wound concentric on an inside of a secondary winding.
Figure 45:
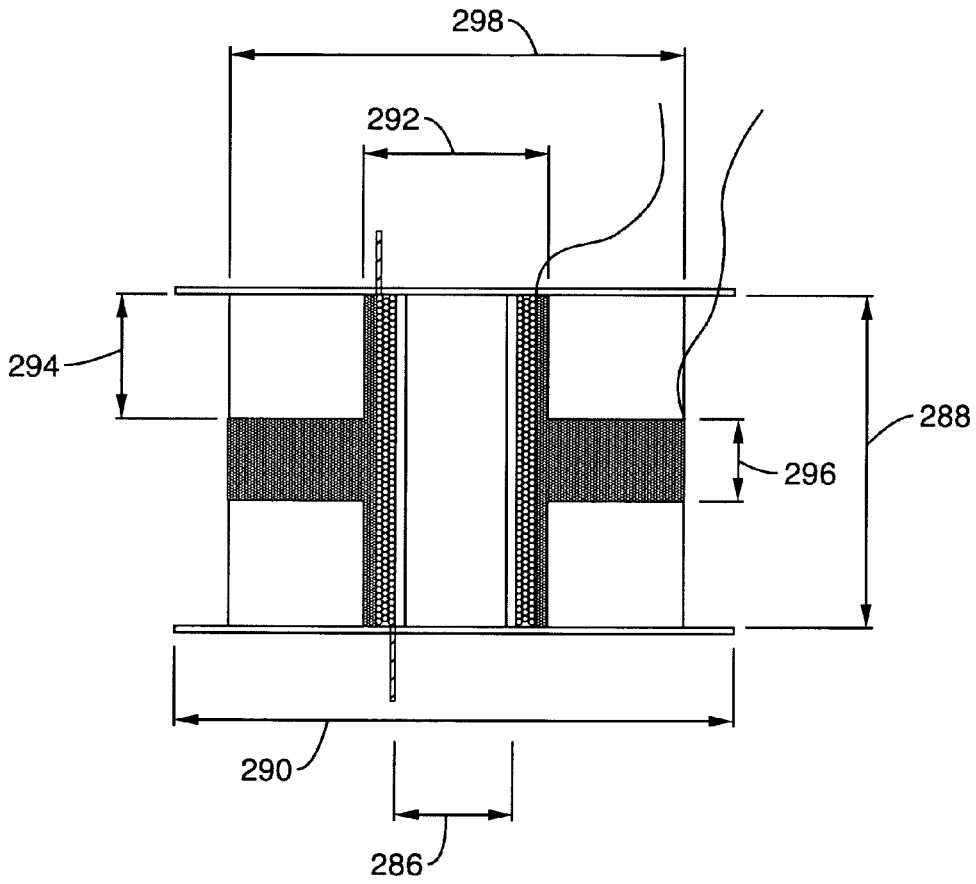
FIG. 45 is a cut-away side elevation view of a first example of a tapered geometry with a primary winding wound concentric on an inside of a secondary winding.
Figure 46:
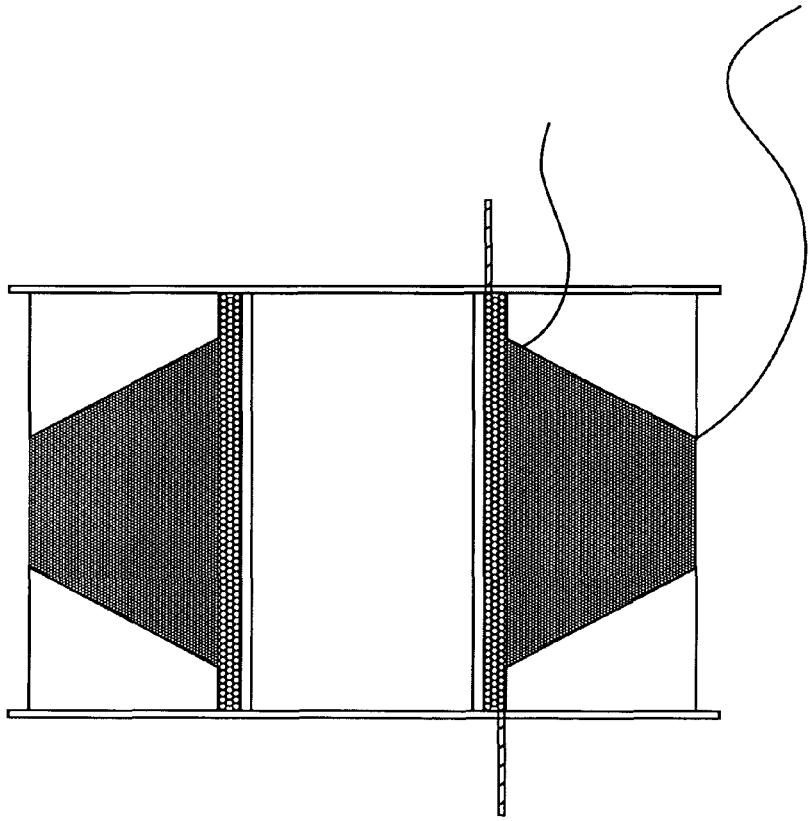
FIG. 46 is a cut-away side elevation view of a second example of a tapered geometry with a primary winding wound concentric on an inside of a secondary winding.
Figure 47:
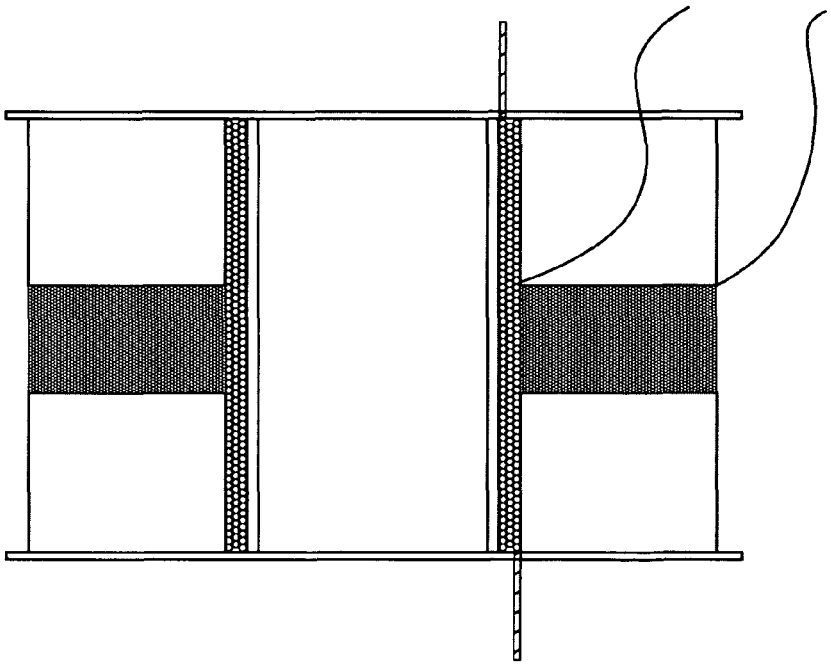
FIG. 47 is a cut-away side elevation view of a third example of a tapered geometry with a primary winding wound concentric on an inside of a secondary winding.
Figure 48:
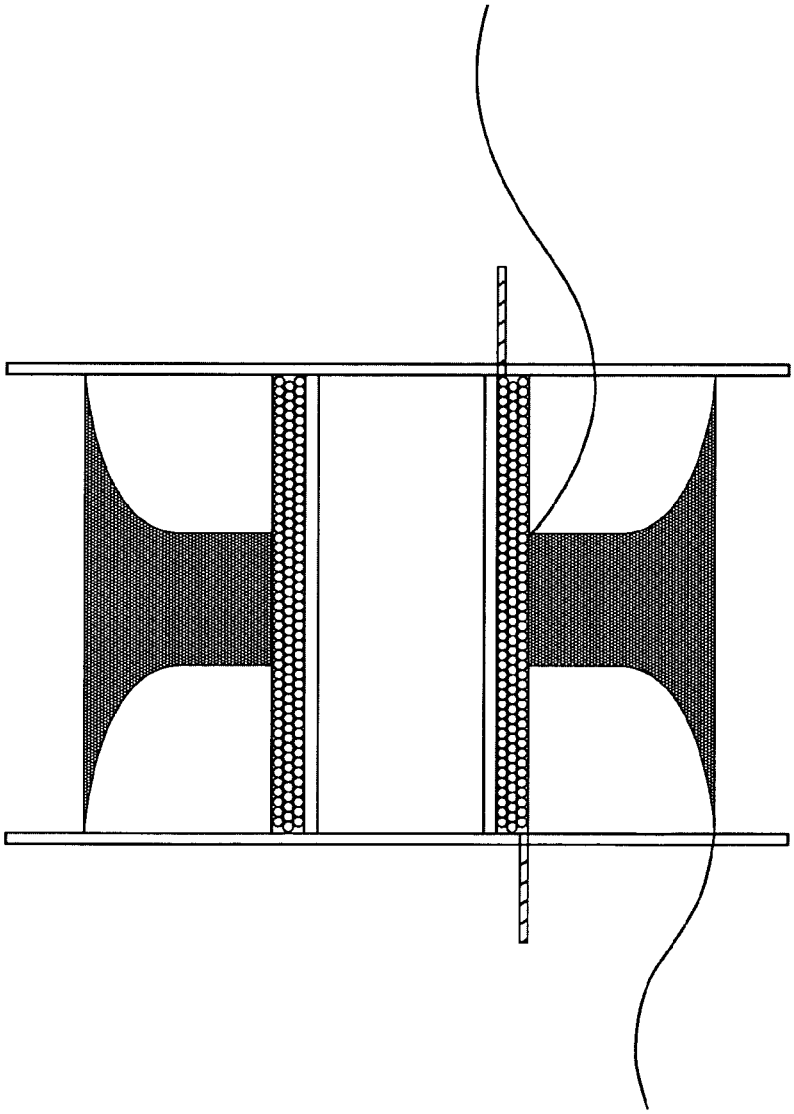
FIG. 48 is a cut-away side elevation view of a fourth example of a tapered geometry with a primary winding wound concentric on an inside of a secondary winding.
Figure 49:
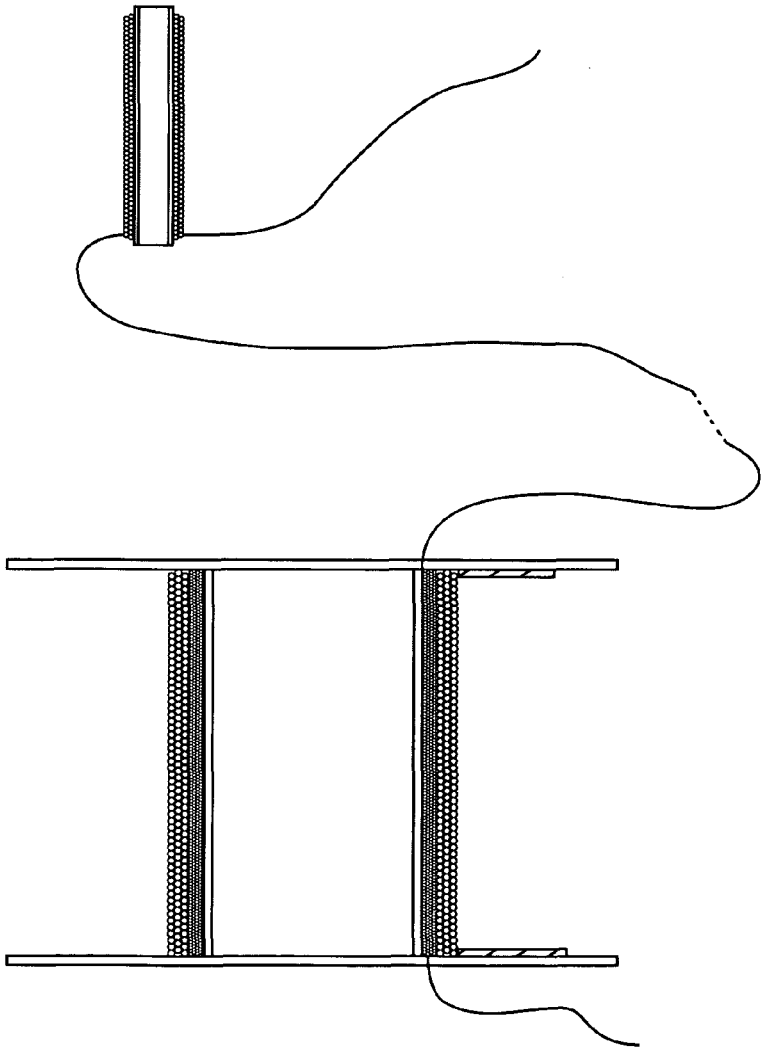
FIG. 49 is a cut-away side elevation view of an example of a remote location geometry with a primary winding wound concentric around an outside of an initial portion secondary winding, and an additional portion of the secondary windings being remotely located in an area of electrical freedom.

In one embodiment, the spool 52 has a thin flat shape. Thin and flat means that the distance from a center of the former to one outside minus the distance from the center to the former shall be at least half the thickness of the former. The internal area of the spool between the center and the former can be made large. The spool and/or its former can be any geometric shape (circular, square, oval, etc.) so long as the spool is thin and flat. Described above and illustrated in FIG. 35, were the thin and flat geometries with the primary on the inside of the secondary. This embodiment is particularly well suited for use with an advanced development method disclosed below.

The high frequency magnification device 50 is also comprised of a primary winding 70 formed from an insulated conductive wire 72 and a secondary winding 80 preferably formed from magnetic wire 82. In one embodiment, the wire gauge of the insulated conductive wire or primary wire 72 is selected to provide the primary winding with at least ten to two-hundred (10-200) turns depending on the wire's thickness. This is to insure that the primary winding (or primary) will generate significant magnetic flux. In some cases only a few primary turns are required, depending on power and frequency delivered by the generator 26. One must insure the primary coil or winding 70 will not filter out the intended drive frequency 30. The primary wire gauge is selected based on the current handling capacity necessary for an intended power handling capacity.

Usually three to eighteen (3-18) gauge primary wire 72 is sufficient, however, the choice of the magnetic wire or secondary wire 82 also must be considered. The secondary wire 82 should be three to fifteen (3-15) gauge numbers higher than the primary wire 72, but the secondary wire 82 needs to maintain a low resistance and so usually should not exceed gauges higher than about twenty-four (24) gauge unless multiple strands of secondary wire 82 are used in conjunction to make up the secondary winding 80. A compact high frequency magnification device 50 might have a twelve (12) gauge primary and an eighteen (18) gauge secondary.

The high frequency magnification device 50 may be further comprised of an insulation material 78 interposed between the primary winding or coil 70 and the secondary winding or coil 80. Depending on the choice of insulated wire and/or considering the power handling requirements of the specific embodiment, this step may be omitted.

A significant portion of any magnification device 50 is the secondary winding or coil 80. The use of the sizeable secondary wire gauges (less than 24 gauge) is to insure a large inductive time constant. That is, the design must provide the secondary coil with a large self-inductance and a small self-resistance. The secondary wire gauge determines the self-resistance, so the wire must be as large in diameter as possible. This helps to keep the inductive time constant as large as possible so it is possible to achieve a large magnification factor, while at least a portion of the secondary coil maintains electrical freedom. These two aspects define two design requirements. Using any of the geometries delineated hereinabove will insure the second of these design requirements is met. The upper boundary on spatial resonant frequency is about 30 MHz. Frequencies above this can be created to utilize only the temporal resonant aspects of magnification technology, but both spatial, and the preferred spatial and temporal overlap become limited by the shortening length with which one has remaining to create a meaningful secondary coil with appropriate properties for achieving magnification. The lower boundary on operational frequency for a high frequency magnification section is about 50 Hz. There is too much series capacitance in a coil designed to operate below 50 Hz and it begins to take more and more wire to accomplish any additional lowering of the resonant frequency below about 1.25 kHz. To avoid this problem, the wire gauge must be increased which leads to a reduction of the magnification factor even further through increased resistance.

Accordingly, it is usually necessary to utilize a significant amount of secondary wire 82, compared to primary wire 72. In one embodiment, and for example, the high frequency magnification device 50 includes about six thousand (6,000) feet of eighteen (18) gauge magnetic (enamel-coated) wire forming eight hundred (800) turns. Whereas, the primary includes about two hundred to three hundred (200-300) feet of twelve (12) gauge standard (plastic-coated) wire forming sixty-five to ninety-five (65-95) turns. The primary wire 72 can be wrapped on the inside or the outside of the secondary coil 80.

High Frequency Magnification Device Assembly

Still referring to FIGS. 2 through 8, the assembly of the high frequency magnification device 50 begins by threading a first end 74 of the primary wire 72 through a first hole 66 in the first outside flange 58 and then tightly wrapping or winding the primary wire 72 around the former 54 of the spool 52 for forming the primary winding or coil 70 with a second end 76 of the primary wire 72 being threaded through a second hole 67 of the first outside flange 58. During this process the primary wire 72 shall be kept as close as possible to the previous winding. This can be done by hand or with aid of a winding machine. After this is done, the optional insulation material 78 (thin plastic sheets, transformer paper, etc.) is wrapped around the primary wire 72 and an appropriate fastener, such as tape, is employed to fasten the insulation material 78 for forming a circumscribing layer of insulation material 78 between the primary winding 70 and the subsequently wound secondary winding 80.

The next step in the assembly is the wrapping or winding of the secondary wire 80 around the insulation material 78, the underlying primary winding 70, and the former 54 of the spool 52 in the same direction as the primary winding 70 was wound thereby forming the secondary winding or coil 80. This step begins by threading a first end 84 of the secondary wire 82 through the second hole 67 in the first outside flange 58 and then tightly wrapping or winding the secondary wire 82 around the insulation material 78 and the underlying primary winding 70 for forming the secondary winding or coil 80 with a second end 86 of the secondary wire 82 being threaded through a third hole 68 of the first outside flange 58.

The secondary winding or coil 80 usually comprises a larger volume of the spool 52 than the primary winding or, coil 70. Additionally, a portion of the secondary winding or coil 80 physically extends beyond a region of significant changing electric fields induced by the primary winding or coil 70 (when the primary is eventually connected to the external generator 26) as provided by the thin and flat spool geometry delineated hereinabove.

The creation of the large secondary coil 80, relative to the primary coil 70, of relatively thick gauge secondary wire 82, although preferably a thinner gauge than the primary wire 72, insures there will be a large self-inductive time constant leading to a large magnification factor. The aforementioned thin and flat geometry insures that a portion of the secondary winding or coil 80 maintains electrical freedom. Therefore the two requirements for high frequency magnification devices are met by the above delineated design.

In one example, the spool dimensions might be two inches thick, with a former diameter of ten inches and an outer spool diameter of twenty inches allowing for the length of a winding channel 64 to be five times its width. Using these spool dimensions, and in one example, the primary winding 70 is wound to take up an inner one inch depth of the winding channel 64, and the secondary winding 80 is wound to take up two inches of the channel 64. As a result, there is not only a large self-inductance and inductive time constant from the eighteen gauge secondary wire encompassing such a large single circuit element, but also a portion of the secondary winding 80 extends beyond where the induced electric field from the primary winding 70 can have any significant effect. The twelve gauge primary wire is then connected to the external power amplifier or generator 26 for use.

The discovery of creating the magnification device 30, under the aforementioned constraints is that it enables a new and useful type of phenomenon to take place in the secondary coil termed (1) energy magnification, or (2) passive power generation. As described in the introduction, the use of differential equations for RL circuits based on the principle of the conservation of energy allows one to state that the inductive current decay is based on the inductive time constant. Both the energy and the electro-motive force can be understood quantitatively by current decay. Since the current does not decay but builds up, so therefore does the energy and electromotive force inside the secondary winding or coil 80, as long as it maintains electrical freedom. Therefore, direct external loading is also not permitted, unless a special system is created to preserve the electrical freedom of the secondary winding or coil 80 while loading occurs.

The secondary winding or coil 80 of the high frequency magnification device 50 has a large inductive time constant, and the high frequency magnification device 50 is AC driven at some operational or drive frequency 30 above 1 kHz. Therefore, if the inductive time constant is larger than 0.001 seconds, then it takes longer for the induced current to decay than the time between cycles of the drive frequency 30. There are always (frequency)*(time constant) cycles that pass, with the first transition still at 37% of its initial value.

For example, if the drive frequency is 1 kHz and the inductive time constant is 0.02 seconds, then there are (1000 Hz)*(0.02 seconds)=20 cycles that pass while the conservation of energy dictates the first transition is still at 37% of its original value. This unit-less factor, as noted above, is called the magnification factor (herein MF) wherein MF=frequency*inductive time constant=(f*L)/R. This only applies to self-inductance and self-resistance of a single coil. Since the secondary winding or coil 80 does not have time (by the conservation of energy) to allow for the current to decay before more cycles are incurred and a portion of the secondary winding or coil 80 maintains electrical freedom as delineated hereinabove, then the induced currents from each cycle are allowed to superimpose.

Looking at the energy, after 1.2 time constants, there is still half of the magnetic energy stored by the self-inductance present from the first transition. Either way, the energy, voltage, and especially the current content all quickly surpass that of an ideal transformer, even though the high frequency magnification device 50 is air-core. The allowance for the superposition of the cycles related to the magnification factor can only occur if the secondary winding or coil 80 is physically separated from significant effects of the induced electric field from the primary winding or coil 70. This situation is not found in normal transformers, which are all designed to have maximum magnetic flux linkage between primary and secondary coils. Accordingly, the magnification section or device 20 including the high frequency magnification section or device 50 of the passive power generation system 10 is an entirely different device with separate set of behaviors, even though the same fundamental physical laws govern both. In fact, the first notable behavior is that the magnification section or device 20 including the high frequency magnification section or device 50 of the passive power generation system 10 can have open circuit current content.

The magnification section or device opens up a new branch of study in electrical engineering in which the boundary conditions no longer are restricted to being fixed at both ends. That is, no longer does a complete circuit have to be formed in order for current to flow. If all circuits are analogous to stringed instruments, then this new device is analogous to wind instruments. That is why there is an odd integer multiple relationship for harmonics in these devices instead of an even one as is the case for closed circuits. To avoid confusion, these devices will be called "sections" instead of circuits. Sections can be connected together like circuits, but will exhibit completely different behavior since they need not be closed, as circuits must be, in order for charge to flow. Currently, building the magnification section or device following the two requirements listed above is the only known way to create a "section," and conveniently also provides a bridge between the world of circuits and the world of sections.

As described in the above introductory material, induced electric fields are different from those arising from static charges because they form complete circles. Any secondary windings in the magnification device which lie where the induced electric fields from the primary windings exist will have currents induced in them. Furthermore, there are many primary turns, and they each generate flux, therefore the secondary windings have many induced currents which all occur simultaneously, from the numerous induced electric fields.

With the primary winding or coil wound concentric on the inside of the secondary winding or coil, the induced electric field strength falls off at a rate of: an outer radius of the primary winding or coil squared divided by twice the distance into the secondary winding or coil. All the turns of the secondary that lie inside the region of induced electric field all must respond each cycle. These induced currents all respond to the induced electric fields each cycle. Over this region of the secondary coil the induced current is dictated by the induced electric field and the cycles cannot superimpose. This is true for any mutual inductance and explains why conventional transformers (designed to maximize mutual inductance) are incapable of magnifying energy. However, when a magnification device is created, there is a large region of secondary coil specifically designed to be removed from this region of significant changing flux. For example, the electric field in the region has fallen to below 50% of its initial value. Alternatively, since a portion of the secondary winding or coil must remain free for magnification to operate; if magnification action is occurring, then a portion of the secondary winding or coil must be free. Therefore, electrically free may be defined in terms of magnification action occurring.

In any case, since a large portion of the magnification device secondary winding or coil lies outside the region of significant induced electric field from the primary winding or coil, this portion of the secondary winding or coil does not have to follow the induced field. Furthermore, due to the large inductive time constant, the principle of the conservation of energy does not allow any induced current to decay rapidly from any cycle. This means that a number of induced currents equal to the magnification factor all superimpose by the time the first transition is still at 37% of its original value. That is the underlying mechanism for magnifying electricity or energy. Instead of the induced field alone dictating the resulting currents, the superposition of several cycles must combine when induced in a magnification device by the principle of the conservation of energy and Faraday's law. This only occurs if both requirements described above are met which can be now be restated as, (1) an over unity MF, and (2) a portion of the secondary coil maintaining electrical freedom.

Furthermore, since the high frequency magnification device 50 is able to increase the current content in this fashion, the energy content must also rise. Not from violation of conservation, but due to actual conservation, that is, this system requires the induced currents to remain in existence longer than the magnetic field that produces them. All other systems of induction known to date are based on the induced currents lasting only as long as the magnetic field that produces them.

As mentioned in the above introductory material, we cannot define electric potential inside regions of changing flux. Allowing for the superposition of induced currents in the same coil outside of this region where the self-inductance can take effect is termed a free geometry. As described above, the free geometry along with a large inductive time constant can be used with a suitable frequency to achieve magnification of electricity or energy. Since this magnification of energy occurs due to induced current superposition it can occur even when the secondary is open circuited. The shape of the current waveform may be complex and non-linear due to the superposition of both impressed and delayed induced currents from many cycles unless the device is operated under a resonant condition, which, in one embodiment, is the preferred case, since then a sinusoidal output waveform is achieved. In any case, the magnitudes for voltage and current parameters are greatly enhanced. Since magnification occurs for open circuit conditions, it is an entirely new device. Direct external loading also destroys the electrical freedom of the secondary coil; so local recovery of the magnified electricity or energy was a significant problem to overcome.

Figure 11:
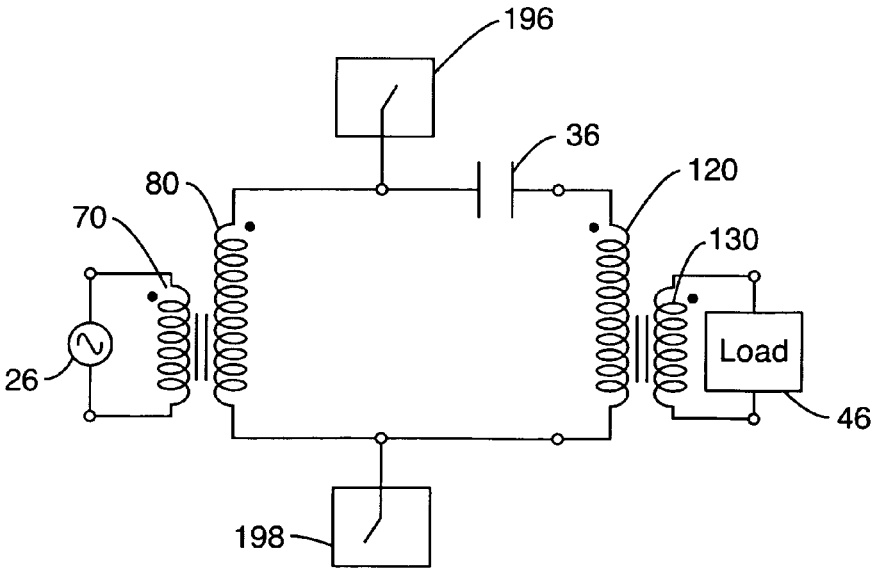
FIG. 11 is a schematic view of an embodiment of the passive power generation system in the form of a high frequency passive power generation system.
Figure 12:
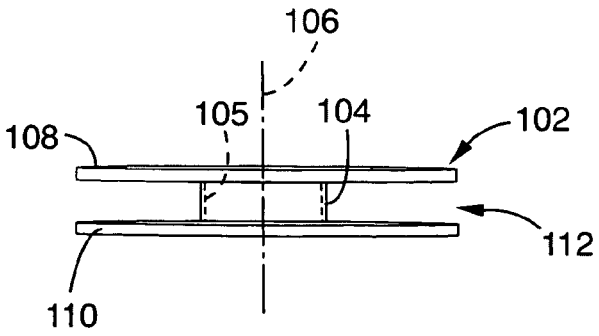
FIG. 12 is a side elevation view of an embodiment of an air-core insulating spool of the high frequency recovery device.
Figure 13:
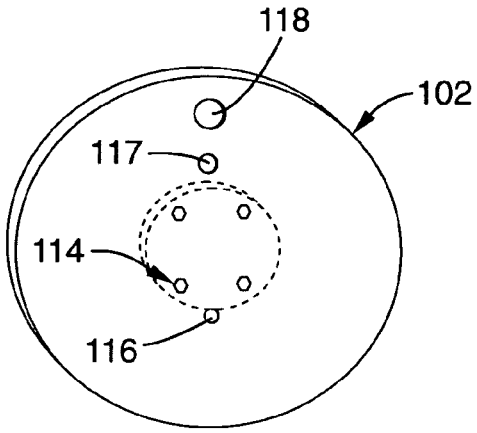
FIG. 13 is a top plan view of the air-core insulating spool shown in FIG. 12.
Figure 14:
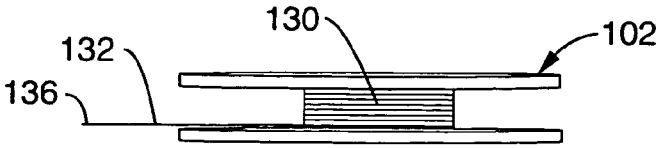
FIG. 14 is a side elevation view of an embodiment of a secondary winding wound on a former of the air-core insulating spool of the high frequency recovery device.
Figure 15:
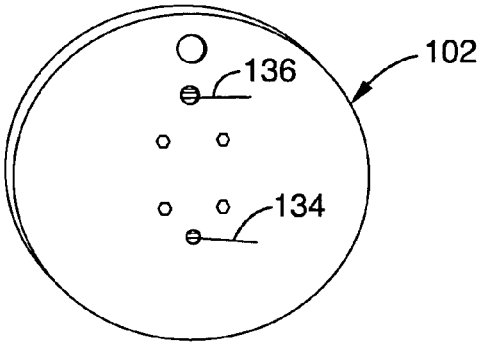
FIG. 15 is a top plan view of the secondary winding wound on the former of the air-core insulating spool of the high frequency recovery device.
Figure 16:
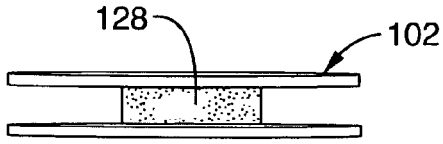
FIG. 16 is a side elevation view of an insulation material covering the secondary winding wound on the former of the air-core insulating spool of the high frequency recovery device.
Figure 17:
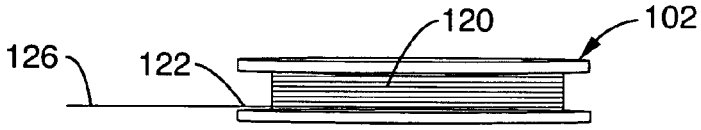
FIG. 17 is a side elevation view of an embodiment of a primary winding wound around the secondary winding of the high frequency recovery device with the insulation layer interposed therebetween.
Figure 18:
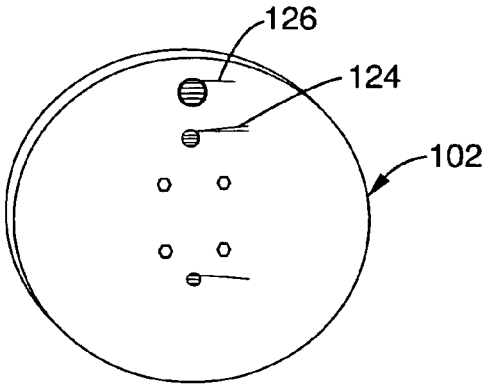
FIG. 18 is a top plan view of the primary winding wound around the secondary winding of the high frequency recovery device with the insulation layer interposed therebetween.
Figure 34:
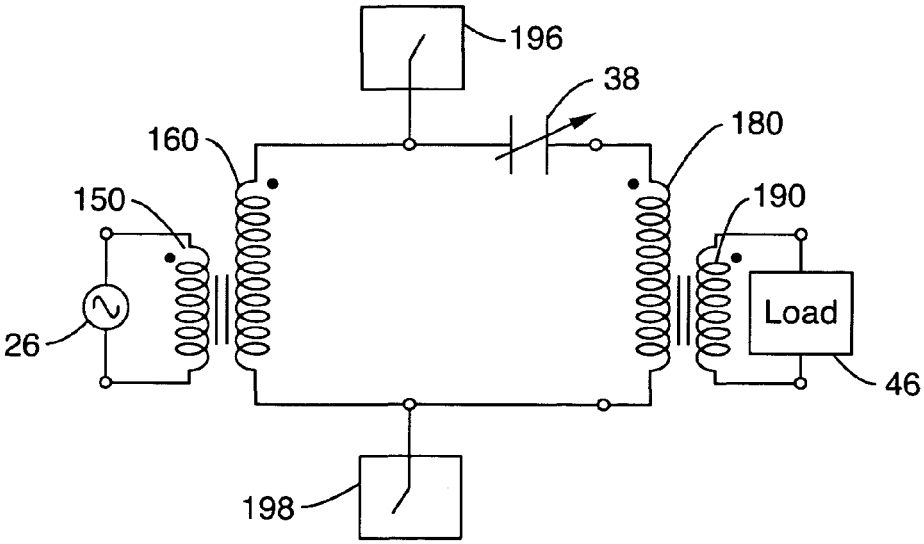
FIG. 34 is a schematic view of an embodiment of the passive power generation system in the form of a power frequency passive power generation system.

It is sometimes possible to also make the overall length of a conductor an odd integer multiple wavelength of four times the drive frequency as well as the temporal resonance. This is the preferred method, but is difficult to achieve unless a unique development method delineated hereinbelow is used. This is defined as temporal and spatial resonant tuning, and will create a powerful and frequency stable device. In certain cases, an excess length of wire may be extended outside of a temporal resonating coil to make up extra required length. It is preferred to use the majority of length in making up the secondary coil (or primary coil of a recovery device) in itself instead. A magnification device operates open circuit with current content therefore it is the odd integer multiples which give the maximum voltages at the one-quarter (¼) and three-quarter (¾) wavelengths. This is like a string fixed at one end with a sliding ring at the other, whereas a normal circuit is like a string fixed at both ends. This is also the reason for the isolated plates 196, 198 (FIGS. 11 and 34). The spatial wavelength is maximized at a free end at the one-quarter wave and three-quarter wavelengths. If the fundamental cannot be used, then an odd integer multiple of it will also fit with a mode at the free end of the string. Existing practice is just not aware of devices that posses this open circuit current content capability. We use the quarter wave of the even integer wavelengths all the time for standard circuits. The use of the spatial component is not preferred as compared to use of the temporal component since modern equipment is now available to utilize it. Theoretically, either temporal or spatial resonance, or both, will operate.

Practically, spatial resonance is more frequency stable than temporal resonance, but temporal resonance is stronger than spatial resonance. Therefore, the best mode of invention is the overlap of both. This achieves the power of temporal resonance with the stability of spatial resonance.

In order to avoid undue experimentation, it is appropriate to disclose the geometric properties that effect temporal resonance. These were determined by computer simulation in conjunction with experimental result. As a result, it was discovered that making a coil thinner increases the frequency of temporal resonance. Reducing the diameter of the former will also increase the frequency of temporal resonance, but by not as much. Therefore to increase the temporal resonance of a coil, rough control is gained by reducing the thickness of the former, while fine tuning control is gained by reducing the diameter of the former.

If a preferred embodiment of passive power generation system 10 is to be created, then the temporal resonance may be tuned to four times the intended operational or drive frequency 30, whereas the spatial resonance should be tuned to the drive frequency 30.

Figure 10:
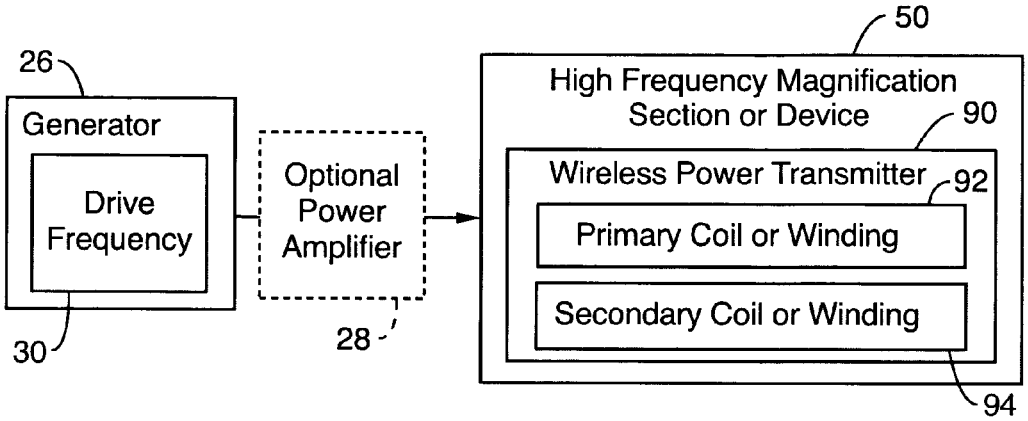
FIG. 10 is a block diagram view of an embodiment of a high frequency wireless power transmitter.

Referring to FIG. 10, and in a standalone embodiment, the high frequency magnification section or device 50 is used in a standalone embodiment as a wireless power transmitter (WPT) 90 wherein the temporal resonance and the spatial resonance must both be tuned to the operational or drive frequency 30. In one embodiment, the wireless power transmitter 90 comprises: a primary winding 92 having a first number of turns and driven at a drive frequency 30; a secondary winding 94 disposed relative to the primary winding 92 and having a second number of turns greater than the first number of turns for providing an inductive time constant greater than a time between cycles of the drive frequency 30 for allowing currents induced in the secondary winding 94 by the primary winding 92 to superimpose for magnifying energy so long as a portion of the secondary winding 94 remains electrically free relative to the primary winding 92; and wherein a temporal resonant frequency of the secondary winding 94 is substantially equal to the drive frequency 30. Additionally, and in one embodiment, the secondary winding is formed from a conductor having an end nearest the primary winding coupled to earth ground. Furthermore, and in one embodiment, the secondary winding 94 is formed from a conductor having a length substantially equal to a quarter wave length or odd integer multiple of a quarter wave length of the drive frequency 30.

Accordingly, and for one embodiment of the passive power generation system 10, the temporal resonant and spatial resonant frequencies of the magnification section must differ, whereas, in one embodiment of a standalone applications of the magnification sections 20 they must coincide.

In the passive power generation system 10 which is operatively coupled, the external tuning component combines with the self-inductive components in series, but the self-capacitive elements are not able to form an equivalent circuit since they must follow their respective coils inductive phase angle, separated by a phase shift component (the operative coupling). Since the operative coupling maintains a difference in voltage phase between the two lumped-sum coils, their individual self-capacitances do not combine to an equivalent as their inductive components do. The result is that the temporal resonance of the secondary coil is reduced by the series inductive connection and square rooted. Therefore, to restore an operative balance, a temporal resonance of four times the operational frequency may be used. Incidentally, any operational frequency can be used since the system 10 is tuned by an external component. Presently, a resonant tuning of four times the intended operational frequency has produced the largest experimental recovery magnitudes.

The most powerful devices utilizing the technology disclosed herein are the high frequency devices. Since the potential to magnify electricity or energy is given by the MF. As wire gauge decreases and becomes less resistive, it also becomes larger and more expensive. Therefore, the most powerful and cost effective magnification sections will be constructed for use at high frequency, with the proper low gauge wire selected to achieve proper spatial and temporal resonant tuning.

High Frequency Recovery Section or Device 100

Figure 2:
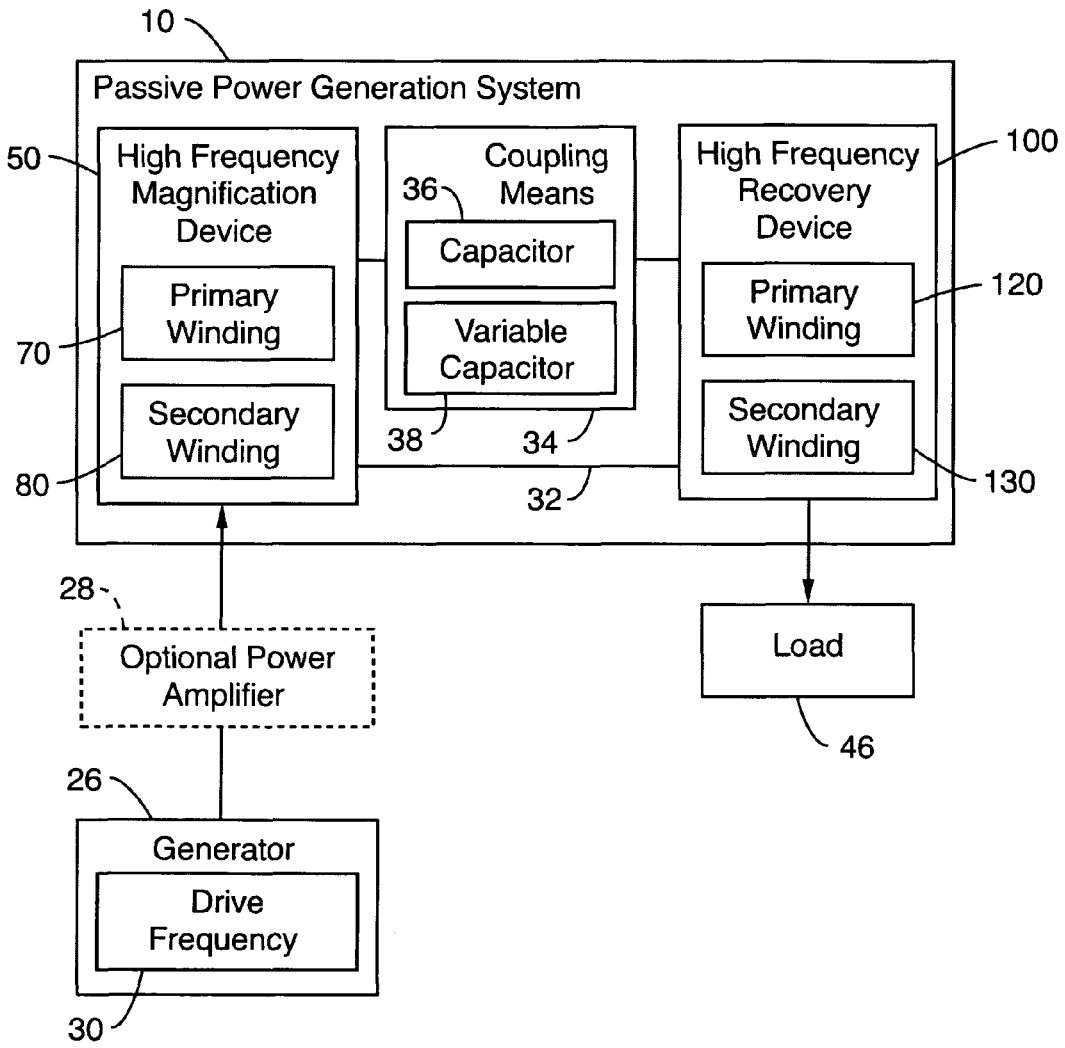
FIG. 2 is a block diagram view of an embodiment of the passive power generation system comprised of a high frequency magnification device and a high frequency recovery device.
Figure 3:
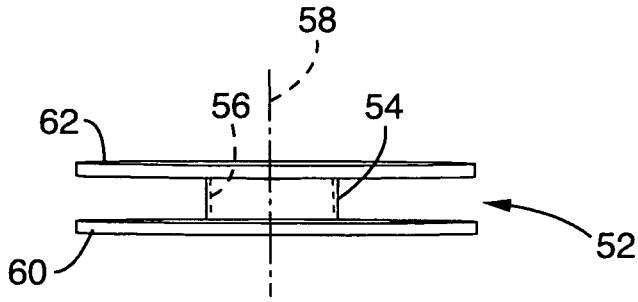
FIG. 3 is a side elevation view of an embodiment of an air-core insulating spool of the high frequency magnification device.
Figure 4:
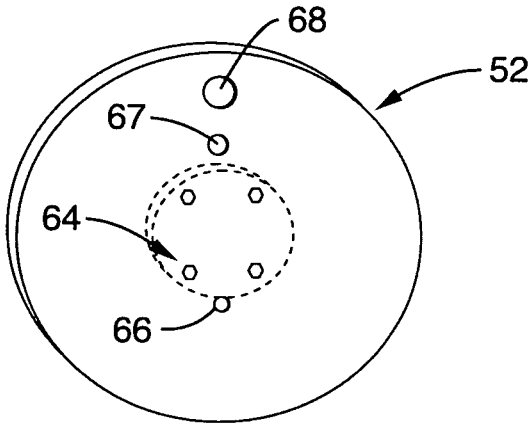
FIG. 4 is a top plan view of the air-core insulating spool shown in FIG. 3.
Figure 5:
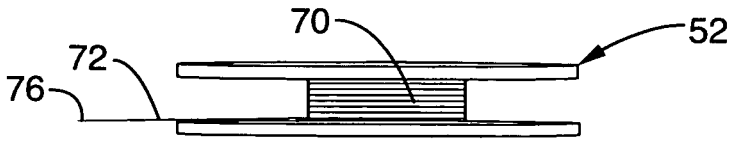
FIG. 5 is a side elevation view of an embodiment of a primary winding wound on a former of the air-core insulating spool of the high frequency magnification device.
Figure 6:
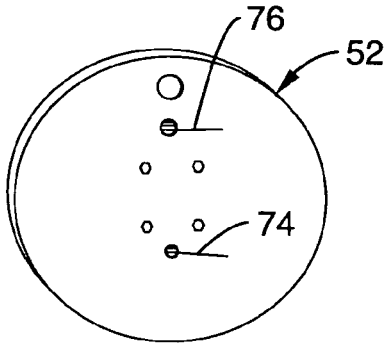
FIG. 6 is a top plan view of the primary winding wound on the former of the air-core insulating spool of the high frequency magnification device.
Figure 7:
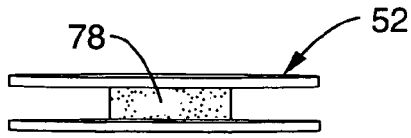
FIG. 7 is a side elevation view of an insulation material covering the primary winding wound on the former of the air-core insulating spool of the high frequency magnification device.
Figure 8:
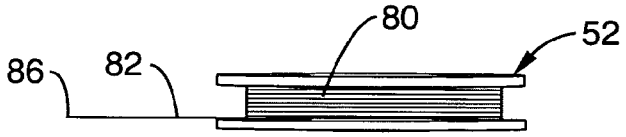
FIG. 8 is a side elevation view of an embodiment of a secondary winding wound around the primary winding of the high frequency magnification device with the insulation layer interposed therebetween.
Figure 9:
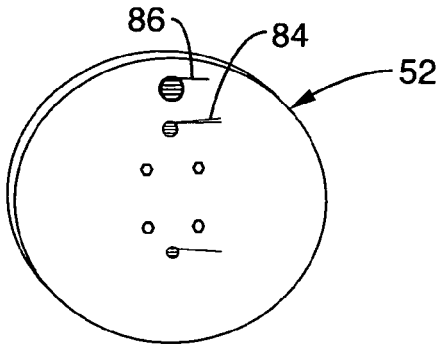
FIG. 9 is a top plan view of the secondary winding wound around the primary winding of the high frequency magnification device with the insulation layer interposed therebetween.

In the high frequency embodiment, the recovery section or device 40 takes the form of a high frequency recovery section or device 100 for providing locally recover of a portion of magnified energy or power from resonantly tuning a lumped sum element by using capacitive coupling 36 thereby creating a high frequency passive power generation system 10 as illustrated in FIGS. 2 and 11.

Referring to FIGS. 2 and 11, and in one embodiment, the materials required for a high frequency recovery section or device 100 are the same as those used to create the magnification section or device 50, since we are creating a lumped sum element. There is the additional option to adjust the number of low voltage secondary turns used in the recovery device 100, as well as the gauge, in order to provide the desired output impedance for the intended load 46. Great care should be taken to properly tune the recovery device 100 to the same frequency as the magnification device 50 was tuned. The adjustment of the low voltage secondary winding or coil 130 may cause the primary inductance of the recovery device 100 to differ from the secondary winding or coil 80 of the magnification device 50 by a small amount. This can be due to the magnification section primary area's being slightly different from the corresponding recovery section. If the magnification section primary 70 is wound on the inside of its secondary 80 then the inductances may differ. When the inductances differ, technically they are no longer lumped sum elements of each other. The allowance of breaking the lumped sum element model is preferred in this case in favor of both devices 50, 100 having the same temporal resonant tuning on their high voltage windings 80, 120.

It is theoretically possible to overheat the low voltage secondary winding or coil 130 of the recovery device 100 if a suitable gauge wire is not chosen to handle the excess power generated by the magnification device 50. For example, the recovery of as little as ten percent from the magnification device 50 with a MF of ninety would require nine times the current handling for the low voltage secondary 130 in the recovery section, as was required as current handling for the primary winding 70 of the magnification device 50. A second approach is to provide excessive current handling capacity in the primary of the magnification device 50, which will suffice if the source can handle the magnification device primary load. Then there will usually be sufficient current handling in the recovery device 100 even if they are of the same gauge. That way whether the primary winding 70 of the magnification device 50 is wound interior or exterior to its secondary winding 80; the magnification and recovery sections 50, 100 will still be lumped sum elements of each other, as well as having the same spatial and temporal tuning as each other.

Referring to 12 through 18, and in one embodiment, and, the high frequency recovery device 100 is comprised of an air-core insulating spool 102 comprised of a central former 104 having a hollow core 105 circumscribing a central axis 106. The central former 104 axially extends between a first outside flange 108 and a second outside flange 110. The spool 102 is made of materials that are non-conductive (wood, rubber, plastic, paper, et cetera). If fasteners 114 are used to fasten the outsides 108, 110 together they should not be made of iron, but made of plastic, rubber, or brass instead. In one embodiment, the spool 102 is a thin flat shape. Thin and flat means that distance from the center of the spool to the outside minus the distance from the center of the spool to the former shall be at least half the thickness of the former. The spool 102 and/or its former 104 can be any geometric shape (circular, square, oval, etc.) so long as the spool is thin and flat.

The high frequency recovery device 100 is further comprised of a primary wire 122 forming the primary winding or coil 120 and a secondary wire 132 forming the secondary winding or coil 130. Both can be any insulated conductive wire, but magnetic wire is preferred for use for at least the high voltage primary coil 120. The low voltage secondary wire gauge should be selected to provide at least two (2) turns for the output secondary winding or coil 130 depending on the wire's gauge. This is to insure that the secondary winding or coil 130 will couple a significant amount of induced electric field. The secondary wire gauge shall be selected based on the current handling capacity necessary for the device due to its intended power source. Usually three to eighteen (3-18) gauge secondary wire 132 is sufficient. However, the choice of primary wire 122 also must be considered. The primary wire 122 should be three to fifteen (3-15) gauge numbers higher than the secondary wire 132, and matched to the secondary wire 132 of the magnification section 50. If multiple strands are used in the magnification section windings then the same number of strands, respectively, should also be used in the recovery section 100. A typical high frequency recovery section 100 might have a twelve (12) gauge secondary and an eighteen (18) gauge primary according to the previously outlined magnification section 30.

In one embodiment, an optional insulation material 128 is utilized for use between the primary and secondary windings or coils 120, 130. The majority of the spool 102 will be taken up by primary winding or coil 120. This creates a lumped sum element coil to match the magnification section. A typical small-scale recovery section 100 might have six thousand (6000) feet of eighteen (18) gauge magnetic (enamel-coated) wire forming eight hundred (800) turns for the primary winding 120. Whereas, the secondary winding or coil 130 has two hundred to three hundred (200-300) feet of twelve (12) gauge standard (plastic-coated) wire forming less than one hundred (100) turns. The primary winding 120 can be wrapped on the inside or the outside of the secondary winding 130, however the secondary wrapped on the inside is usually preferred for use with the advanced development method delineated hereinbelow. Additionally, the magnification section 50 may be wound with the low voltage primary 120 inside and the recovery section low voltage secondary 130 wound on the outside, or any combination. The pattern of interior or exterior winding need not be the same between a magnification and recovery section. It is preferred in that case, as again the lump summed element model is slightly broken, in favor of making sure the high voltage winding are of the same temporal resonance.

The external capacitive element 36 (FIG. 11) that operatively couples the magnification section to the recovery section should be tuned according to one or the two equation noted for (C) herein above. Additionally, it should be noted again that in the cases where the inductances differ slightly between the two high voltage windings, their sum should be used inside the equation $C=1/(4*\pi^2*f^2*(2L))$ instead of $2*L$. According, in this case, the equation for C is: $C=1/(4*\pi^2*f^2*(LmagS+LrecP))$ wherein $\pi$=pi, f is the frequency of operation or the drive frequency, and LmagS is the value of the inductance of the secondary winding 80 of magnification section 50 and LrecP is the value of the inductance of the primary winding 120 of the recovery section 100.

High Frequency Recovery Device Assembly

Still referring to Referring to 12 through 18, the assembly of high frequency recovery device 100 begins by tightly wrapping the secondary wire 132 around the former 104 of the spool 102 for forming the secondary winding 130. During this process the wire 132 shall be kept as close as possible to the previous winding. This can be done by hand or with aid of a winding machine. Usually one end 134 of the secondary wire 132 will enter through a hole 116 of the spool 102 and the other end 136 will exit through hole 117 of the spool 102. After this is done, an optional insulation material 128 (thin plastic sheets, transformer paper, etc.) is utilized and some appropriate fastening material, such as tape, to fasten the optional insulation material 128 between the secondary winding or coil 130 and the subsequently wound primary winding or coil 120 of the high frequency recovery device 100.

The next step in the assembly is the winding of the high voltage primary winding or coil 120 on the spool 102 in the same direction as the secondary winding or coil 130 was wound. During this process the primary wire 122 shall be kept as close as possible to the previous winding. This can be done by hand or with aid of a winding machine. Usually one end 124 of the primary wire 122 will enter through the hole 117 of the spool 102 and the other end 126 will exit through hole 118 of the spool 102. When the primary winding 120 is properly coupled and tuned then the current and voltage contained in the primary winding 120 will induce current in the secondary winding or coil 130.

The low voltage secondary winding 130 can be used to connect to the external load 46 and act as a generator, as Faraday's law provides that there will be power available through the coupled magnetic field between the primary winding 120 and the secondary winding 130 of the recovery section 100.

An example of spool dimensions might be two (2) inches thick, with a former diameter of ten (10) inches and an outer spool diameter of twenty (20) inches allowing for the length of a winding channel 112 to be five times its width. The secondary winding 130 would take up the inner one (1) inch depth of this winding channel 112, and the primary winding 120 would be take up two (2) inches of the channel 112. With proper tuning and external coupling between the magnification section or device 50 and the recovery section or device 100, the primary winding 120 of the recovery section or device 100 will capture a portion of the magnified electricity or energy. This directly coupled voltage and current will use the entirety of the recovery sections primary winding or coil 120 and therefore there will be no magnification action. However, the output secondary winding or coil 130 will experience induced currents from the large magnetic flux generated by the primary winding or coil 120. A twelve (12) gauge secondary coil can therefore be used as a generator for an external load 46.

This type of recovery section 100 creates a direct electrically coupled, high frequency passive power generation system 10. The low voltage secondary winding or coil 130 of the recovery section 100 when its primary winding or coil 120 is properly tuned and connected with the secondary winding or coil 80 of the magnification section 50 forms a circuit that can power the external load 46. Since high frequency passive power generation systems 10 typically operate at a selected frequency, a variable high voltage capacitor 38 is optional for making tuning adjustments as was mentioned in the local recovery section for recovery device 40.

The addition of rectifiers and inverters after the high frequency recovery device 90 further reduces the need for a particular frequency of operation. As environmental conditions change the temporal resonance, an adjustment of drive frequency 30 can accordingly be made to temporal resonance passive power generation systems. This makes the temporal resonance versions of passive power generation systems 10 especially well suited for mobile applications, where changes to local environmental conditions may occur rapidly and otherwise de-tune operative systems.

It is also suitable to use the preferred overlap of temporal and spatial resonances for mobile situations, the spatial component will simply not necessarily be at resonance all the time as the operational or drive frequency 30 is shifted. If the amplitude of this frequency shift can be kept small, then the spatial component will be kept close enough to its quarter wavelength to be effective for practical purposes.

If the recovery section 100 and magnification section 50 are allowed to magnetically interact during operation, a cancellation of energy is likely to occur. To avoid this, the two sections 50, 100 will usually not be oriented on axis with each other.

One illustration of the difference between sections and circuits may be noted by the inability to use an external coupling device as a tuning instrument, as the operational frequency approaches half the temporal resonant frequency of the magnification section 50 and the recovery section 100. The choice of an operational frequency that is one-quarter of the temporal resonance insures that the passive power generation system 10 user will avoid this range.

Power Frequency Magnification Device 140

In another embodiment, and referring to FIGS. 19 through 25, the magnification device 20 is in the form of the power frequency magnification section or device 140 that covers the power frequencies of, for example, fifty (50) Hertz to about one (1) kHz as noted hereinabove.

Inductance is a geometric property and so is resistance of a copper wire, therefore it is necessary to scale up the power frequency magnification device 140 in order to achieve a lower operational frequency. In addition, power frequencies are normally fixed; so the power frequency magnification device 140 must be more carefully designed to operate at a specific frequency. In contrast, the high frequency magnification device 50 can use wider frequency sweeping to find operational points. The power frequency magnification device 140 also must be designed to operate at the drive frequency 30 in a stable manner. Finally, the power frequency magnification device 140 may be designed for use with a permeability enhancing core material 142.

The two requirements from high frequency magnifications device 50 also apply to the power frequency magnification device 140: Keeping the inductive time constant as large as possible so it is possible to achieve (1) a large magnification factor, while (2) at least a portion of the secondary coil maintains electrical freedom. Two more requirements are also included for the power frequency design are (3) the secondary must be wound for a stable self-capacitance and (4) a former will be used to align the magnetic field in the core where there will now be laminated iron, or some other type of core material. The fourth requirement means that special care is taken when designing the spool and former so as to allow for proper separation of the secondary turns from the induced electric field region. The power frequency magnification device 140 operates by creating a large inductive time constant to achieve a large magnification factor, since the frequency is now much lower, for example, fifty (50) Hertz to about one (1) kHz. The high frequency magnification device 50 relied on high frequency instead to increase the magnification factor.

Figure 19:
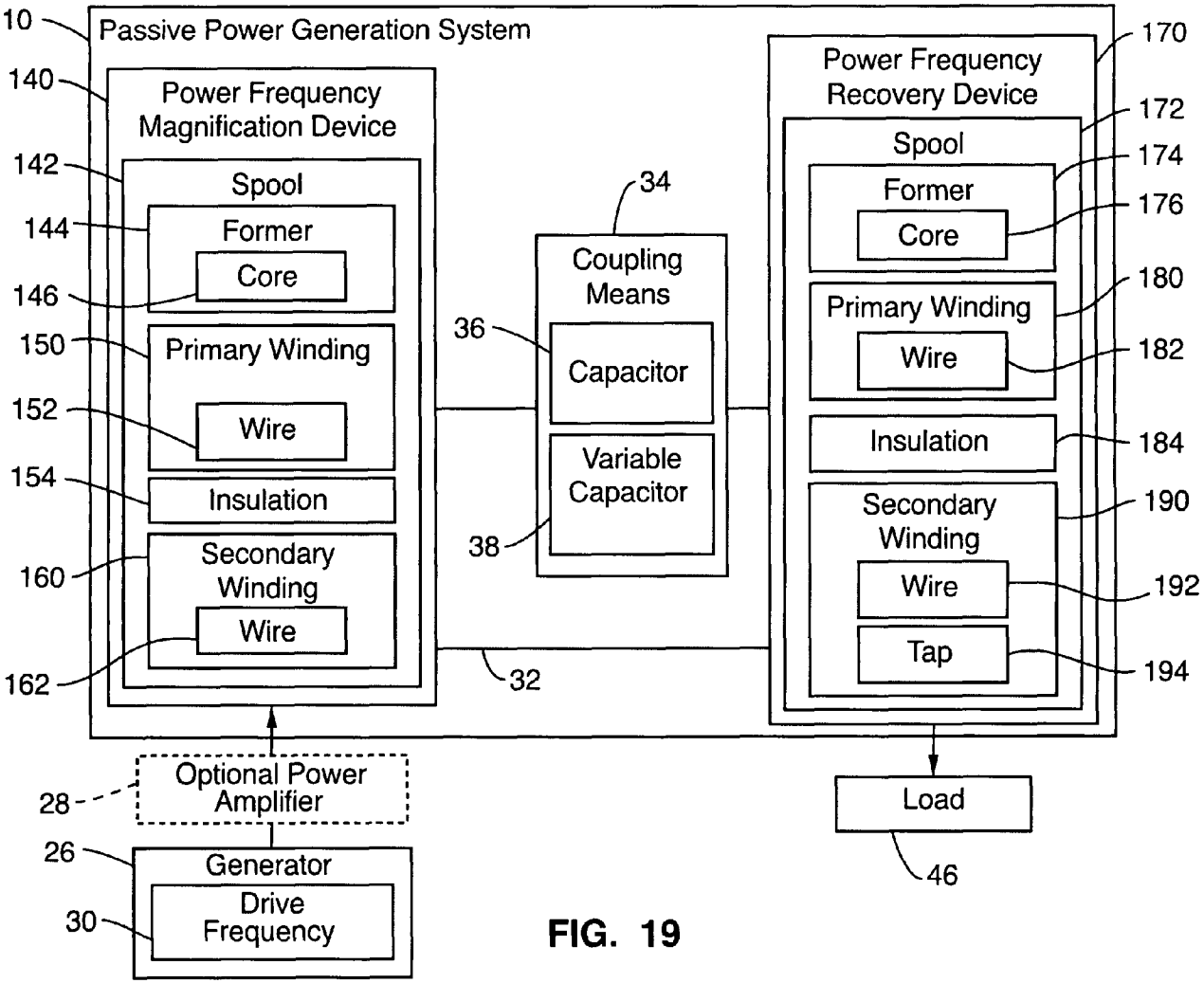
FIG. 19 is a block diagram view of an embodiment of the passive power generation system comprised of a power frequency magnification device and a power frequency recovery device.
Figure 20:
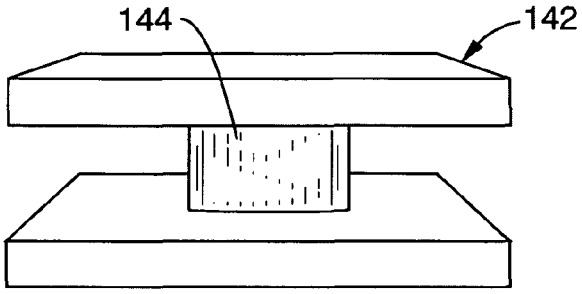
FIG. 20 is a side elevation view of an embodiment of insulating spool of the power frequency magnification device.
Figure 21:
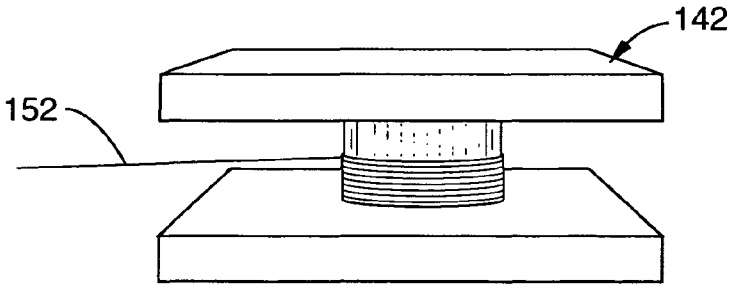
FIG. 21 is a side elevation view of an embodiment of a primary wire being wound on a former of the air-core insulating spool of the power frequency magnification device.
Figure 22:
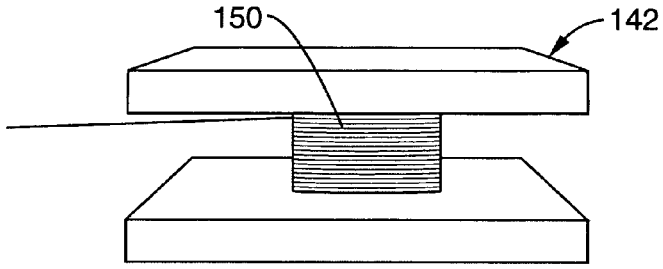
FIG. 22 is a side elevation view of an embodiment of the primary wire wound on the former of the air-core insulating spool of the power frequency magnification device.

In one embodiment, and referring to FIG. 19, the power frequency magnification device 140 is comprised an insulating spool 142 having a central former 144 circumscribing a permeability enhancing core material 146 such as laminated iron. It should be noted that any iron used will heat up during operation as a result of eddy currents and should be laminated to reduce this heating. The use of iron also significantly contributes to the weight of the magnification section. It is most important to use the iron in the core, so the spool and former may be made of wood or plastic or similar material to reduce weight.

The spool 142 and/or its former 144 can be any geometric shape (circular, square, oval, et cetera); however, the internal area of the spool between the center and the former should be made large enough to accommodate for the core 146. For example, a wooden spool of sides four foot by four foot and a square former of fourteen inches may have an interior opening of about seventeen inches. Additionally, the spool should allow for the distance from the center to the outside minus the distance from the center to the former to be at least two to three (2-3) times the thickness of a primary wire winding of the power frequency magnification device 140.

In construction of an embodiment of the core 146, thin sheets of iron that can be laminated or insulated from each other are employed and formed into a long column with the iron sheets running vertically up the column. For example, nine hundred (900) sheets of twenty (20) gauge grain-oriented steel, or soft iron sheet measuring ten inches by thirty-six inches could be insulated from each other with thin high-temperature plastic, varnish, oxidation, et cetera and stacked in piles together to form the suitable iron core 146 to fit inside the former 144 of the wooden square spool 142. Also liquid ferric solutions, ferrite, or other materials with suitable magnetic properties can be employed in the core 146. The fitting of the ferric core 146 is typically done after winding and is typically laminated to reduce eddy current losses, no matter what the material composition. It is also possible to use solid ferric material and simply allow it to heat up.

The power frequency magnification device 140 is also comprised of a primary winding 150 of wire 152 and a secondary winding 160 of wire 162. In one embodiment, the primary winding 150 is formed from an insulated conductive wire 152 and the secondary winding 160 is formed from magnetic wire 162. Additionally, and in one embodiment, the primary wire gauge is selected to provide at least ten to two hundred (10-200) turns of primary coil depending on the wire's thickness. This is to insure that the primary winding 150 will generate significant magnetic flux in the ferric core 146 and provide a suitable resistive load to an external generator 26. The primary wire gauge is preferably selected based on the current handling capacity necessary for the device due to its intended power source. Usually zero to twelve (0-12) gauge primary wire 152 is sufficient, however, the choice of secondary wire 160 must also be considered. The secondary wire 160 should be there to fifteen (3-15) gauge numbers higher than the primary wire 152, but not higher than about twenty-four (24) gauge unless multiple strands of secondary wire 162 are used in conjunction to make up a single coil. The primary winding 150 may be a larger inductor than the high frequency counterpart since the use of lower frequencies will not usually pose a problem with the low pass filter action of the primary winding or coil 150. This also provides for a more intense magnetic flux to link the ferric core 146 and subsequently the secondary windings 160.

A typical power frequency magnification device 140 might have three hundred pounds of eight (8) gauge for primary wire 152, and one thousand five hundred (1,500) pounds of twelve (12) gauge for secondary wire 162. Since the wire alone is of significant weight, one should employ a winding machine capable of supporting and winding a one-ton coil at fifty to one hundred (50-100) pounds of tension. One should also employ a tensioning mechanism for the wire during winding. One should also employ a method to unwind and rewind the coils; therefore, it is likely another smaller winding machine capable of winding a three hundred (300) pound load is also preferred. The second winding machine may be used as the tension mechanism to avoid unnecessary splices in the secondary wire 162. Also since there is such a volume of wire to wind on in a somewhat linear motion, a wire guide mechanism is also necessary to properly feed the wire onto the spool 142.

A significant portion of any power frequency magnification section or device 140 is usually the secondary winding or coil 160. The use of the sizeable secondary wire gauges suggested is to insure a large inductive time constant. That is, the design must create a secondary winding or coil 160 with a large self-inductance and a small self-resistance. The wire gauge determines the resistance, so the thickness of the wire must be large, such as below twenty-four (24) gauge. The majority of the spool 142 will be taken up by secondary wire.

The power frequency magnification device 40 is typically further comprised of insulation material 154 such as thin plastic, transformer paper, et cetera for use between the primary and secondary windings or coils 150, 160 as well as for the third requirement for large-scale magnification section design. The power frequency magnification device 140 requires the secondary 160 to be wrapped in a special manner in order to stabilize the self-capacitance of the winding 160. This involves the use of insulation material as well. The higher the gauge wire, the lower the temporal resonant frequency will be, for a given geometry magnification section. Unfortunately, the higher the resistance will also be; therefore the lower the power handling. As one approaches lower and lower operational or drive frequencies the resistance of the wire eventually increases to the point that there is no longer an over unity magnification factor possible given the low target frequency.

As the target frequency decreases, the spatial quarter wavelength becomes exceedingly too long to achieve the preferred embodiment with both spatial and temporal tuning. Finally, the self-capacitance begins to create a situation where is takes more and more wire to achieve the same lowering of resonant frequency. For these reasons, the high frequency magnification section 50 is more powerful than the power frequency section 140. In addition, the power frequency section 140 requires more raw materials and requires more careful procedures to produce.

Power Frequency Magnification Device Assembly

Still referring to FIGS. 19 through 25, the assembly of the power frequency magnification section or device 140 includes an initial step of tightly wrapping the primary wire 152 around the former 144 of the spool 142 for forming the primary winding 150. During this process the wire 152 shall be kept as close as possible to the previous winding, so as to create as dense a magnetic field as possible in the core 146 when it is eventually connected to the external generator 26. This may be done by machine, or by a human assisted by machines. Usually the primary wire 152 will enter through hole and exit through hole in the sides of the spool.

After this is done, the insulation material 154 (thin plastic sheets, transformer paper, et cetera) is wrapped around the primary winding 150 to form a layer of the insulation material and an appropriate fastener, such as tape, is employed to fasten the layer of the insulation material 154 between the primary winding 150 and the subsequently wound secondary winding 160.

Figure 23:
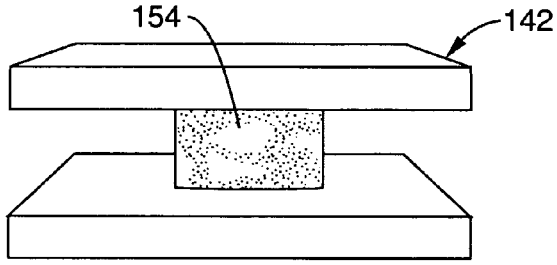
FIG. 23 is a side elevation view of an insulation material covering the primary winding of the power frequency magnification device.
Figure 24:
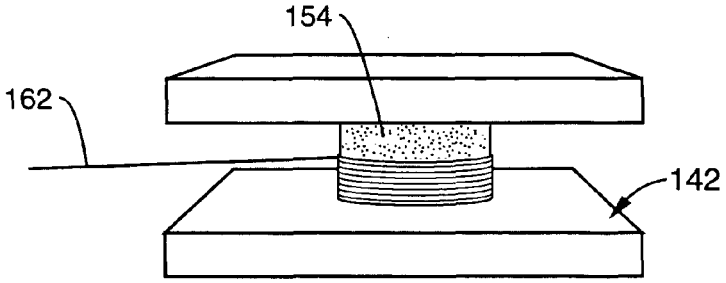
FIG. 24 is a side elevation view of an embodiment of a secondary wire being wound on the former of the air-core insulating spool of the power frequency magnification device.
Figure 25:
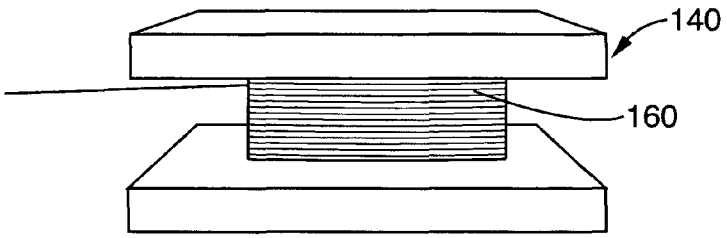
FIG. 25 is a side elevation view of an embodiment of the secondary wire wound on the former of the air-core insulating spool of the power frequency magnification device.

The next step in the assembly includes wrapping or winding the secondary wire 162 around insulation material 154, the underlying primary winding 150, and the former 144 of the spool 142 in a unique method for stabilizing the self-capacitance of the secondary winding or coil 160 by winding individual layers with insulation 154 between each individual layer. The individual layers must all be wound in a single direction for each layer. At the end of each individual layer the wire will then go perpendicular to the windings across the length of the former 144 and the winding of the next layer begins. For example, if one begins at the bottom of the former 144 and begins winding upward, one may put a layer several wires thick along the entire length of the former by slowing moving the guide mechanism upward during winding. Then once the top is reached, the winding must stop, the insulation added, and the wire fed back to the bottom of the former 144 before another layer can start. FIGS. 23 and 24 illustrate the cyclic process of wrapping insulation and then a subsequent layer of the secondary wire 162 until the secondary winding 160 is obtained as illustrated in FIG. 25. Proper winding creates a capacitor between each layer since the voltage difference across each layer is then uniform. Winding up and down the former 154 while forming the secondary is to be avoided.

If one winds up and down the former 144 then at the top and bottom of each new layer creates a gradient due to the linearly increasing voltage along the length of the inductor. If one winds only in one direction for each layer, then each point as one moves up the former 144, between each layer, is a linearly increasing voltage, and therefore forms a capacitance that is stable, and enhanced by the presence of the insulation material. This is the third requirement delineated above for the power frequency magnification section or device 140. It is necessary due to the fixed operational frequency. Forgoing this unique step will lead to an unstable frequency of operation.

The next step in assembly is to use a function generator and power amplifier to test the secondary coil for its resonant frequency. In accordance with the advanced development method delineated below, this may be done several times during winding.

In one embodiment of the passive generation system 10, the temporal resonance of the secondary winding 160 is desired to be four times the intended drive frequency 26. So a 600 Hz operational frequency should use a magnification device 140 with a temporal resonance of 2400 Hz. The temporal resonance must be periodically measured during construction so as to map its progress towards the target. Adding and removing windings in layers can adjust the resonance to the desired frequency. If the target frequency is too low for the gauge of secondary wire selected, this will be evident by the need to use more and more to achieve an equivalent lowering of temporal resonant frequency. If this occurs, a higher gauge wire must be selected and the intended power handling of the device must be lowered accordingly.

The next step in assembly is to add the ferric or permeability enhancing material core 146 to the 140. This can be a simple column core but should not be an entire ring core enclosing the entire secondary winding 160, otherwise the secondary winding 160 will not be of a free geometry. At most the iron could extend along the sides of the spool 142. Again any iron used and not laminated and properly oriented will heat up which may or may not be desirable depending on the core material used. Any permeability enhancing material 146 placed in the former 144 will increase the inductance of the magnification section 140. For external tuning purposes in the system 10, this must be considered when choosing the valve of the operative coupling means 34.

Since we can employ the use of materials that operate in this fashion quite well at frequencies below about 1 kHz, large magnification factors can be achieved with power frequency designs employing permeability enhancing cores 146.

An example value would be an inductance of one hundred eighty (180) Henry and a resistance of one hundred twenty (120) Ohms creating an inductive time constant of one and one-half (1.5) seconds. If powered at four-hundred (400) Hz this implies a magnification factor of six-hundred (600). Therefore, currents induced from six-hundred (600) transitions will superimpose before the first cycle reaches 37% of its original value.

Figure 26:
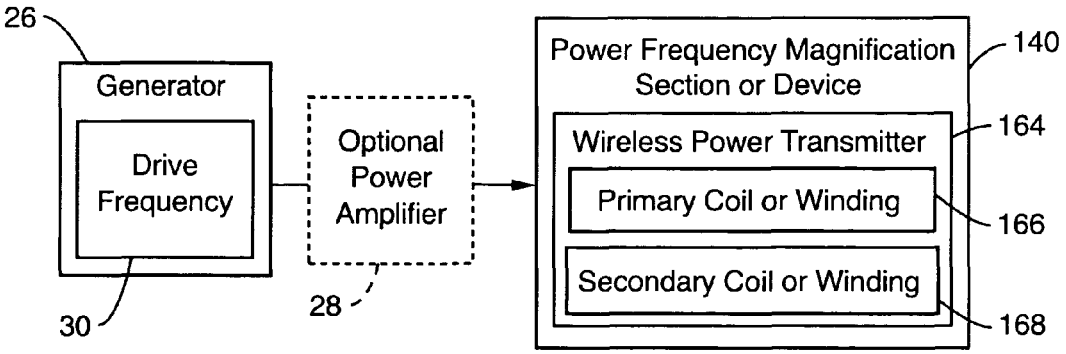
FIG. 26 is a block diagram view of an embodiment of a power frequency wireless power transmitter.

Referring to FIG. 26 and in a standalone embodiment, the power frequency magnification section or device 140 is used in a standalone embodiment as a wireless power transmitter device 164 wherein the temporal resonance and the spatial resonance must both be tuned to the operational or drive frequency 30. That is, the target frequency for temporal resonance and the operational frequency are the same for the power frequency wireless power transmitter device 164, or any standalone application just as was the case for the high frequency magnification section applications delineated hereinabove. Of note is that the spatial resonance is always equal to the quarter wavelength of the drive frequency for all systems: high and power frequency magnification sections and standalone applications, as well as, high and power frequency recovery sections and standalone applications. In one embodiment, the wireless power transmitter 164 comprises: a primary winding 166 having a first number of turns and driven at a drive frequency 30; a secondary winding 168 disposed relative to the primary winding 92 and having a second number of turns greater than the first number of turns for providing an inductive time constant greater than a time between cycles of the drive frequency 30 for allowing currents induced in the secondary winding 168 by the primary winding 166 to superimpose for magnifying energy so long as a portion of the secondary winding 168 remains electrically free relative to the primary winding 166; and wherein a temporal resonant frequency of the secondary winding 168 is substantially equal to the drive frequency 30. Additionally, and in one embodiment, the secondary winding is formed from a conductor having an end nearest the primary winding coupled to earth ground. Furthermore, and in one embodiment, the secondary winding 168 is formed from a conductor having a length substantially equal to a quarter wave length or odd integer multiple of a quarter wave length of the drive frequency 30.

Power Frequency Recovery Device 170

Referring again to FIG. 19, and in the power frequency embodiment, the recovery section or device 40 takes the form of a power frequency recovery section or device 170. Analogous to the power frequency magnification device 140, the power frequency recovery section or device 170 is usually comprised of a permeability enhancing core 176 inside a central former 174 of a spool 172. The use of permeability enhancing material will significantly contribute to the weight of the recovery section 170; however, it is important to use the permeability enhancing core 176, so the spool 172 and former 174 may be made of wood or plastic to reduce weight. The spool and/or its former can be any geometric shape (square, circular, oval, etc.). For the purpose of ease in core construction, the spool 172 may be, for example, a square wooden spool of sides four foot by four foot and a square former of fourteen (14) inches may have an interior opening of about seventeen (17) inches. The internal area of the spool between the center and the former should be made as large as possible as to accommodate the permeability enhancing core 176 such as a laminated permeability enhancing core. Alternative geometries may be employed to thin out the secondary winding thickness as its distance from the core increases, or to employ a separate section of secondary windings otherwise located in an area of electrical freedom.

Figure 27:
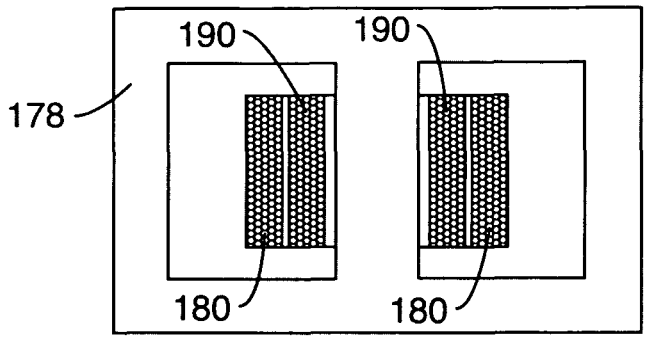
FIG. 27 is a diagrammatical view of a primary winding and a secondary wrapped fully in a permeability enhancing core.
Figure 28:
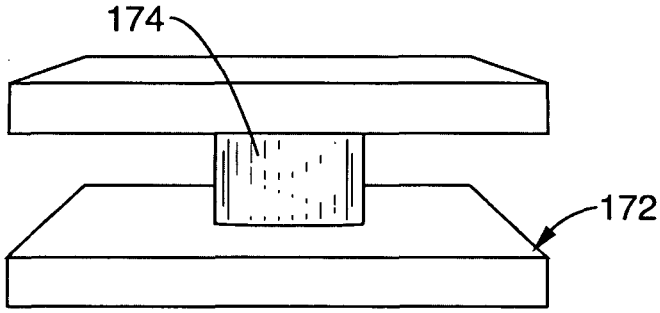
FIG. 28 is a side elevation view of an embodiment of insulating spool of the power frequency recovery device.
Figure 29:
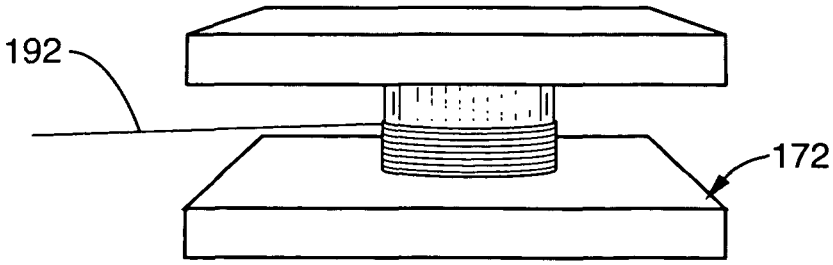
FIG. 29 is a side elevation view of an embodiment of a secondary wire being wound on a former of the air-core insulating spool of the power frequency recovery device.
Figure 30:
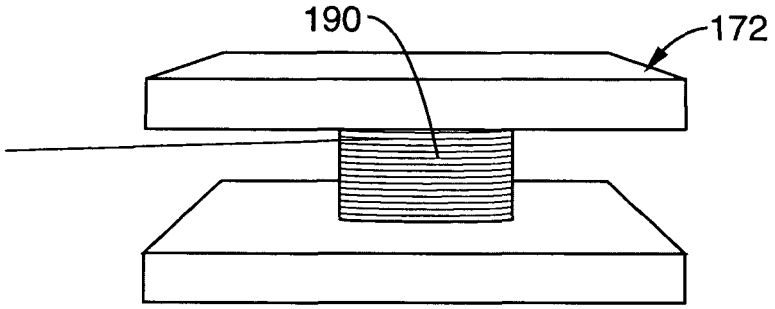
FIG. 30 is a side elevation view of an embodiment of the secondary wire wound on the former of the air-core insulating spool of the power frequency recovery device.
Figure 31:
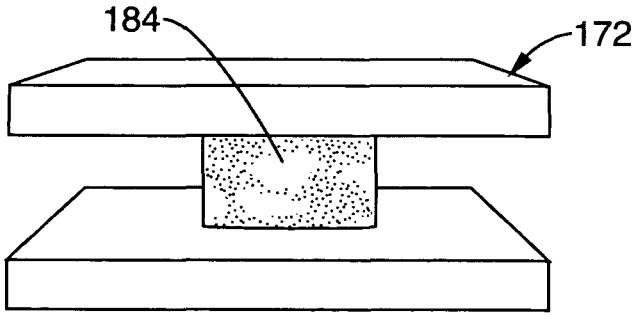
FIG. 31 is a side elevation view of an insulation material covering the secondary winding of the power frequency recovery device.
Figure 32:
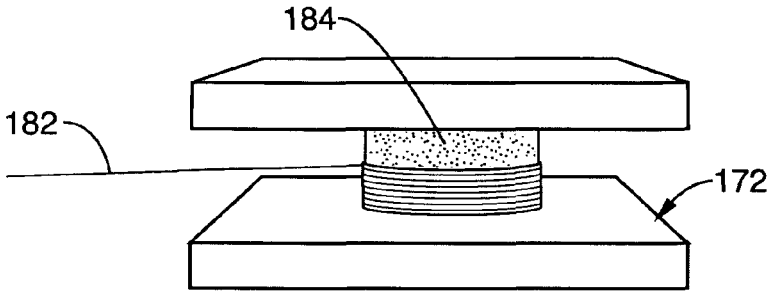
FIG. 32 is a side elevation view of an embodiment of a primary wire being wound on the former of the air-core insulating spool of the power frequency recovery device.
Figure 33:
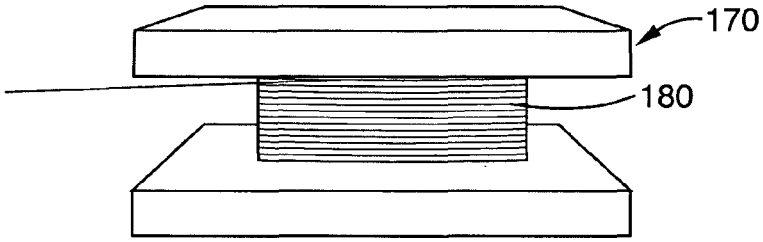
FIG. 33 is a side elevation view of an embodiment of the primary winding wound on the former of the air-core insulating spool of the power frequency recovery device.

As illustrated in FIG. 27, the recovery section can also be wrapped fully in a permeability enhancing core 178 thereby allowing the flux to continue in at least two full circles that connect to the central core.

The permeability enhancing material required can be in the form of, but not limited to, thin sheets of iron or grain-oriented steel that can be laminated or insulated from each other and formed into a long column with the permeability enhancing sheets running vertically up the column. It should be noted that any permeability enhancing material used will heat up during operation and should be laminated to reduce this heating, which is caused by eddy currents. For example, nine hundred (900) sheets of twenty (20) gauge grain-oriented steel sheet measuring ten (10) inches by thirty-six (36) inches could be insulated from each other with thin high-temperature plastic, varnish, oxidation, et cetera and stacked in piles together to form a suitable iron core to fit in the core of a wooden square spool. The fitting of the iron core is typically done after winding. If the core is to be fully wrapped, then additional laminated iron will be necessary to extend usually in a square around the coil on both sides.

The primary winding 180 is formed from wire 182 and the secondary winding 190 is formed from wire 192. This can be any insulated conductive wire, but magnetic wire is preferred for use for at least the primary winding or coil 180. The secondary wire gauge should be selected to provide at least ten to two hundred (10-200) turns of secondary winding or coil 190 depending on the thickness of the wire. This is to insure that the secondary winding or coil 190 will couple many induced currents from the flux in the iron core 176 or 178. The secondary wire gauge shall be selected based on the current handling capacity necessary for the output of the device 10 due to the expected percentage recovery, and the operational magnification factor. Usually three to eighteen (3-18) gauge secondary wire 192 is sufficient, however, the choice of primary wire 182 also must be considered. The primary wire 182 should be the same as was used in creating the secondary winding or coil 160 of the magnification section 140.

A typical power frequency recovery section 170 might have a three (300) pounds of three (3) gauge for secondary wire 192, and one thousand five hundred (1500) pounds of twelve (12) gauge for primary wire 182. Since the wire alone is of significant weight, a winding machine capable of supporting and winding a one-ton coil at fifty to one hundred (50-100) pounds of tension is required. A tensioning mechanism is also necessary. One may also need a method to unwind and rewind the coils; therefore, it is likely another smaller winding machine capable of winding a three (300) pound load is also required. It is preferred to use a second winding machine as the tension mechanism to avoid unnecessary splices in the primary wire 182. Since there is so much volume of wire to wind on in a somewhat linear motion, a wire guide mechanism is also necessary to properly feed the wire onto the spool. The significant portion of any recovery section 170 is the primary coil 180. The majority of the spool 172 will be taken up by primary wire 182.

Insulation material 184 (thin plastic, transformer paper, etc.) is required for use between the primary and secondary coils 180, 190 as well as for the third requirement for large-scale recovery section design. The power frequency passive power generation system requires the primary winding 180 to be wrapped in a special manner delineated below (just as the magnification section 140) in order to stabilize the self-capacitance of the primary winding 180. This involves the use of insulation material 184 as well. This also insures an approximation to the lumped sum element of the recovery section 170 to its magnification section 140.

Power Frequency Recovery Device Assembly

Referring back to FIG. 19 and to FIGS. 28 through 33, the assembly of the power frequency recovery device 170 begins by tightly wrapping the secondary wire 192 around the former 174 of the spool 172. During this process the wire 192 shall be kept as close as possible to the previous winding, so as to create as dense a coil as possible when it is eventually in the presence of the induced electric field from the primary winding 180. This is done by machine, or by a human assisted by machines. Usually the secondary wire 192 will enter and exit through a hole in the spool 172.

Halfway through the length of the secondary coil or winding 190, one should insert a center tap 194 in the secondary 190 of the recovery section 170. This is to allow for proper grounding conditions and for standard established wiring connections for low voltage and high current circuits. If the center tap 194 is not included, the unit will still operate, but an external transformer with a center tap may be needed to safely connect the device in accordance with established wiring practices. After center-tapping the secondary, the remainder of the secondary coil or winding 190 should then be formed. Once the secondary coil or winding 190 of the recovery section 170 is done, the insulation material 184 (thin plastic sheets, transformer paper, etc.) is utilized along with some appropriate fastener to fasten a layer of insulation material 184 between the secondary winding 190 and the subsequently wound primary winding 180 of the recovery device 170. This is to protect the secondary winding 190 from the primary winding 180 in the case of an autotransformer connection where there could be a significant voltage difference across this physical surface inside the recovery section 170. For low power handling and or low voltage designs, this insulation may be omitted.

The next step in the assembly is to wind the primary winding or coil 180 on the spool 172 in the same direction as the secondary winding or coil 190 was wound. The primary winding or coil 180 shall also be wound in the same special manner that the secondary 160 of the magnification section 140 was wound to help insure the creation of a lumped sum element for the primary winding or coil 180 of the recovery section 170. As before, the self-capacitance can be stabilized for this large coil by winding special layers with insulation 184 between each layer. This helps both coils 180, 190 maintain a stable temporal resonance. Since resonant tuning is used to recover the magnified electricity or energy, formation of stable self-capacitance is of importance. Since the insulation 184 that separates the layers of coil experiences uniform voltage difference across its surfaces continuously, they form the dielectric layers of a capacitor. By using a stable material as this dielectric, two things occur. First, the dielectric constant is higher than that of air, so the effect of the air (which exhibits a varying dielectric constant) inside the coil is minimized. Second, the use of a higher dielectric constant material will enhance the capacitance as the primary winding or coil 180 is constructed, thereby allowing a desired resonant frequency to be reached with less wire.

The next step in assembly is to use a function generator and power amplifier to test the recovery section primary winding or coil 180 for its resonant frequency. For this test, use the low voltage secondary as the input, and test the recovery section primary winding or coil 180. The voltage resonance on the primary winding or coil 180 is desired to be four times the intended drive frequency; just as the magnification section 140 was tuned. So a six-hundred (600) Hz device should have a resonance of twenty-four hundred (2400) Hz. The temporal resonance must be periodically measured during construction so as to map its progress towards the desired resonant frequency. Adding and removing windings in layers can adjust the temporal resonance to the desired frequency. If the preferred method of design is being used where there is an appropriate temporal and spatial resonance overlap, then the total length of the primary wire 182 should additionally equal the quarter wavelength of the operational frequency.

The final step in assembly is to add the permeability enhancing material core 176 to the device 170. This can be a simple column core or an entire ring core enclosing both recovery section windings. Any iron used and not laminated and properly oriented in the direction of changing magnetic flux may excessively heat up. Unlike during construction of the magnification section 140, in a recovery section 170 we are attempting to achieve full magnetic coupling between the primary winding 180 and secondary winding 190 of the recovery section 100.

The use of this type of recovery device 170 is to create a direct electrically coupled power frequency passive power generation system 10. The secondary winding 190 of the recovery section 170 when properly tuned and connected with the magnification section 140 forms a generator that can power an external load 46.

Since power frequency models typically operate at a fixed frequency, the variable high voltage capacitor 38 is usually required to make the final tuning adjustments as illustrated in FIG. 34 and as was delineated above in the introduction to local recovery with reference to FIG. 1.

Additional Use and Operation

There are multiple uses for the magnification section or device 20 of the passive power generation system 10. All the following uses apply to both the high frequency magnification device 50 and the power frequency magnification device 140.

First, the magnification device 20 of the passive power generation system 10 can be used for the study of the phenomenon of open circuit current content. Second magnification device 20 can be connected to the Earth and used as a wireless power transmitter. Third, the magnification device 20 can be connected to the Earth and used in a method of electrically measuring the diameter of the planet directly across from the point of insertion. Forth, the magnification device 20 can be used in conjunction with a recovery section or device 40 delineated hereinbelow to locally recover the magnified electricity or energy for use in the passive power generation system 10. Fifth, the magnification device 20 can be used to create excessively large magnetic fields. This is normally prohibited by natural law since permeability is a multiplicative factor in magnetic fields. The magnification factor allows this to be overcome to a certain extent especially for an air-core magnification section.

Sixth, the magnification device 20 can be used to study of the phenomenon of open circuit current content which is a new topic. Typically the user would be equipped with a sinusoidal function generator connected to a power amplifier and to the primary of magnification device with insulated plates 196, 198 (FIGS. 11 and 34) terminating both ends of the secondary. Then a high voltage probe and high current (as well as high voltage) current probe enables examination of the relevant real-time data using an oscilloscope or spectrum analyzer. Of interest may be the magnification phenomenon looking at the voltage, current, and phase angle across the open circuit, as different frequencies were input into the primary.

Seventh, and as noted above and illustrated in FIGS. 10 and 26, the magnification device 20 can be used as a wireless power transmitter. This takes advantage of the fact that Earth itself is a free body in space and one can set up standing waves that propagate around the globe by connecting one end of the secondary coil to the Earth (preferably at a calculated node) and using the open circuit current content phenomenon to act as a continual source. Since Earth is a free body, electrically isolated in outer space, it does not disturb the freedom of the portion of the secondary coil that must remain electrically free. Subsequently, the proper choice of drive frequency can start another earthbound spatial resonance that will propagate using the entire globe. With information from the eighth use below, a frequency of global resonance can be calculated for the spatial wavelength. Then using that information an appropriate drive frequency can be chosen to enhance the wireless transmission capabilities.

The eighth use of magnification device 20 is as a device to calculate the diameter of the planet. Connecting the system as described in the sixth use, and then connecting one end of the secondary coil to the planet allows one to determine the frequency of maximum current transmission to the planet. The distance of the planet's diameter is found by dividing the speed of light (186,000 miles/second) by that frequency. The more accurate the frequency measurement is, the better the distance reading. Also, if the opposite side of the planet from where the secondary is grounded happens to be an ocean, then the distance measurement changes with the ocean tides.

The ninth use of magnification device 20 is in combination with the recovery section 40 delineated hereinbelow for creating the passive power generation system 10 for magnifying electricity or energy and recovering at least a portion of the magnified electricity or energy. High frequency passive power generation system use high frequency to achieve a high magnification factor, power frequency passive power generation systems use very large inductive time constants with permeability enhancing cores. Important from a safety standpoint is that not all the electricity contained in any magnification device can typically be recovered. Therefore it is always important to insulate the termination plates 196, 198 (FIGS. 11 and 34) and/or elevate one so as not to create excessive danger from the high-energy current content of the open circuit. When forming section 20, an elevated plate may be an often seen element. This is especially true for high frequency and/or high power versions. This is also true for experiments related to the use of generating large magnetic fields for experiments. Since not all the magnified electricity or energy can be locally recovered, it is also necessary to overcompensate for this when designing the magnification factor. It is always preferred to make the magnification factor as high as possible when intending to create a section.

Magnification Device Geometry

For use and operation, FIGS. 35 through 49 illustrate fifteen geometries that insure a portion of the secondary coil is electrically free. FIGS. 35 through 41 and 49 illustrate eight geometries that have the primary coil on the outside of the secondary coil. FIGS. 42 through 48 illustrate seven geometries having the primary coil wound on the inside of the secondary coil.

Moreover, the following relates to the different geometries that may be used to create magnification devices 20. It should be noted that any of the mentioned geometries can be used for either high frequency (30 MHz-1 kHz) or power frequency (300 Hz-1 kHz) devices. These geometries all have the same thing in common: they are intended to insure a portion of the secondary coil maintains electrical freedom.

A first category includes geometries with the primary coil on the outside of the secondary so that the electric field falls off linearly towards the center of the primary windings until it reaches zero at the center of the former. Geometries in this category include: 1) Thin and Flat Geometries wherein the former diameter must be less than half the distance from the inside of the primary winding to the center of the former. By adjusting the thickness of the former, the temporal resonance may be widely adjusted. 2) Wardencliffe Geometries wherein the geometry is to have close magnetic coupling between the primary and secondary coils for a portion of the coils and then have another portion of the secondary coil purposely placed in a region of low electric field strength, such as centered over the central region of the tightly coupled coils. Alternatively the portion of the secondary coil need not be near the coils with tight mutual inductance at all, but otherwise remotely located. 3) Column Geometries wherein the secondary may be formed around a long cylinder of which the primary is only wound up less than half the exterior length. This cylinder may alternatively be of odd shape such as a convex or concave cone, et cetera.

A second category includes geometries with the primary coil on the outside of the secondary so that the electric field falls off as the primary radius squared divided by twice the distance outside the primary windings and into the secondary windings. Geometries in this category include: 1) The aforementioned thin and flat geometries disclosed as a preferred embodiment for the development method delineated hereinbelow. 2) Column Geometries wherein the secondary may be formed around a long cylinder of which the primary placed inside only takes up less than half the interior length. This cylinder may alternatively be of odd shape such as a convex or concave cone, et cetera.

A third category includes multiple coil geometries wherein geometries in this category include: 1) Adjacent Coils as illustrated in FIG. 34 wherein the secondary may be formed as a thin and flat coil with one or multiple primary coils positioned both adjacent and concentric to the central axis of the secondary coil. In addition, the primary coil may be placed in any other angle or position that facilitates direct magnetic coupling to a portion of the secondary coil via the proximity of the primary coil(s) and secondary coil to each other. If an even number of primary coils are used, then they will usually be connected so their magnetic fields are oriented in the same direction all the time, with their magnetic flux permeating a portion of the secondary coil between them. Furthermore, multiple primary coils may be connected in series and/or parallel with each other. 2) Multiple coil versions of the aforementioned category one through three geometries created with multiple primary and/or secondary coils and the aforementioned category one through three geometries created with multiple strands in their primary and/or secondary coils.

Figure 50:
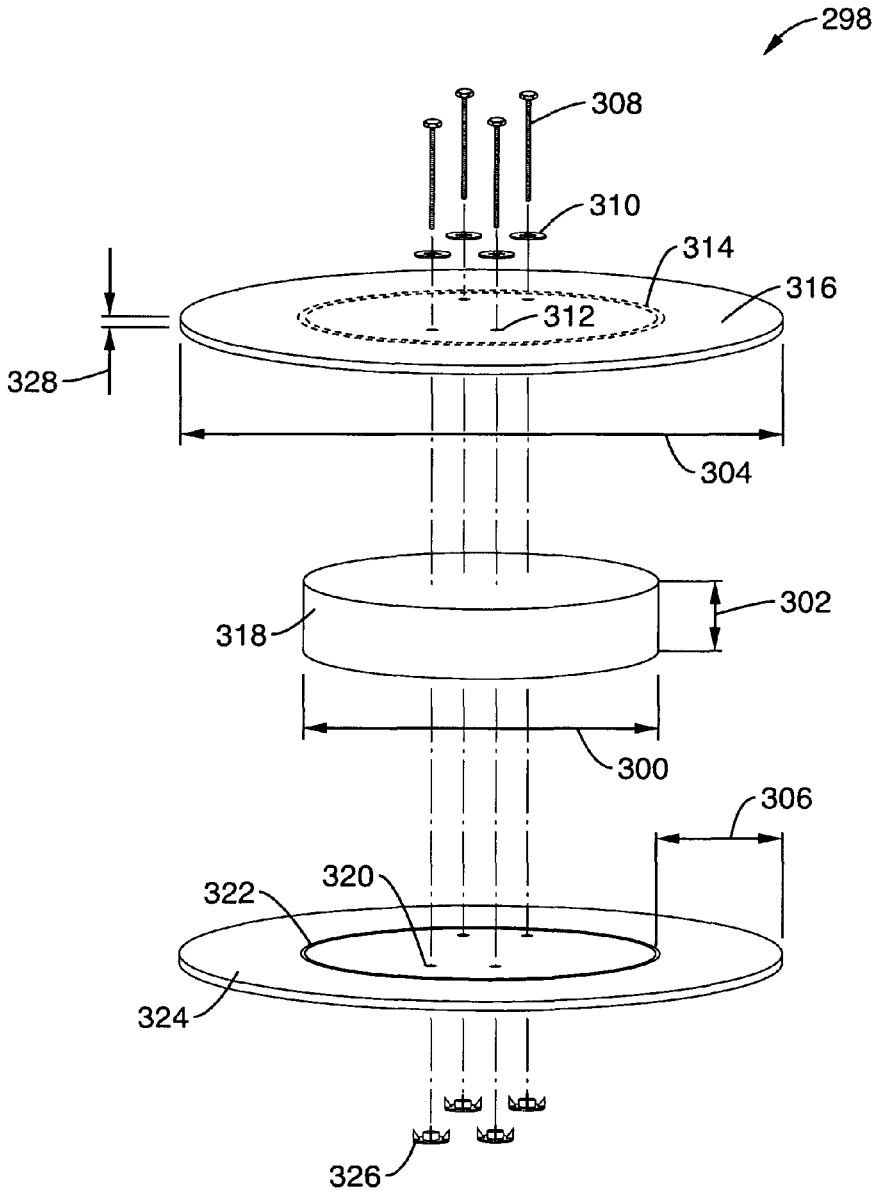
FIG. 50 is an exploded parts view of a spool comprised of a single central former, two spool ends and fasteners.

As will be further delineated in the advanced development method below, FIG. 50 illustrates an exploded parts view of a spool 298 comprised of a single central former 318, two spool ends 316, 324 and appropriate fasteners comprised of bots 308 that pass through respective apertures 312, 320, washers 310, and nuts 326. Items 300 through 306 depict dimensions. Choosing particular dimensions for items 300, 302, and 304 produces a particular temporal resonant frequency for an embodiment. Items 314 and 322 depict the partial recess in each respective spool end to receive the central former.

Figure 51:
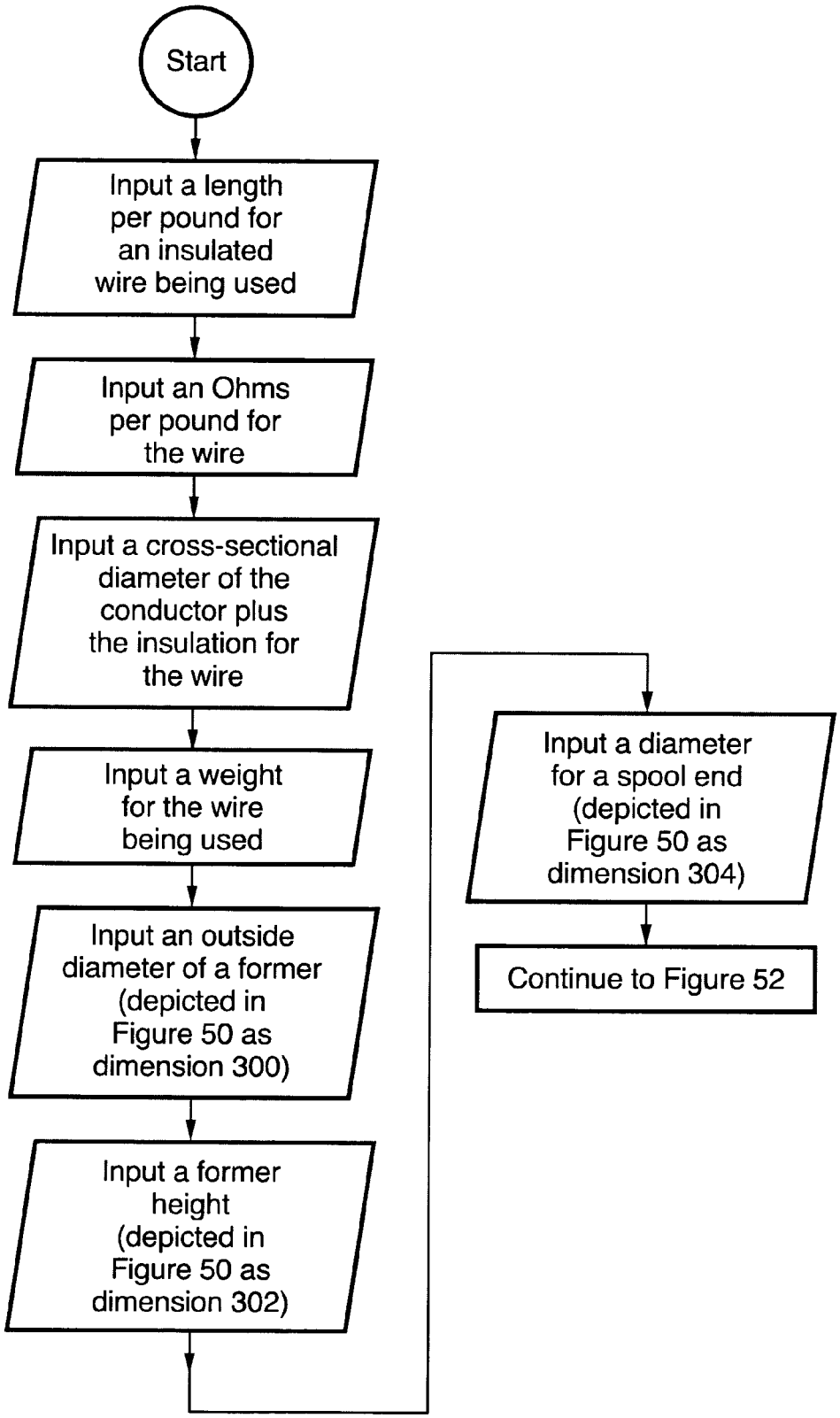
FIGS. 51-53 illustrate a flowchart view of a method to calculate a temporal resonant frequency for a coil with a particular set of geometric dimensions, as well as its magnification factor.
Figure 52:
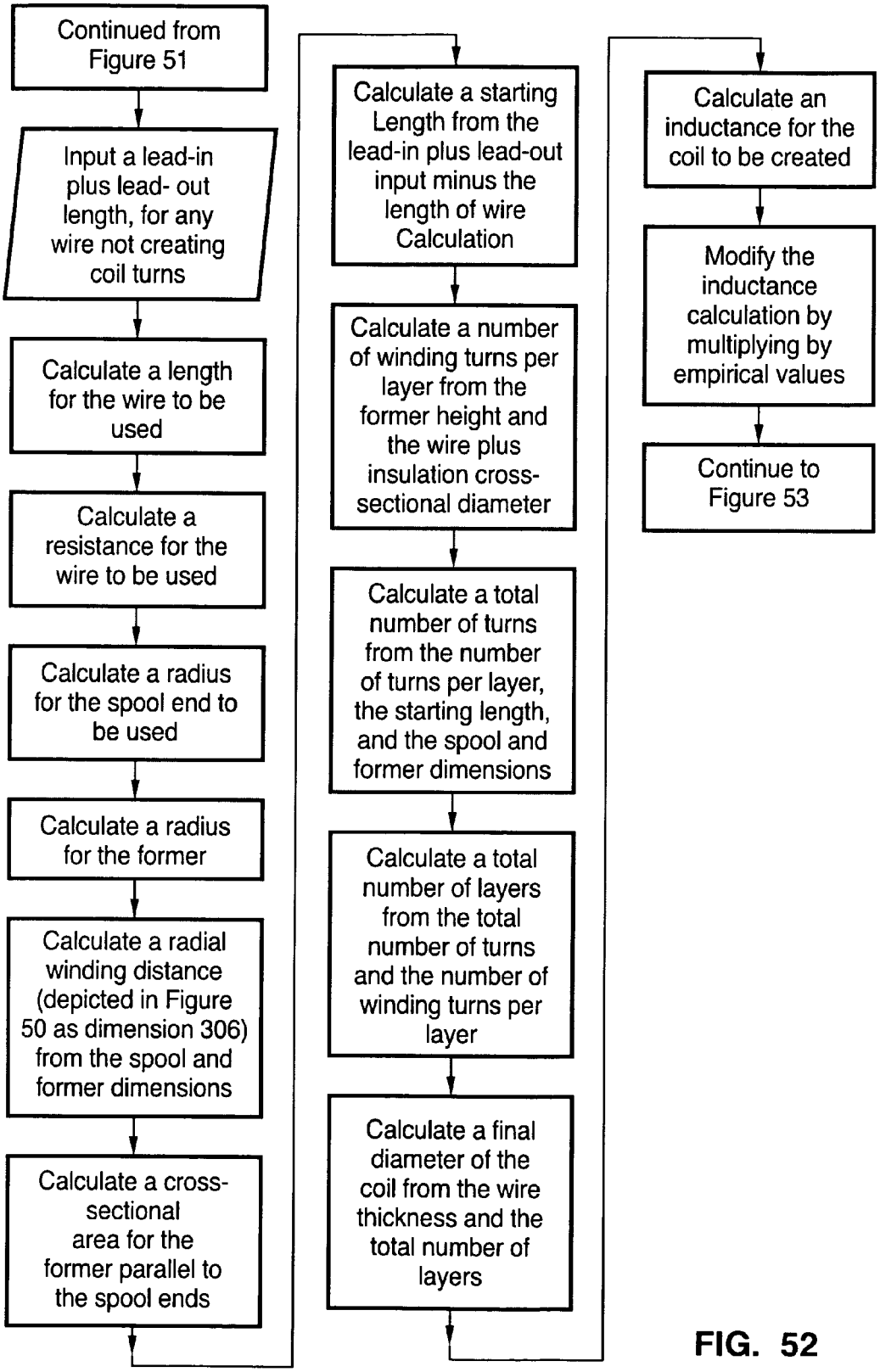
Figure 53:
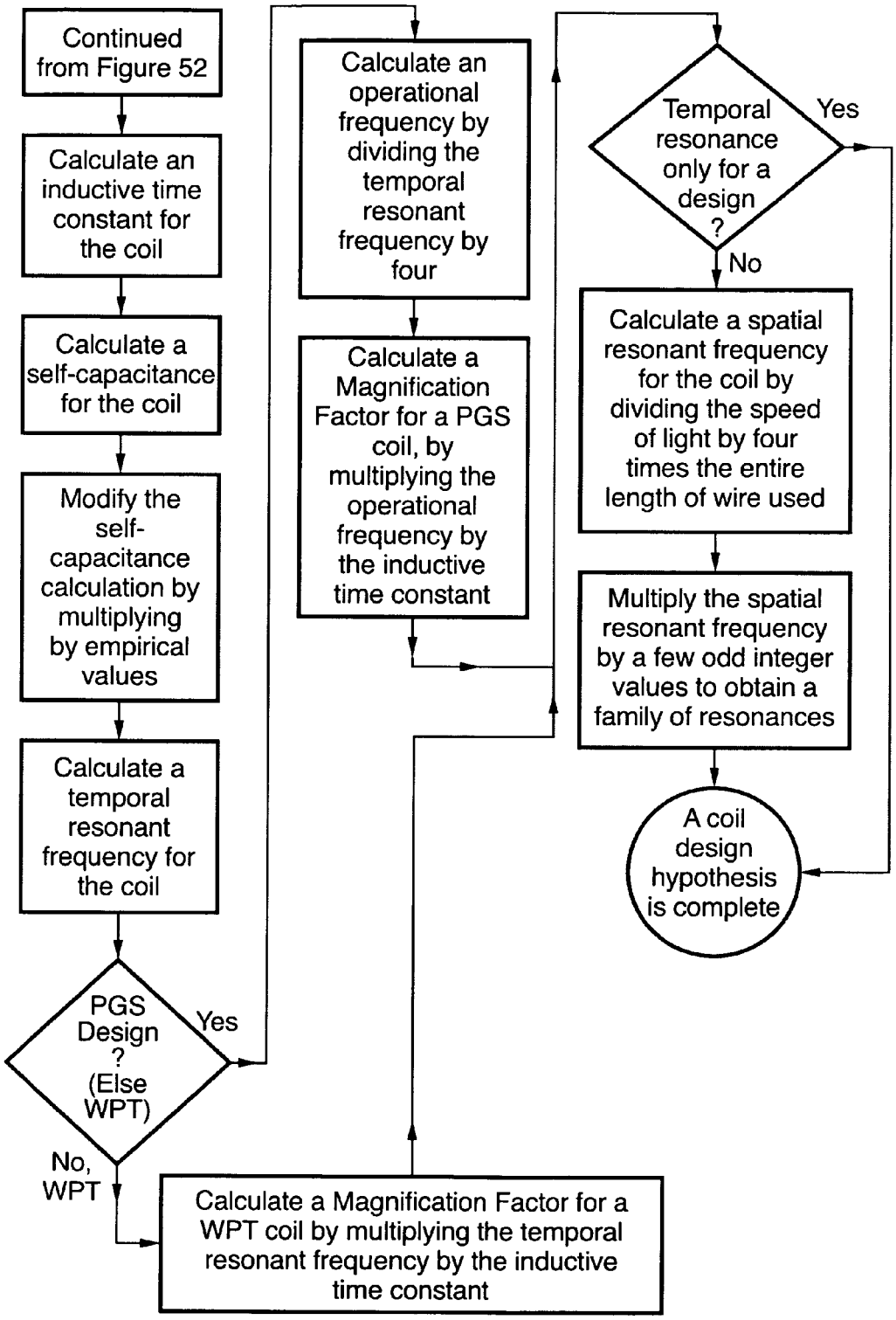
Figure 54:
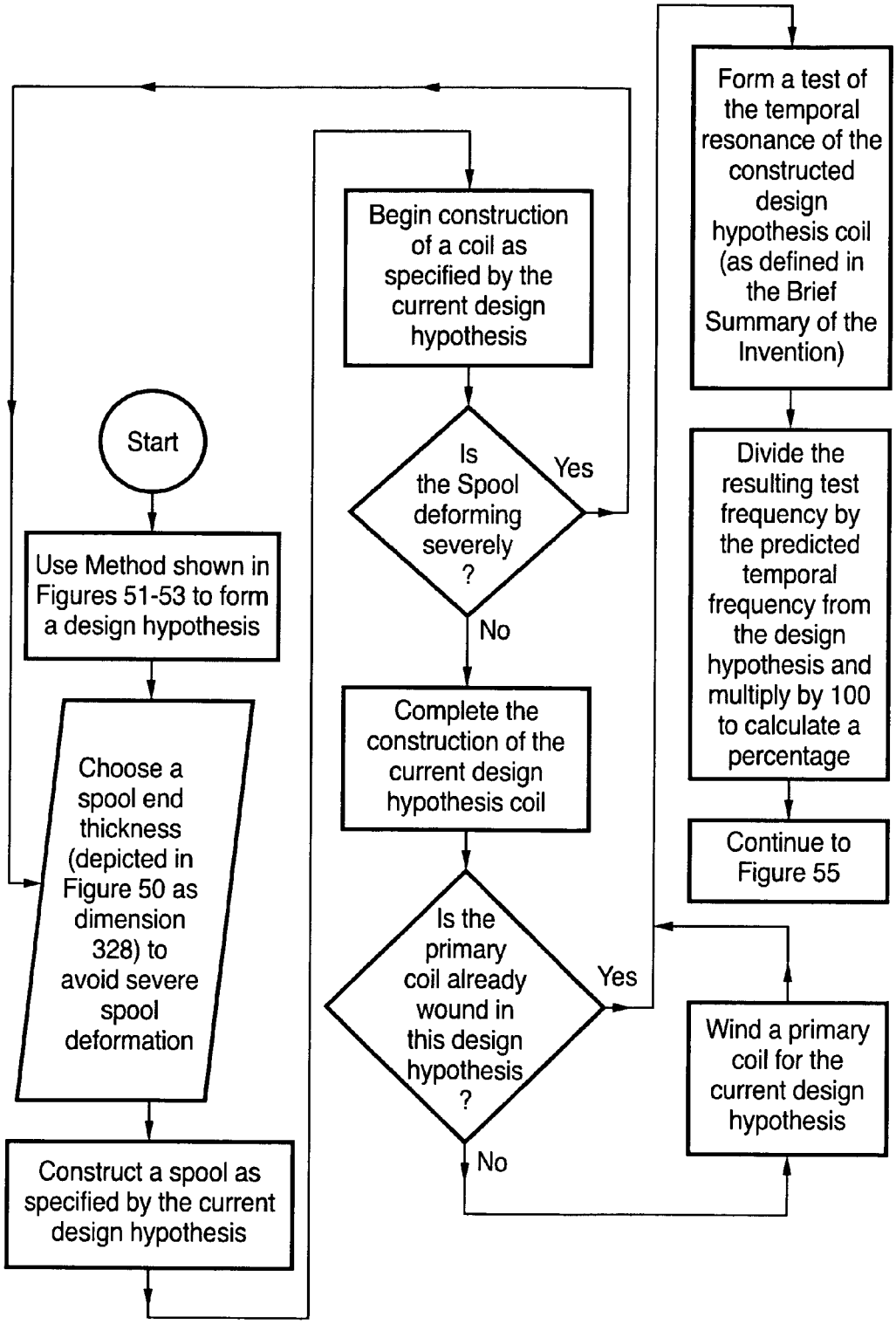
FIGS. 54-61 illustrate a flowchart view of an advanced development method for creating physical embodiments of wireless power transmitters and passive power generation systems wherein the advanced development method is based on a design hypothesis generated by the method illustrated in FIGS. 51-53 and wherein the advanced development method applies to both high frequency and power frequency devices.
Figure 55:
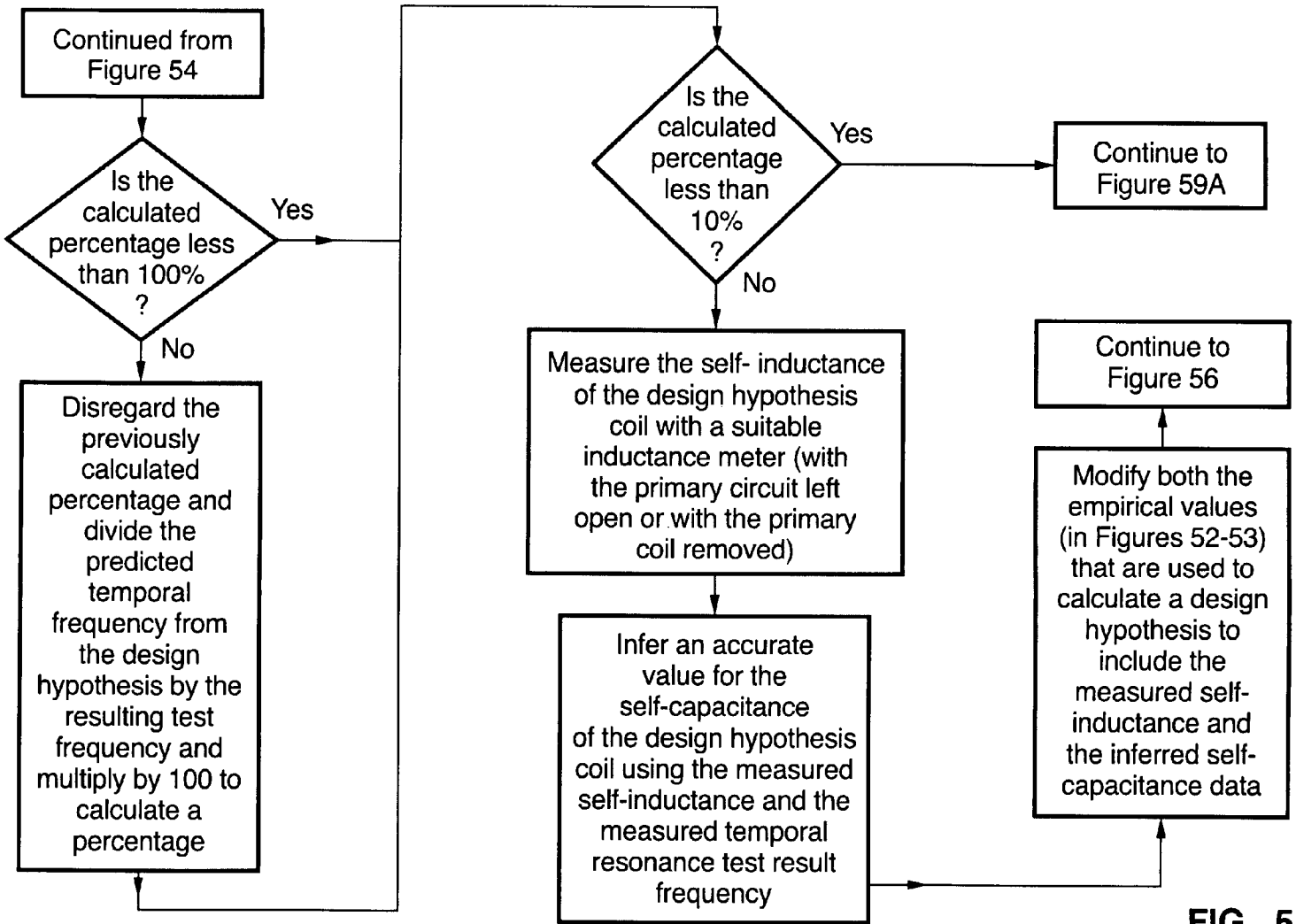

Additionally, and as will also be further delineated in the advanced development method below, FIGS. 51 through 53 illustrate a method to calculate a temporal resonant frequency for a coil with a particular set of geometric dimensions, as well as its magnification factor. The method allows for temporal resonance and spatial resonance considerations to both be optionally employed in creation of a design hypothesis for a wireless power transmitter including 92, 164. In addition, the method allows for temporal resonance and spatial resonance considerations to both be optionally employed in creation of a design hypothesis for a passive generation system including passive power generation system 10. The method applies to high frequency and power frequency devices. The result is to generate a design hypothesis for a particular embodiment of either a wireless power transmitter, or a passive generation system including specific geometric dimensions for the spool and the wire to be used.

Furthermore, and as will also be further delineated in the advanced development method below, FIGS. 54 through 61 illustrate an advanced development method for creating physical embodiments of wireless power transmitters and passive generation systems. The advanced development method is based on a design hypothesis generated by the method illustrated in FIGS. 51-53. The advanced development method applies to both high frequency and power frequency devices. The advanced development method considers temporal resonance devices, spatial resonance devices, and employing both spatial and temporal resonances together in devices.

Advanced Development Method

A method flowchart for the Advanced Development Method is illustrated in FIGS. 54-61. The first step of the advanced development method is to form a design hypothesis using an additional method, specified by a flowchart illustrated in FIGS. 51-53. By refining the design hypothesis though subsequent iterations of the Advanced Development Method, a suitable target embodiment will emerge. To begin the formation of a design hypothesis beginning in FIG. 51, parameters of a wire, and geometric dimensions of a spool must be specified. Preliminary details about the potential design are calculated such as the total length of wire to be used. A simulation is run expending the calculated length of wire, beginning with the given spool dimensions. An approximation of the total number of turns and total number of layers is an output of this simulation, as well as, whether the given spool dimensions are of sufficient size to accommodate the total length of wire to be used. A theoretical inductance is calculated from the simulation results. The inductance is then multiplied by empirical values to obtain a more accurate approximation. With the preliminary details computed and the inductance calculation complete, an inductive time constant for the simulated coil can be formed. Using data from the simulation, a theoretical self-capacitance for the coil is computed. This self-capacitance is then modified by empirical values to obtain a more accurate approximation. Then a temporal resonant frequency for the simulation can be calculated from the inductance and self-capacitance approximations formed for the coil.

Still referring to FIGS. 51-53, the calculation of the magnification factor is next, however, this calculation depends on the type of design hypothesis. If the design hypothesis is for a wireless power transmitter (WPT), the magnification factor will be found by multiplying the temporal resonant frequency by the inductive time constant. This is because a wireless power transmitter is driven at its temporal resonant frequency during operation. If the design hypothesis is for a passive power generation system (PGS), the magnification factor will be found by first dividing the temporal resonant frequency by four, in order to find the operational frequency. Then the operational frequency will be multiplied by the inductive time constant to determine the proper magnification factor for a PGS design hypothesis. Once a magnification factor is calculated, whether for a WPT or a PGS, if the device is utilizing only temporal resonance for operation, then the design hypothesis is complete. However, if spatial resonance is also to be considered then a spatial resonant frequency and a few harmonics are also calculated. The final design hypothesis therefore, will be in one of four forms: a temporal resonance only WPT, a temporal resonance WPT with spatial considerations, a temporal resonance only PGS, or a temporal PGS with spatial considerations. Once a design hypothesis is formed, the Advanced Development Method can continue to be utilized to test and finish a target embodiment, or other standalone application. Passive generation system, passive power generation system, and PGS are interchangeable terms referring to the system shown in FIGS. 1-2.

The next several steps in the Advanced Development Method illustrated in FIGS. 54-61 involve building a physical device comprised of a spool and a coil based on the design hypothesis specifications. Once the spool and coil have successfully been created, a test of the temporal resonant frequency is performed. To test the temporal resonant frequency of the design hypothesis spool and coil, a primary coil will also have to be present. Upon temporal resonance testing, the design hypothesis coil forms the secondary coil of an embodiment of device 50 or of device 140. The temporal resonance test is preformed as follows. Hook the primary coil to a suitable source of powerful oscillations as indicated in FIG. 10 or FIG. 26, to form the input circuit. During the temporal resonance test, the generator 26 and drive frequency 30 will be variable. A suitable voltage meter (not pictured in FIG. 10 or FIG. 26) is connected to secondary coil or winding 96 or to secondary coil or winding 168. The temporal resonant frequency is defined as the drive frequency 30, upon which the voltage reading on the secondary coil or winding 96 or secondary coil or winding 168 is at a maximum; given that the input voltage to primary coil or winding 94 or primary coil or winding 166 remains approximately constant as the drive frequency 30 is swept throughout the test. Once the temporal resonant frequency has been physically tested, the result is compared to the predicted value from the design hypothesis and percentage is calculated. If the value of the measured temporal resonance from the test is within 10% of the predicted value from the design hypothesis, then the design has initially passed and the method continues. If however, the design hypothesis does not pass this initial evaluation, then measures are taken of the current design in order to refine the empirical values used in calculating subsequent design hypotheses.

Figure 56:
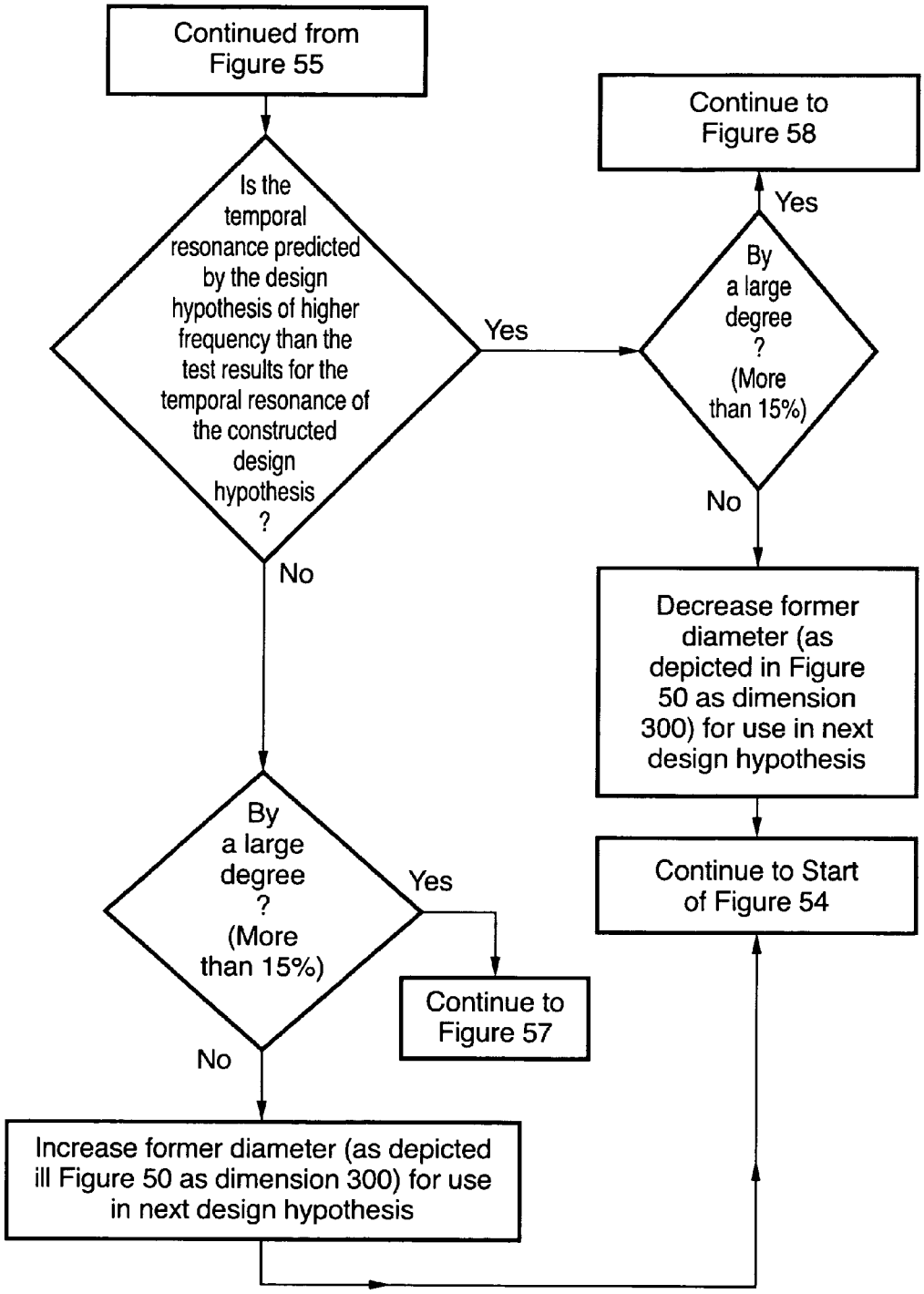
Figure 57:
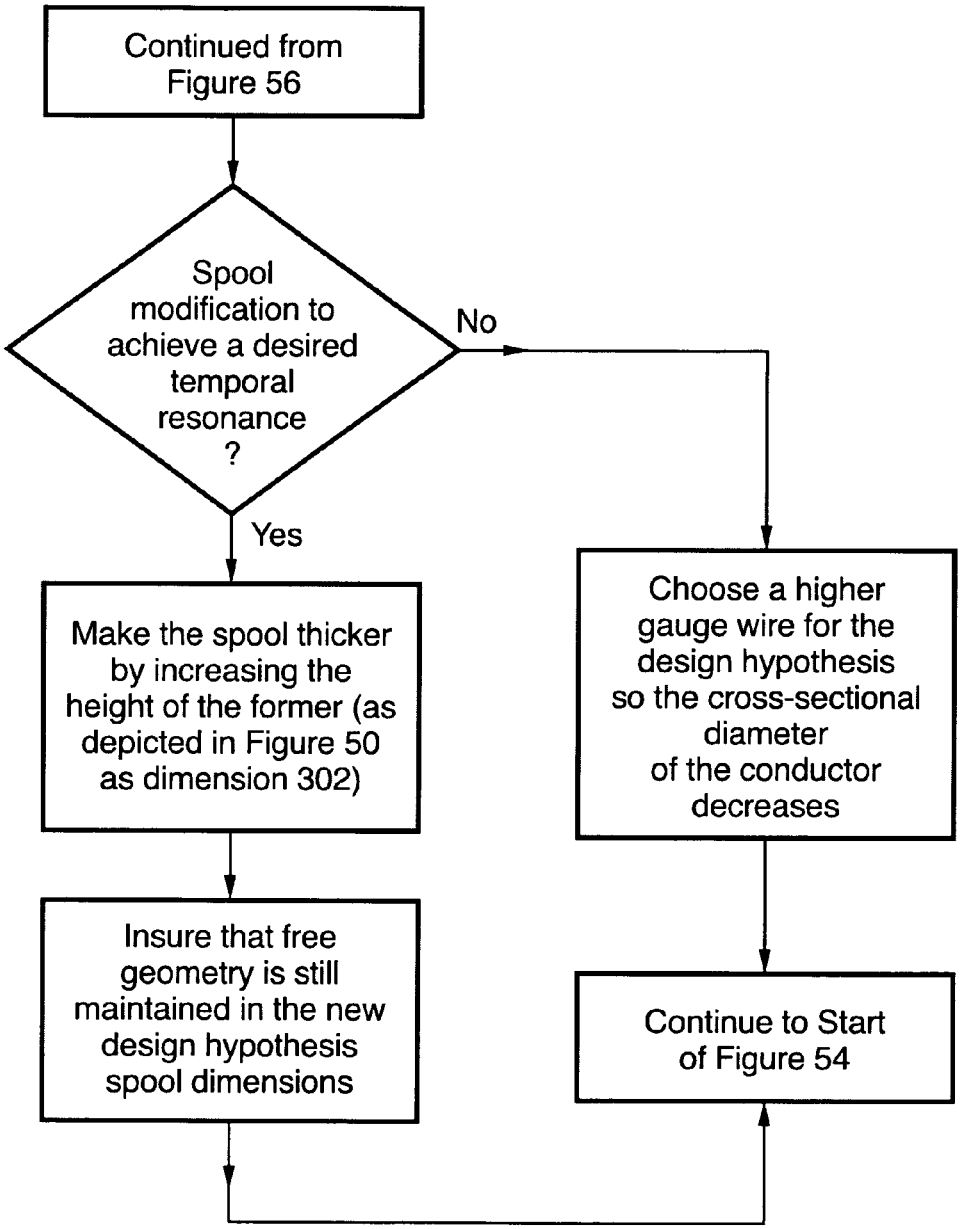
Figure 58:
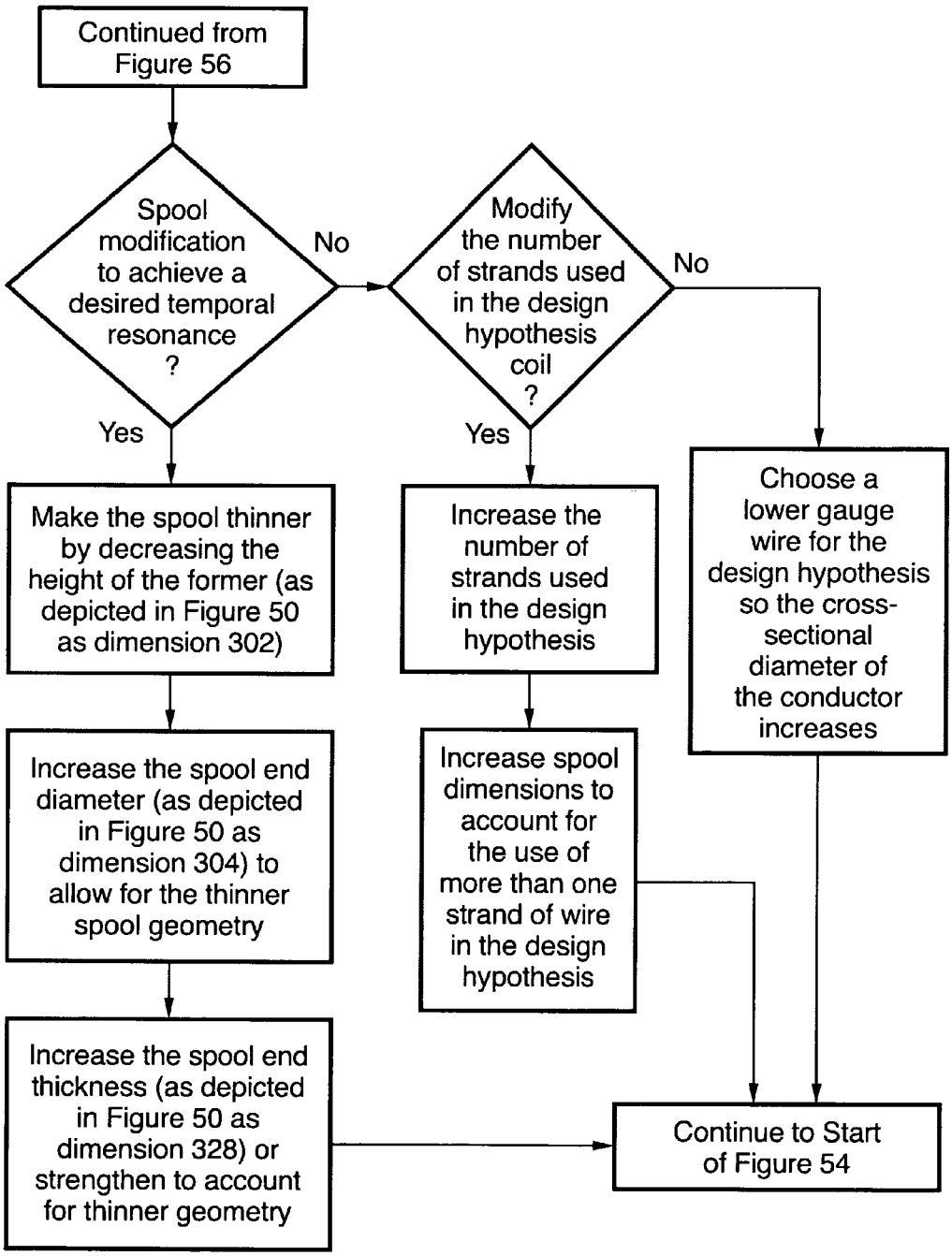

If the design hypothesis does not pass the initial evaluation of its temporal resonant frequency, FIGS. 56-58 provide several options and tests to determine what design parameters to change in order to come closer to the target design in the next iteration. Nonetheless, all these paths lead back to the start of the Advanced Development Method and to refining a design hypothesis until the initial test comparing the predicted and measured resonance is passed to within a 10% margin. Once a design hypothesis has passed that initial test, the advanced development method continues.

Figure 59A:
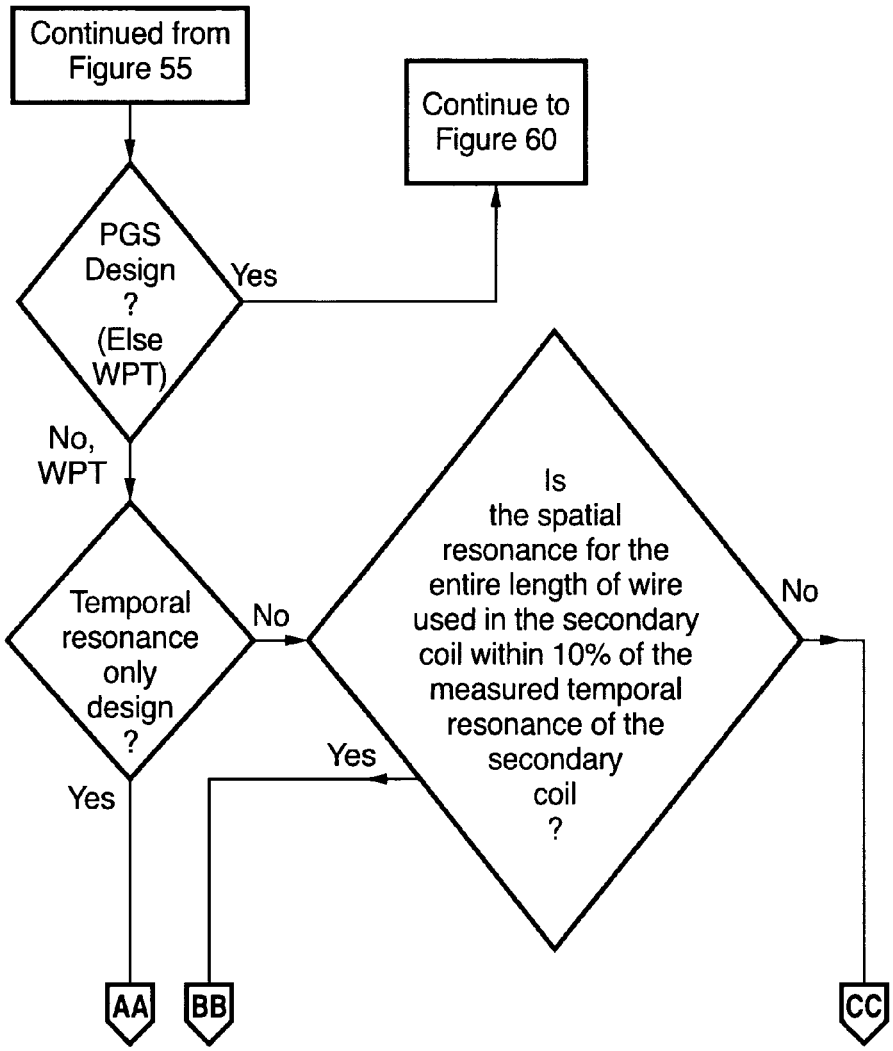
Figure 59B:
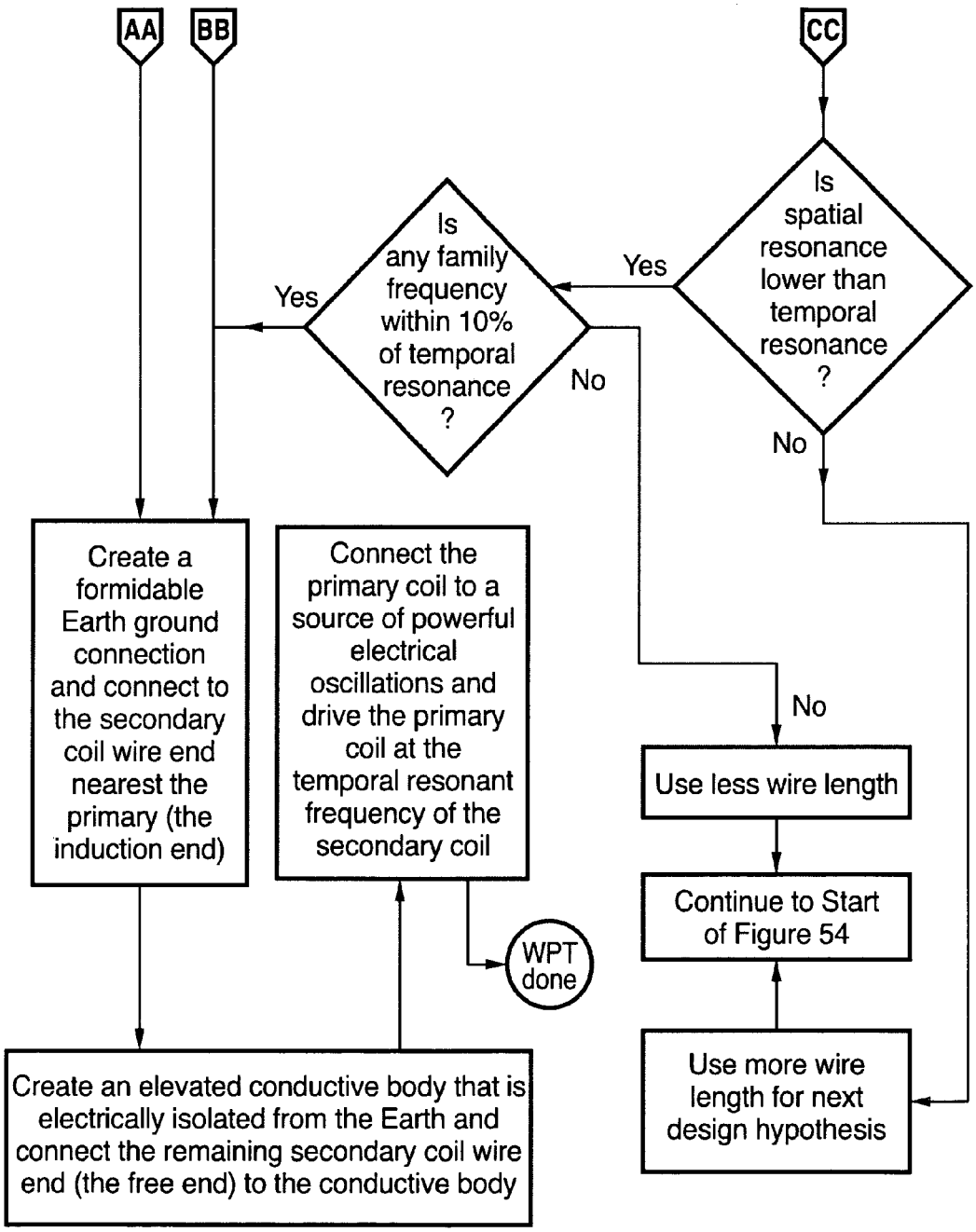
Figure 60:
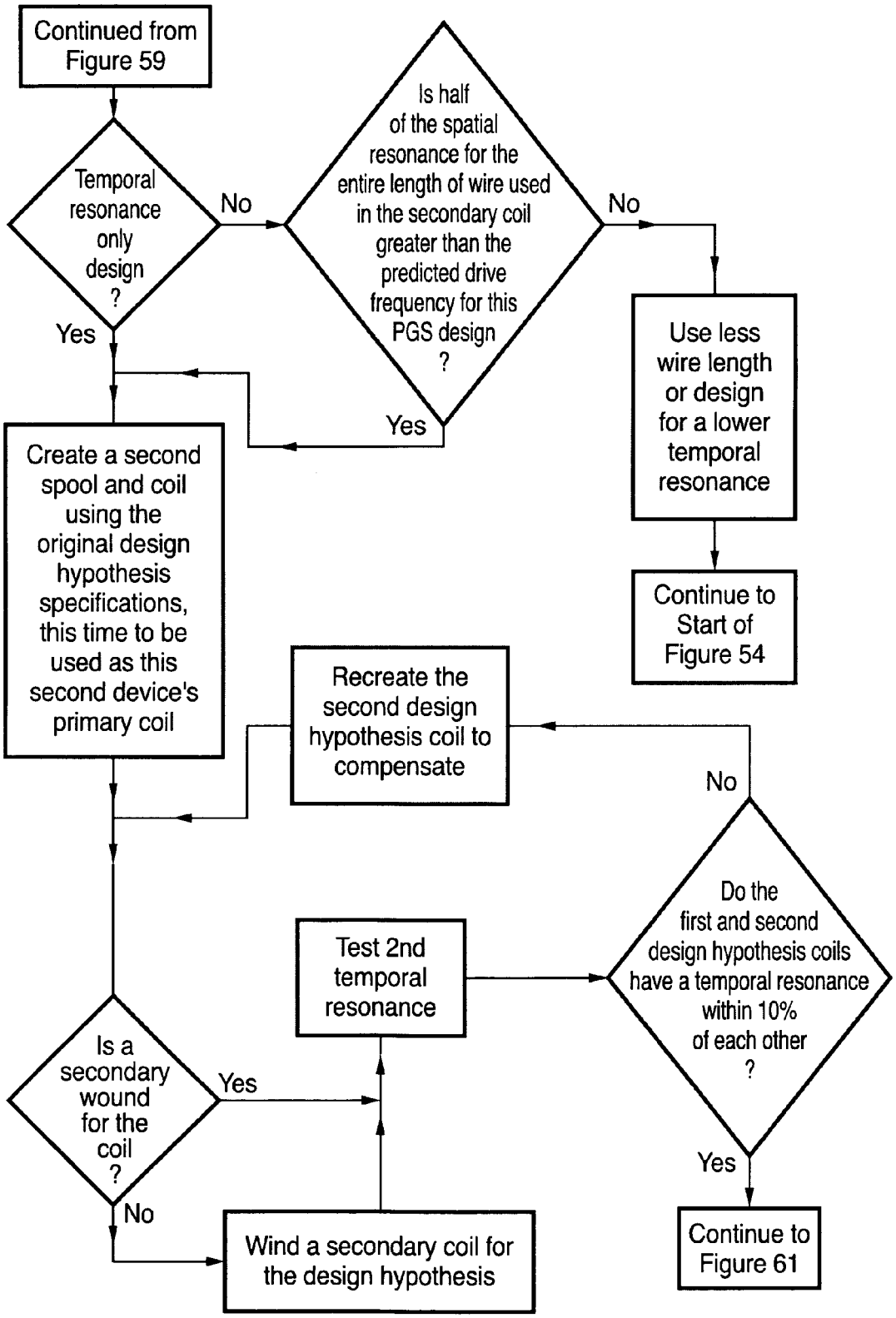
Figure 61:
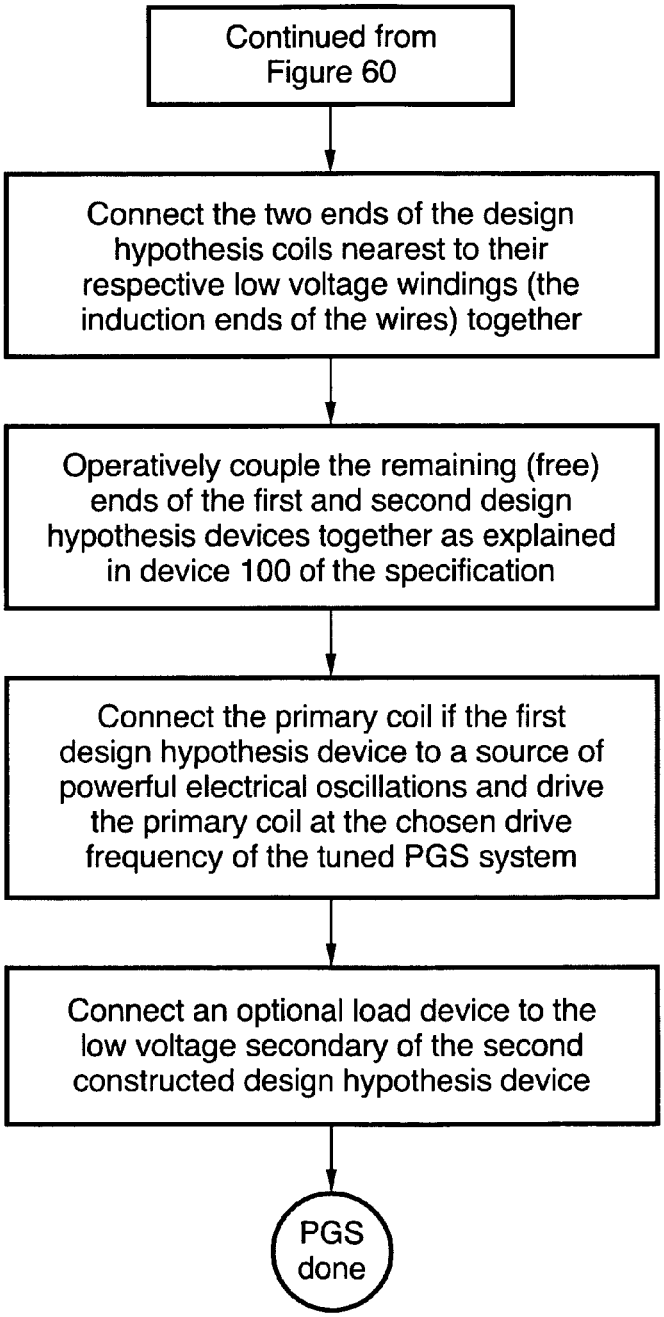

As illustrated in FIG. 59, the design hypothesis is now evaluated for its type: a temporal resonance only WPT, a temporal resonance WPT with spatial considerations, a temporal resonance only PGS, or a temporal PGS with spatial considerations. If spatial resonance is considered in the design hypothesis, then the design hypothesis must pass additional verifications. If a temporal resonance only WPT is the type of design hypothesis, once the initial test has been passed then the method proceeds to instruct on the completion of a WPT. If a temporal resonance WPT with spatial considerations is the type of design hypothesis, then the method checks for the spatial resonance or one of its harmonics to equal the measured temporal resonant frequency. If a temporal resonance only PGS is the type of design hypothesis, then the method instructs on how to build a recovery device 100 or a recovery device 170 and how to calculate the proper coupling means 34 for the system. If a temporal resonance PGS with spatial considerations is the type of design hypothesis, then the method instructs on how to build a recovery device 100 or a recovery device 170 and how to calculate the proper coupling means 34 for the system, then the method checks that half the spatial resonance is greater than the operational frequency.

The result of the Advanced Development Method is an embodiment of device 20, device 50, device 140, or a standalone application, if the design hypothesis specified a WPT. The result of the Advanced Development Method is an embodiment of a passive power generation system 10, or a standalone application if a PGS was specified. Finally, the method for determining a design hypothesis and the advanced development method itself applies to all the free geometries listed in FIGS. 35-49, and disclosed herein above.

For an example embodiment of device 20, in the form of a temporal resonance only WPT, a central insulating former and two insulating spool ends may be brought together and held by appropriate fasteners, which is depicted in FIG. 50 in an expanded view. In the example embodiment of device 20, the former diameter denoted in FIG. 50 as dimension 300 is approximately ten inches (10"). The height of the former denoted in FIG. 50 as dimension 302 is approximately two inches (2"). The diameter of the spool ends denoted in FIG. 50 as dimension 304, is approximately twenty inches (20"). The depth of each recess of the spool ends is one-eighth inch (⅛"), as denoted in FIG. 50 as items 314 and 322. The winding channel made up by this spool is five inches (5") long, and one and three-quarter inches (1¾") high. The thickness of each spool end is three-eighths of an inch (⅜"), as denoted in FIG. 50 as dimension 328. A fifty foot (50') long, standard 600V rated twelve gauge (12 AWG) wire is wrapped around the central former approximately 134 times to create an approximately 0.88 mH and approximately 0.4Ω primary winding 22. Then an optional thin layer of plastic insulation is wrapped around the primary winding. Finally, eighteen gauge (18 AWG) magnetic wire is wrapped atop the insulating layer approximately 1875 times, to form an approximately 0.5 H and approximately 22.4Ω secondary winding 24. The turns ratio for this device 20 is approximately 1:14. The measured temporal resonant frequency is approximately twenty thousand cycles per second (20 kHz). By connecting the end of the secondary winding 24 nearest to the central former to a formidable Earth ground connection, and by connecting the remaining end of the secondary winding 24 to a conductive body isolated from Earth, a section is formed that will interact with the planet via electric voltages and electric currents. By connecting a generator running at 20 kHz to the primary winding 22, a wireless power transmitter can be formed to substantially magnify the power input to device 20 through the primary winding 22 as energy is conveyed to the secondary winding 24 at the rate of approximately once every fifty microseconds (50 μs) while it takes approximately twenty-two point three milliseconds (22.3 ms) for any single energy transfer to dissipate to approximately sixty-three percent (63%) of its original value as dictated by the conservation of energy. Therefore, the turns ratio will no longer be an accurate determinate of the electric voltage present on the secondary winding 24. The magnification factor for this example embodiment is approximately four hundred forty-six (446) at 20 kHz.

For an example embodiment of device 10, in the form of a temporal resonance only PGS, two pair of central insulating formers and two pair of insulating spool ends may be brought together and held by appropriate fasteners, a single of which is depicted in FIG. 50 in an expanded view. In this example embodiment of device 10, the former diameters denoted in FIG. 50 as dimension 300 are approximately ten inches (10"). The heights of the formers denoted in FIG. 50 as dimension 302 are approximately two inches (2"). The diameters of the spool ends denoted in FIG. 50 as dimension 304, are approximately twenty inches (20"). The depths of each recess the two pairs of spool ends is one-eighth inch (⅛"), as denoted in FIG. 50 as items 314 and 322. The winding channel made up by these spools are five inches (5") long, and one and three-quarter inches (1¾") high for each spool. The thickness of each spool end is three-eighths of an inch (⅜"), as denoted in FIG. 50 as dimension 328. A fifty foot (50') long, standard 600V rated twelve gauge (12 AWG) wire is wrapped around the central former of each spool separately approximately 134 times to create an approximately 0.88 mH and approximately 0.4Ω winding. Then an optional thin layer of plastic insulation is wrapped around the winding on each. Finally, eighteen gauge (18 AWG) magnetic wire is wrapped atop the insulating layer on both devices approximately 1875 times, to form an approximately 0.5 H and approximately 22.4Ω winding. The turns ratio for this magnification device 20 and this recovery device 40 is approximately 1:14. The magnification device 20 has the twelve gauge (12 AWG) wire forming its primary winding 22, while its eighteen gauge (18 AWG) magnetic wire forms the secondary winding 24. The recovery device 40 has an opposite arrangement of the two windings. In recovery device 40, the eighteen gauge (18 AWG) magnetic wire comprises the primary winding 42, and the twelve gauge (12 AWG) wire comprises the secondary winding 44. The magnification device 20 is a special step-up transformer, whereas the recovery device 40 is a special step-down transformer. The measured temporal resonant frequency for each is approximately twenty thousand cycles per second (20 kHz). Therefore, the operational frequency or drive frequency for the passive generation system could be chosen to be five thousand cycles per second (5 kHz). For a drive frequency of 5 kHz, the coupling means 34 is calculated to be approximately four point five nanoFarads (4.5 nF). By connecting the end of the secondary winding 24 farthest from device 20's central former to one side of an external 4.5 nF capacitor, and by connecting the end of primary winding 42 farthest from device 40's central former to the other end of the external capacitor, and by connecting the two remaining ends of secondary winding 24 of device 20 and primary winding 42 of device 40 together; a series tuned circuit is formed. By connecting a generator running at 5 kHz to the primary winding 22, a passive power generation system can be formed to substantially magnify the power input to device 20 through the primary winding 22 as energy is conveyed to the secondary winding 24 at the rate of approximately once every two hundred microseconds (200 μs) while it takes approximately twenty-two point three milliseconds (22.3 ms) for any single energy transfer to dissipate to approximately sixty-three percent (63%) of its original value as dictated by the conservation of energy. Therefore, the turns ratio will no longer be an accurate determinate of the electric voltage present on the secondary winding 24. The magnification factor for this example embodiment is approximately one hundred twelve (112) at 5 kHz. The coupling means 34 connected to the recovery device 40 will recover a portion of this magnified power locally for use in load 46.

The above delineation of the embodiments of the passive power generation system 10, including their uses and operation, demonstrates the industrial applicability of this invention.

Accordingly, it should be apparent that further numerous structural modifications and adaptations may be resorted to without departing from the scope and fair meaning of the present invention as set forth hereinabove and as described herein below by the claims.

I claim:

1. A magnification section, comprising:

a primary winding having a first number of turns and driven at a drive frequency; and a secondary winding disposed concentric with said primary winding and having a second number of turns greater than said first number of turns for providing an inductive time constant greater than a time between cycles of the drive frequency for allowing currents induced in said secondary winding by said primary winding to superimpose for magnifying energy so long as a portion of said secondary winding remains electrically free relative to said primary winding.

2. The magnification section of claim 1 wherein said secondary winding is formed from a conductor having a length substantially equal to a quarter wave length of the drive frequency.

3. The magnification section of claim 1 wherein said secondary winding is formed from a conductor having a length substantially equal to an odd integer multiple of a quarter wave length of the drive frequency.

4. A wireless power transmitter, comprising:

a primary winding having a first number of turns and driven at a drive frequency;

a secondary winding disposed concentric with said primary winding and having a second number of turns greater than said first number of turns for providing an inductive time constant greater than a time between cycles of the drive frequency for allowing currents induced in said secondary winding by said primary winding to superimpose for magnifying energy so long as a portion of said secondary winding remains electrically free relative to said primary winding; and wherein a temporal resonant frequency of said secondary winding is substantially equal to the drive frequency.

5. The wireless power transmitter of claim 4 wherein said secondary winding is formed from a conductor having an end nearest said primary winding coupled to earth ground.

6. The wireless power transmitter of claim 4 wherein said secondary winding is formed from a conductor having a length substantially equal to a quarter wave length of the drive frequency.

7. The wireless power transmitter of claim 4 wherein said secondary winding is formed from a conductor having a length substantially equal to an odd integer multiple of a quarter wave length of the drive frequency.

8. A passive power generation system, comprising:

a magnification section comprising:

a first primary winding loosely coupled to a first secondary winding wherein said first primary winding is electrically coupled to a generator for being driven at a drive frequency;

said first secondary winding comprised of a first portion having a first magnetic link with said first primary winding and a second portion having a second magnetic link with said first primary winding that is a percentage of said first magnetic link that achieves a magnification factor so that said first secondary winding will oscillate at the drive frequency;

a recovery section comprising:

a second primary winding loosely coupled to a second secondary winding;

said second primary winding of said recovery section electrically coupled in series with said first secondary winding of said magnification section for defining a secondary and primary series coupling; and a capacitive coupling means electrically coupled in series with said secondary and primary series coupling for tuning said recovery section to have a recovery drive frequency substantially equal to the drive frequency of said magnification section.

9. A passive power generation system, comprising:

a magnification section comprising:

a first primary winding loosely coupled to a first secondary winding wherein said first primary winding is electrically coupled to a generator for being driven at a drive frequency;

said first secondary winding comprised of a first portion having a first magnetic link with said first primary winding and a second portion having a second magnetic link with said first primary winding that is a percentage of said first magnetic link that achieves a magnification factor so that said first secondary winding will oscillate at the drive frequency;

a recovery section comprising:

a second primary winding loosely coupled to a second secondary winding;

said second primary winding of said recovery section electrically coupled in series with said first secondary winding of said magnification section for defining a secondary and primary series coupling;

a captive coupling means electrically coupled in series with said secondary and primary series coupling for tuning said recovery section to have a recovery drive frequency substantially equal to the drive frequency of said magnification section; and wherein said capacitive coupling means is comprised of a capacitance having a value (C) determined through the equation:

$$C=1/(4*\pi^2*f^2*(LmagS+LrecP))$$

where $\pi$=pi, f is the drive frequency,

LmagS is a value of inductance of said first secondary winding of said magnification section, and LrecP is a value of inductance of said second primary of said recovery section.

10. The system of claim 9 wherein the drive frequency (f) is equal to a quarter of a temporal resonance frequency of said first secondary winding of said magnification section.

11. The system of claim 9 wherein the drive frequency (f) is greater than a quarter of a temporal resonance frequency of said first secondary winding of said magnification section and less than half of a spatial resonance frequency of said first secondary winding of said magnification section.

12. The system of claim 9 wherein the drive frequency (f) is less than a quarter of a temporal resonance frequency of said first secondary winding of said magnification section and greater than a magnification factor of one.

13. The system of claim 10 wherein said first secondary winding of said magnification section is formed from a conductor having a length substantially equal to a quarter wave length of the temporal resonant frequency of said first secondary winding of said magnification section.

14. The system of claim 10 wherein said second primary winding of said recovery section is formed from a conductor having a length substantially equal to a quarter wave length of the temporal resonant frequency of said first secondary winding of said magnification section.

15. The system of claim 11 wherein said first secondary winding of said magnification section is formed from a conductor having a length substantially equal to a quarter wave length of the temporal resonant frequency of said first secondary winding of said magnification section.

16. The system of claim 11 wherein said second primary winding of said recovery section is formed from a conductor having a length substantially equal to a quarter wave length of the temporal resonant frequency of said first secondary winding of said magnification section.

17. The system of claim 12 wherein said first secondary winding of said magnification section is formed from a conductor having a length substantially equal to a quarter wave length of the temporal resonant frequency of said first secondary winding of said magnification section.

18. The system of claim 12 wherein said second primary winding of said recovery section is formed from a conductor having a length substantially equal to a quarter wave length of the temporal resonant frequency of said first secondary winding of said magnification section.

19. The system of claim 10 wherein said first secondary winding of said magnification section is formed from a conductor having a length substantially equal to an odd integer multiple of a quarter wave length of the temporal resonant frequency of said first secondary winding of said magnification section.

20. The system of claim 10 wherein said second primary winding of said recovery section is formed from a conductor having a length substantially equal to an odd integer multiple of a quarter wave length of the temporal resonant frequency of said first secondary winding of said magnification section.

21. The system of claim 11 wherein said first secondary winding of said magnification section is formed from a conductor having a length substantially equal to an odd integer multiple of a quarter wave length of the temporal resonant frequency of said first secondary winding of said magnification section.

22. The system of claim 11 wherein said second primary winding of said recovery section is formed from a conductor having a length substantially equal to an odd integer multiple of a quarter wave length of the temporal resonant frequency of said first secondary winding of said magnification section.

23. The system of claim 12 wherein said first secondary winding of said magnification section is formed from a conductor having a length substantially equal to an odd integer multiple of a quarter wave length of the temporal resonant frequency of said first secondary winding of said magnification section.

24. The system of claim 12 wherein said second primary winding of said recovery section is formed from a conductor having a length substantially equal to an odd integer multiple of a quarter wave length of the temporal resonant frequency of said first secondary winding of said magnification section.

25. A magnification section, comprising:

a secondary winding comprised of a first winding portion and a second winding portion;

a primary winding driven at a drive frequency and located relative to said first winding portion and said second winding portion of said secondary for inducing an electric field strength differential between said first winding portion and said second winding portion of said secondary wherein said electric field strength induced in said first winding portion is greater than said electric field strength induced in said second winding portion by an electric field strength amount that achieves a magnification factor; and wherein said primary winding includes a first number of turns and said secondary winding includes a second number of turns greater than said first number of turns of said primary for providing an inductive time constant for said secondary winding that is greater than a time between cycles of the drive frequency for allowing currents induced in said secondary winding by said primary winding to superimpose for magnifying power in said secondary as a function of said magnification factor.

26. A passive power generation system, comprising:

a magnification section comprising:

a first primary winding loosely coupled to a first secondary winding wherein said first primary winding is electrically coupled to a generator for being driven at a drive frequency;

said first secondary winding comprised of a first portion having a first magnetic link with said first primary winding and a second portion having a second magnetic link with said first primary winding that is a percentage of said first magnetic link that achieves a magnification factor so that said first secondary winding will oscillate at the drive frequency.

27. The system of claim 26, further comprising:

a recovery section, said recovery section comprising:

a second primary winding loosely coupled to a second secondary winding;

said second primary winding of said recovery section electrically coupled in series with said first secondary winding of said magnification section for defining a secondary and primary series coupling; and a capacitive coupling means electrically coupled in series with said secondary and primary series coupling for tuning said recovery section to have a recovery drive frequency substantially equal to the drive frequency of said magnification section.

* * * * *